US007591796B1

(12) United States Patent
Barak et al.

(10) Patent No.: US 7,591,796 B1
(45) Date of Patent: Sep. 22, 2009

(54) AUTOMATIC PORTABLE PNEUMATIC COMPRESSION SYSTEM

(75) Inventors: Jacob Barak, Oranit (IL); Sarit Dimir Gelbart, Givat Ada (IL); Amir Fabian, Zichron Yacov (IL); Yaakov Nizan, Tel-Aviv (IL)

(73) Assignee: Medical Compression Systems (DBN) Ltd., Or-Aqiva (IL)

( * ) Notice: Subject to any disclaimer, the term of this patent is extended or adjusted under 35 U.S.C. 154(b) by 1269 days.

(21) Appl. No.: 10/370,283

(22) Filed: Feb. 20, 2003

Related U.S. Application Data

(63) Continuation-in-part of application No. 09/941,909, filed on Aug. 29, 2001, now Pat. No. 7,063,676, which is a continuation of application No. 09/413,968, filed on Oct. 7, 1999, now Pat. No. 6,494,852, which is a continuation-in-part of application No. 09/375,083, filed on Aug. 16, 1999, now Pat. No. 6,447,467, and a continuation-in-part of application No. 09/038,157, filed on Mar. 11, 1998, now Pat. No. 6,478,757.

(60) Provisional application No. 60/424,288, filed on Nov. 6, 2002.

(51) Int. Cl.
*A61H 7/00* (2006.01)

(52) U.S. Cl. ..... 601/152

(58) Field of Classification Search ..... 602/5, 602/13, 19; 2/22; 601/27, 148–152; 128/882, 128/DIG. 20, DIG. 23; 606/201
See application file for complete search history.

(56) References Cited

U.S. PATENT DOCUMENTS

| | | | | |
|---|---|---|---|---|
| 2,823,668 A | | 2/1958 | Van Court et al. | |
| 3,164,152 A | | 1/1965 | Nicoll | |
| 3,186,405 A | | 6/1965 | Bailey et al. | |
| 3,424,151 A | * | 1/1969 | Ericson | 602/13 |
| 4,029,087 A | * | 6/1977 | Dye et al. | 601/152 |
| 4,157,713 A | | 6/1979 | Clarey | |
| 4,206,751 A | * | 6/1980 | Schneider | 601/152 |
| 4,266,298 A | | 5/1981 | Graziano | |
| 4,682,587 A | | 7/1987 | Curlee | |
| 4,682,588 A | | 7/1987 | Curlee | |
| 5,167,227 A | * | 12/1992 | Meserlian | 601/151 |
| 5,186,163 A | | 2/1993 | Dye | |
| 5,728,055 A | | 3/1998 | Sebastian | |
| 5,795,312 A | * | 8/1998 | Dye | 601/151 |
| 6,007,559 A | * | 12/1999 | Arkans | 606/201 |
| 6,315,745 B1 | | 11/2001 | Kloecker | |
| 6,468,237 B1 | * | 10/2002 | Lina | 601/150 |

* cited by examiner

*Primary Examiner*—Michael A. Brown
(74) *Attorney, Agent, or Firm*—Gauthier & Connors LLP

(57) ABSTRACT

An automatic portable ambulant miniaturized system for applying pneumatic pressure to a body limb including a portable ambulant hand-held fluid source unit, a conduit for delivering fluid generated by the unit, a pressure accumulator, and a pressure sleeve coupled to the conduit and adapted to envelop a body limb. The pressure sleeve contains one or more individually inflatable cells, each cell being subdivided into two or more longitudinally extending confluent intra-cell compartments along the axis of the body limb. The intra-cell compartments are inflated and deflated essentially simultaneously by the portable fluid source unit. The pressure accumulator can be flexibly tethered to and pneumatically connected to the fluid source unit, but not integral thereof. The pressure accumulator can also be integral with the pressure sleeve.

161 Claims, 41 Drawing Sheets

| | T1 | T2 | T3 | T4 | T5 | T6 | T7 |
|---|---|---|---|---|---|---|---|
| Valve 1 | + | - | - | - | - | - | - |
| Valve 2 | + | + | - | - | - | - | - |
| Valve 3 | + | + | + | - | - | - | - |
| Valve 4 | - | - | - | + | - | - | - |
| Valve 5 | - | - | - | + | + | - | - |
| Valve 6 | - | - | - | + | + | + | - |
| Compressor | + | + | + | + | + | + | - |

*FIG. 7*

AUTOMATIC PORTABLE PNEUMATIC COMPRESSION SYSTEM

CROSS-REFERENCE TO RELATED US PATENT APPLICATIONS

This application is a continuation-in-part of U.S. patent application Ser. No. 09/941,909, filed on Aug. 29, 2001 now U.S. Pat. No. 7,063,676; which is a continuation application of U.S. patent application Ser. No. 09/413,968, filed Oct. 7, 1999 now U.S. Pat. No. 6,494,852; which is a continuation-in-part of U.S. patent application Ser. No. 09/038,157, filed on Mar. 11, 1998 now U.S. Pat. No. 6,478,757 and a continuation-in-part of U.S. patent application Ser. No. 09/375,083, filed on Aug. 16, 1999 now U.S. Pat. No. 6,447,467. The entire contents of U.S. patent application Ser. Nos. 09/941,909; 09/413,968; 09/038,157; and 09/375,083 are hereby incorporated by reference.

PRIORITY INFORMATION

This application claims priority under 35 U.S.C. §119 to U.S. Provisional Patent Application Ser. No. 60/424,288, which was filed on Nov. 6, 2002. The entire contents of U.S. Provisional Patent Application Ser. No. 60/424,288 are hereby incorporated by reference.

FIELD OF THE PRESENT INVENTION

The present invention relates to medical devices for applying pressure to a region of a body surface. More particularly, the present invention relates to medical devices that use a pressure sleeve and a pressure accumulator to apply pressure to a region of a body surface.

BACKGROUND OF THE PRESENT INVENTION

The present invention relates to systems for applying compressive pressures against a patient's limb, specifically to a miniaturized, automatic portable battery and/or main power supply operated ambulant system.

Various conventional compression devices are known for applying compressive pressure to a patient's limb. These types of devices are used to assist in a large number of medical indications, mainly the prevention of deep vein thrombosis (DVT), vascular disorders, reduction of edemas, and the healing of wounds. Prior art devices are typically divided into two main segments: 1) a hospital segment, in which the conventional compression devices are used mainly for the prevention of DVT and 2) a home segment, in which the conventional compression devices are mainly used to treat severe lymphedema. Although showing high clinical efficacy in clinical studies in treating the above clinical indications, the conventional compression devices share many disadvantages that severely hamper their clinical out come in real life situations For example, the conventional compression devices use a conventional main power supply (wall outlet), and thus impose confinement upon the patient during the long periods of treatment e.g.: in DVT prevention after surgeries, the patients should be on therapy continuously from before the operation until discharge on a 24/7 basis. Confinement to the bed for receiving continuous treatment with a conventional device is impractical and is hardly ever achieved. Moreover the need to stay lying in bed for long periods of time delays recuperation, can lead to the development of pressure ulcers, and is contra-indicated to good medical practice.

The pump unit of the conventional compression device is heavy (5-15 pounds), which makes it hard to maneuver and place in the vicinity of the patients. The pump unit is also big and thus creates a storage problem, specifically in hospitals, in which tens and hundreds of units are stationed, usually in a special storage room.

The sleeve of the conventional compression device is big and ungainly, and thus restricts the movement of the limb it encompasses and imposes discomfort. In addition, the use of multiple cells demands the use of multiple conduits (usually one for each cell) making the whole system more cumbersome and harder to maneuver. Moreover, data corresponding to the pressure and compression cycles of the conventional compression systems has to be manually entered into the system by the clinical staff each time the system is turned ON. Furthermore, since the error detecting mechanism of the conventional systems shuts OFF the system each time an error is detected, the system needs to be manually restarted by the clinical staff, thereby requiring the clinical staff to manually re-enter the data corresponding to the pressure and compression cycles. In other words, in view of the need to manually enter the data corresponding to the pressure and compression cycles upon each start-up of the compression system and in view of the shutting down of the system upon error detection, with the accompanying re-entry of data, the conventional compression systems are overly dependent upon clinical staff for operation, thereby unduly imposing on the workload of the clinical staff.

All of the aforementioned disadvantages result in poor patient and therapist (mainly nurses) compliance and compliant. Clinical studies have proven that daily compliance of the systems is less then 50% resulting in far below expectation clinical outcomes compared to a continuous treatment (Prophylaxis against DVT after total knee arthroplasty, by Geoffrey H. Westrich, the Journal of bone and joint surgery vol. 78-A, June 1996. Why does prophylaxis with external pneumatic compression for DVT fail, by Anthony J. Comerota, the American journal of surgery vol. 164 September 1992 and others).

The conventional compression devices need to be as big and use the conventional electrical outlets for the power supply as conventional compression devices use the same basic shape of inflatable bladders in the sleeves. These conventional compression devices use substantial amounts of fluid (usually air) in order to inflate the sleeve and create the desired pressure at a timely manner (between 0.25-10 seconds per chamber). As a consequence, the conventional compression devices need large compressors that require high current supply, which forces the connection to the electrical outlets for power supply. The same follows with respect to the need for relatively large components in the conventional compression devices, such as solenoids, air conduits etc.

The need for a small ambulant/portable aesthetic device has long been recognized by the industry, as evident from prior patents of leading companies in this field; such as, U.S. Pat. Nos. 5,795,312; 5,626,556; 4,945,905; and 5,354,260, and 6,290,662 as well as EP 0861652, and others; are concerned with using less air to inflate the sleeves, easier handling, and all of the other disadvantages previously discussed.

One proposed solution introduced the use of foot pumps, another suggested an inelastic outer shell to limit the inflation of the cells and others proposed solutions focused upon improving the pumps (flow rate, power consumption, etc.) and not upon improving the use of the pumped air that would enable one to accomplish the same pressures in the same timely manner and the same therapeutic goals using about a fraction of the volume of air that the conventional compression devices need.

As noted above, in many medical conditions it is desirable to apply pressure to a region of the body surface. Conventionally, this is accomplished by fixing one or more individually inflatable cells to the body surface. When the cells are inflated, a pressure is applied to the body surface in contact with the cell. When the cell is deflated, the pressure is relieved. The cells are usually incorporated into a sleeve that is placed around a body limb to be treated. The limb may be, for example, a leg, an arm, a hand, a foot, or the trunk.

The cells may be toroidal in shape when inflated so as to completely surround the limb. A cell may be maintained in an inflated state for a prolonged period of time in order to apply prolonged pressure to the underlying body region. Alternatively, a cell may be inflated and deflated periodically so as to apply intermittent pressure to the underlying body region. A sleeve having one or more individually inflatable cells will be referred to herein as a pressure sleeve.

FIG. 16 shows schematically a prior art system for applying pressure to a body limb. The system uses a pressure sleeve (not shown) comprising one or more individually inflatable cells. The system also includes a console 615 containing a compressor 602 that generates pressurized air. A conduit 607 conducts the flow of pressurized air away from the compressor 602. A number of solenoid valves (605*a*, 605*b*, and 605*c*) equal to the number of cells in the pressure sleeve are positioned along the conduit 607. Each valve (605*a*, 605*b*, and 605*c*) has an air inlet connected to an upstream portion of the conduit 607, a first air outlet connected to a downstream portion of the conduit 607, and a second air outlet (611*a*, 611*b*, and 611*c*) connected to an associated cell via a conduit (614*a*, 614*b*, and 614*c*). Each valve can alternate between an open state in which pressurized air can flow between the inlet and the first outlet and the second outlet (611*a*, 611*b*, and 611*c*) and a closed state in which pressurized air can flow between the inlet and the first outlet, but not between the inlet and the second outlet (611*a*, 611*b*, and 611*c*).

The console 615 further comprises a processor 619 that controls the state of each of the valves (605*a*, 605*b*, and 605*c*) so as to execute a predetermined temporo-spatial array of inflation of the cells. For example, in one application the cells are inflated peristaltically so that one cell is first inflated, while the other cells are deflated. As illustrated in FIG. 16, this can be accomplished by the processor 619 opening the valve 605*a* while the valves 605*b* and 605*c* are closed. Pressurized air flows in the conduit 607 from the compressor 602 into the cell associated with conduit 614*a*. The processor 619 monitors the air pressure in the conduit 607 by means of a pressure gauge 603. When the pressure has reached a predetermined level, the processor 619 closes the valve 605*a*. Next, the cell associated with conduit 614*b* is inflated by opening the valve 605*b*. A one-way valve 625 prevents the flow of air in the conduit 607 from flowing from the valves (605*a*, 605*b*, and 605*c*) towards the compressor 602. The cell associated with conduit 614*a* is then deflated and the cell associated with conduit 614*c* is inflated. The cells associated with conduit 614*b* and 614*c* are then deflated, and the cycle can begin again.

The console 615 has a housing 620 containing the processor 619, the conduit 607 and the valves (605*a*, 605*b*, and 605*c*). The compressor 602 may be located within the housing of the console 615 as shown in FIG. 16.

In the conventional compression system as shown in FIG. 16, pressure in the cells rises gradually, starting when the valve 605*a* is opened until the final pressure is achieved. However, in some medical conditions it is beneficial to produce a fast inflation of the sleeve encompassing the body surface. Studies have shown that the velocity of venous flow or the increase in local arterial flow is proportional to the rate at which the pressure rises. In the prevention of DVT it is believed that this acceleration of venous flow reduces the risk of pooling and clotting of blood in the deep veins and therefore the rate of pressure rise is a critical variable of effectiveness in the prevention of DVT. In order to achieve a rapid inflation, it is known to incorporate in the housing 620 of the console 615 a pressure accumulator.

FIG. 17 shows schematically another conventional compression system for applying pressure to a body limb incorporating a pressure accumulator 740. This conventional compression system contains several components in common with the conventional compression system shown in FIG. 16.

As illustrated in FIG. 17, a solenoid valve 705*a* is positioned on the conduit 707 upstream from the valves (705*b*, 705*c*, and 705*d*). The valve 705*a* has an air inlet connected to an upstream portion of the conduit 707, a first air outlet connected to a downstream portion of the conduit 707, and a second air outlet connected to the pressure accumulator 740 via a conduit. The valve 705*a* can realize an open state in which flow of fluid may occur between the inlet, the first outlet, and the second outlet. The valve 705*a* can also realize a closed state in which flow of fluid may occur between the inlet and the first outlet but not between the second outlet and the inlet or between the second outlet and the first outlet. The processor 719 determines the operational state of valve 705*a*.

The conventional compression system shown in FIG. 17 is used when it is desired to apply pressure rapidly to a portion of a body limb underlying the cell. In this application, the valve 705*a* is opened while the valves (705*b*, 705*c*, and 705*d*) are closed, causing pressurized air to flow in the conduit 707 from the compressor 702 through the valve 705*a* into the accumulator 740. When the pressure in the accumulator 740 reaches a predetermined value $P_A$, as determined by the pressure gauge 703, the processor 719 opens the valve 705*b* causing air to flow from the accumulator 740 into the cell associated with value 705*b*. The pressure in the cell associated with valve 705*b* will rise rapidly to a pressure $P_C$. $P_A$ and $P_C$ satisfy the relationship $P_A V_A = P_C(V_A + V_C)$ where $V_A$ is the volume of the accumulator 740 and $V_C$ is the volume of the cell associated with value 705*b* when inflated. The valves 705*b*, 705*c*, and 705*d* are then operated as described in reference to the system of FIG. 16.

Systems of the type shown in FIG. 17 having an accumulator inside the console are disclosed, for example, in U.S. Pat. Nos. 4,653,130 and 5,307,791 to Senoue et al.; U.S. Pat. No. 5,027,797 to Bullard; U.S. Pat. No. 5,840,049 to Tumey et al.; and U.S. Pat. No. 5,588,955, to Johnson et al. The entire contents of U.S. Pat. Nos. 4,653,130; 5,307,791; 5,027,797; 5,840,049; and 5,588,955 are herby incorporated by reference.

As illustrated in FIG. 17, the presence of the accumulator 740 within the housing 720 of the console 715 adds to the size of the console 715. Thus, adding an accumulator to the console of a system that is otherwise miniature, mobile and battery operated makes the console, and hence the entire system, immobile, which destroys the advantages and benefits of a mobile system.

Therefore, it is desirable to provide a compression system that is small, ambulant, and portable. It is also desirable to provide a compression system that provides patients with continuous 24/7 treatment and freedom of movement. Furthermore, it is desirable to provide a compression system that is suitable for home use and can be stored easily. Moreover, it is desirable to provide a compression system that allows a user to engage in social activities during treatment. Lastly, it is desirable to provide a compression system that is includes a pressure accumulator that is small, ambulant, and portable.

SUMMARY OF THE PRESENT INVENTION

A first aspect of the present invention is a compression system for applying therapeutic pressure to a limb of a body. The compression system includes a pressure sleeve; a compression system console, pneumatically connected to the pressure sleeve, having a controller to provide controlled pressurized fluid to the pressure sleeve; and a pressure accumulator, flexibly tethered and pneumatically connected to the compression system console, to provide controlled pneumatic compression.

A second aspect of the present invention is a pressure sleeve. The pressure sleeve includes an integral pressure accumulator and an inflatable cell operatively pneumatically connected to the integral pressure accumulator.

A third aspect of the present invention is a compression system for applying therapeutic pressure to a limb of a body. The compression system includes a pressure sleeve; a compression system console, pneumatically connected to the pressure sleeve, having a controller to provide controlled pressurized fluid to the pressure sleeve; and a pressure accumulator integral to the pressure sleeve, pneumatically connected to the compression system console, to provide controlled pneumatic compression.

A fourth aspect of the present invention is a therapeutic foot device. The therapeutic foot device includes a pressure sleeve; a sole member; and a pressure accumulator provided in the sole member and operatively pneumatically connected to the pressure sleeve.

A fifth aspect of the present invention is a therapeutic foot system. The therapeutic foot system includes a pressure sleeve; a compression system console, pneumatically connected to the pressure sleeve, having a controller to provide controlled pressurized fluid to the pressure sleeve; a sole member; and a pressure accumulator provided in the sole member and operatively pneumatically connected to the pressure sleeve.

A sixth aspect of the invention is a therapeutic foot device. The therapeutic foot device includes a foot pressure sleeve and a pressure accumulator operatively pneumatically connected to the pressure sleeve. The pressure sleeve includes an inflatable cell. The inflatable cell includes at least two intra-cell compartments, the intra-cell compartments being confluent.

A seventh aspect of the present invention is a therapeutic foot system. The therapeutic foot system includes a pressure sleeve; a compression system console, pneumatically connected to the pressure sleeve, having a controller to provide controlled pressurized fluid to the pressure sleeve; and a pressure accumulator, operatively pneumatically connected to the pressure sleeve and flexibly tethered and pneumatically connected to the compression system console, to provide controlled pneumatic compression.

An eighth aspect of the present invention is a therapeutic pressure system. The therapeutic pressure system includes a pressure sleeve and a compression system console, pneumatically connected to the pressure sleeve, having a controller to provide controlled pressurized fluid to the pressure sleeve. The controller, upon entering a first mode, identifies a type of the pressure sleeve connected to the compression system console.

A ninth aspect of the present invention is a method of providing therapy with a pressure sleeve and a compression system console, pneumatically connected to the pressure sleeve, having a controller and a plurality of air conduit terminals to provide controlled pressurized fluid to the pressure sleeve. The method polls each air conduit terminal to determine a state thereof; determines automatically a type of pressure device connected to an air conduit terminal from the polling; determines automatically a treatment sequence and pressures based on the types of pressure devices connected to the air conduit terminals; and applies therapeutic pressure to a patient based on the determined treatment sequence.

A tenth aspect of the present invention is a method of providing therapy with a pressure sleeve and a compression system console, pneumatically connected to the pressure sleeve, having a controller and a plurality of air conduit terminals to provide controlled pressurized fluid to the pressure sleeve. The method polls each air conduit terminal to determine a state thereof; determines automatically a type of pressure device connected to an air conduit terminal from the polling; determines automatically a pressure to be applied based on the types of pressure devices connected to the air conduit terminals; and applies therapeutic pressure to a patient based on the determined pressure.

An eleventh aspect of the present invention is a method of providing therapy with a pressure sleeve and a compression system console, pneumatically connected to the pressure sleeve, having a controller and a plurality of air conduit terminals to provide controlled pressurized fluid to the pressure sleeve. The method polls each air conduit terminal to determine a state thereof; determines automatically a type of pressure device connected to an air conduit terminal from the polling; determines automatically a treatment sequence based on the types of pressure devices connected to the air conduit terminals; and applies therapeutic pressure to a patient based on the determined treatment sequence.

A twelfth aspect of the present invention is a device for applying pressure to a body limb having a primary axis. The device includes first and second inflatable cells, each of the first and second inflatable cells including at least three intra-cell compartments, the intra-cell compartments being confluent, each compartment being elongated along a longitudinal axis and being substantially rectangular in shape when deflated and substantially cylindrical in shape when inflated, the first and second inflatable cells being longitudinally adjacent each other and arranged coaxially with respect to the primary axis of the limb when engaged with a limb, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond of an inflatable cell including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the adjacent intra-cell compartments within a cell being spatially fixed relative to each other such that upon inflation of the adjacent intra-cell compartments within the cell, the cell becomes circumferentially constricted, the first and second inflatable cells being non-confluent such that that the first and second inflatable cells are separately inflatable; means for laterally coupling outermost compartments so as to form a sleeve such that the sleeve has a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the sleeve when laterally uncoupled and deflated, the second circumference value being a length between the outermost intra-cell compartments of the sleeve when laterally uncoupled and inflated; and a compression system console including control means for determining the temporo-spatial regime of cell inflation.

Another aspect of the present invention is an automatic portable ambulant system for applying pressure to a body limb. The automatic portable ambulant system includes a sleeve including first and second inflatable cells, the first and second inflatable cells each including at least three intra-cell compartments, the intra-cell compartments being confluent, the intra-cell compartments being elongated along a longitudinal axis and being substantially rectangular in shape when deflated and substantially cylindrical in shape when inflated, the first and second inflatable cells being longitudinally adjacent to each other so as to be adapted to be arranged coaxially with respect to a primary axis of a body limb, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the first inflatable cell becoming circumferentially constricted when the intra-cell compartments of the first inflatable cell are inflated, the second inflatable cell becoming circumferentially constricted when the intra-cell compartments of the second inflatable cell are inflated, the first and second inflatable cells being non-confluent such that the first and second inflatable cells are separately inflatable; means for laterally coupling outermost compartments so as to form a sleeve such that the sleeve has a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the sleeve when laterally uncoupled and deflated, the second circumference value being a length between the outermost intra-cell compartments of the sleeve when laterally uncoupled and inflated; and a portable hand-held console unit for providing pressurized air to any one or more selected cells of the sleeve via a conduit, said console unit including a control unit for determining the sequence of cell inflation and deflation.

A further aspect of the present invention is a method for immobilizing a fractured bone in a limb. The method couples outermost intra-cell compartments of a sleeve around a limb, the sleeve comprising at least one inflatable cell, each including at least three intra-cell compartments, the intra-cell compartments being confluent and elongated along a longitudinal axis and being substantially rectangular in shape when deflated and being substantially cylindrical in shape when inflated, the longitudinal axes of the compartments substantially aligning with the primary axis of the limb, wherein the inflatable cells each comprise inner and outer shells of durable flexible material, the inner and outer shells being bonded together about a perimetric cell bond to define the inflatable cell therebetween, the inner and outer shells being further bonded together along compartmental bonds within the perimetric cell bond to define the plurality of intra-cell compartments, wherein the perimetric cell bond includes upper and lower perimetric cell bonds extending substantially in a lateral direction, and left and right perimetric cell bonds extending substantially in the longitudinal direction, and wherein the compartmental bonds partly extend between the upper and lower perimetric cell bonds, wherein the compartmental bonds include perforations to allow for confluent air flow between compartments within a cell, compartments within a cell being spatially fixed relative to each other such that upon inflation of a cell; and intermittently inflates one of the first or second inflatable cells to apply pressure to the limb by circumferentially constricting the intermittently inflated cell, the cell having a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the cell when laterally uncoupled and deflated, the second circumference value being a length between the outermost intra-cell compartments of the cell when laterally uncoupled and inflated.

Another aspect of the present invention is a device for applying pressure to a body limb having a primary axis. The device includes first and second inflatable cells, the first and second inflatable cells each including at least three intra-cell compartments, the intra-cell compartments being confluent, the intra-cell compartments being elongated along a longitudinal axis and being substantially rectangular in shape when deflated and substantially cylindrical in shape when inflated, the first and second inflatable cells being adjacent each other and arranged coaxially with respect to the primary axis of the limb, the first and second inflatable cells each including inner and outer shells of durable flexible material, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the first inflatable cell becoming circumferentially constricted when the intra-cell compartments of the first inflatable cell are inflated, the second inflatable cell becoming circumferentially constricted when the intra-cell compartments of the second inflatable cell are inflated, the first and second inflatable cells being non-confluent such that the first and second inflatable cells are separately inflatable; means for laterally coupling outermost compartments so as to form a sleeve such that the sleeve has a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the sleeve when laterally uncoupled and deflated, the second circumference value being a length between the outermost intra-cell compartments of the sleeve when laterally uncoupled and inflated; and a compression system console including control means for determining a temporo-spatial regime of cell inflation.

A further aspect of the present invention is an automatic portable ambulant system for applying pressure to a body limb. The system includes a sleeve including first and second inflatable cells, the first and second inflatable cells each including at least three intra-cell compartments, the intra-cell compartments being confluent, the intra-cell compartments being elongated along a longitudinal axis and being substantially rectangular in shape when deflated and substantially cylindrical in shape when inflated, the first and second inflatable cells being adjacent each other and arranged coaxially with respect to the primary axis of the limb, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the first inflatable cell becoming circumferentially constricted when the intra-cell compartments of the first inflatable cell are inflated, the second inflatable cell becoming circumferentially constricted when the intra-cell compartments of the second inflatable cell are inflated, the first and second inflatable cells being non-confluent such that the first and second inflatable cells are separately inflatable; means for laterally coupling the outermost intra-cell compartments within a cell so as to form a sleeve such that the sleeve has a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the sleeve when laterally uncoupled and deflated, the second circumference value being a length between the outermost intra-cell compartments of the sleeve when laterally uncoupled and inflated; and a portable hand-held compression system console for providing pressurized air to inflate selected cells of the sleeve via a conduit. The compression system console includes a control unit for determining the sequence of cell inflation and deflation.

A still further aspect of the present invention is a device for applying pressure to a body limb having a primary axis. The device includes an inflatable cell; the inflatable cell including at least two intra-cell compartments, the intra-cell compartments being confluent, each intra-cell compartment being elongated in a direction of the primary axis, the inflatable cell further including inner and outer shells of durable flexible material, the inner and outer shells being bonded together about a perimetric cell bond, the inner and outer shells being further bonded together along compartmental bonds within the perimetric cell bond to define each intra-cell compartment, the perimetric cell bond including upper and lower perimetric cell bonds, the compartmental bonds partly extending between the upper and lower perimetric cell bonds, the compartmental bonds including perforations to allow for confluent air flow between adjacent intra-cell compartments within the cell, adjacent intra-cell compartments being spatially fixed relative to each other, such that upon inflation, the cell becomes circumferentially constricted, the inflatable cell having a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the sleeve when laterally uncoupled and deflated, the second circumference value being a length between the outermost intra-cell compartments of the sleeve when laterally uncoupled and inflated.

Another aspect of the present invention is a device for applying pressure to a body limb having a primary axis. The device includes an inflatable cell, the inflatable cell including at least two intra-cell compartments, the intra-cell compartments being confluent to allow for confluent air flow between adjacent intra-cell compartments within the cell, adjacent intra-cell compartments being spatially fixed relative to each other, such that upon inflation, the cell becomes circumferentially constricted, the inflatable cell having a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the sleeve when laterally uncoupled and deflated, the second circumference value being a length between the outermost intra-cell compartments of the sleeve when laterally uncoupled and inflated.

A further aspect of the present invention is an automatic portable ambulant system for applying pressure to a body limb. The system includes an inflatable cell, the inflatable cell including at least two intra-cell compartments, the intra-cell compartments being confluent, each compartment being elongated in a direction of the primary axis, the inflatable cell further including inner and outer shells of durable flexible material, the inner and outer shells being bonded together about a perimetric cell bond, the inner and outer shells being further bonded together along compartmental bonds within the perimetric cell bond to define each intra-cell compartment, the perimetric cell bond including upper and lower perimetric cell bonds, the compartmental bonds partly extending between the upper and lower perimetric cell bonds, the compartmental bonds including perforations to allow for confluent air flow between adjacent intra-cell compartments within the cell, adjacent intra-cell compartments being spatially fixed relative to each other, such that upon inflation, the cell becomes circumferentially constricted, the inflatable cell having a first circumference value when the intra-cell compartments are deflated and a second circumference value when the intra-cell compartments are inflated, the second circumference value being less than the first circumference value so as to provide for circumferential constriction, the first circumference value being a length between the outermost intra-cell compartments of the sleeve when laterally uncoupled and deflated, the second circumference value being a length between the outermost intra-cell compartments of the sleeve when laterally uncoupled and inflated; and a portable hand-held compression system console including a control unit for determining a sequence of cell inflation and deflation.

Another aspect of the present invention is a device for applying pressure to a body limb having a primary axis. The device includes first and second inflatable cells, each of the first and second inflatable cells including at least three intra-cell compartments, the intra-cell compartments being confluent, each compartment being elongated along a longitudinal axis and being substantially rectangular in shape when deflated and substantially cylindrical in shape when inflated, the first and second inflatable cells being longitudinally adjacent each other and arranged coaxially with respect to the primary axis of the limb when engaged with a limb, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond of an inflatable cell including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the adjacent intra-cell compartments within a cell being spatially fixed relative to each other such that upon inflation of the adjacent intra-cell compartments within the cell, the cell becomes circumferentially constricted, the first and second inflatable cells being non-confluent such that that the first and second inflatable cells are separately inflatable, the intra-cell compartments, while being inflated, substantially simultaneously expanding in a direction substantially normal to a surface of the limb and contracting in a direction substantially coaxially to the surface of the limb; means for laterally coupling outermost compartments so as to form a sleeve; and a compression system console including control means for determining a temporo-spatial regime of cell inflation.

Another aspect of the present invention is an automatic portable ambulant system for applying pressure to a body limb. The automatic portable ambulant system includes a sleeve including first and second inflatable cells, the first and second inflatable cells each including at least three intra-cell compartments, the intra-cell compartments being confluent, the intra-cell compartments being elongated along a longitudinal axis and being substantially rectangular in shape when deflated and substantially cylindrical in shape when inflated, the first and second inflatable cells being longitudinally adjacent to each other so as to be adapted to be arranged coaxially with respect to a primary axis of a body limb, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the first inflatable cell becoming circumferentially constricted when the intra-cell compartments of the first inflatable cell are inflated, the second inflatable cell becoming circumferentially constricted when the intra-cell compartments of the second inflatable cell are inflated, the first and second inflatable cells being non-confluent such that the first and second inflatable cells are separately inflatable, the intra-cell compartments, while being inflated, substantially simultaneously expanding in a direction substantially normal to a surface of the limb and contracting in a direction substantially coaxially to the surface of the limb; means for laterally coupling outermost compartments so as to form a sleeve; and a portable hand-held compression system console including a control unit for determining the sequence of cell inflation and deflation.

A further aspect of the present invention is a method for immobilizing a fractured bone in a limb. The method couples outermost intra-cell compartments of a first inflatable cell having a plurality of intra-cell compartments and outermost intra-cell compartments of a second inflatable cell having a plurality of intra-cell compartments, the coupling of the outermost intra-cell compartments of first and second inflatable cells forming a sleeve around a limb, the sleeve comprising, each including at least three intra-cell compartments, the intra-cell compartments being confluent and elongated along a longitudinal axis and being substantially rectangular in shape when deflated and being substantially cylindrical in shape when inflated, the longitudinal axes of the compartments substantially aligning with the primary axis of the limb, wherein the inflatable cells each comprise inner and outer shells of durable flexible material, the inner and outer shells being bonded together about a perimetric cell bond to define the inflatable cell therebetween, the inner and outer shells being further bonded together along compartmental bonds within the perimetric cell bond to define the plurality of intra-cell compartments, wherein the perimetric cell bond includes upper and lower perimetric cell bonds extending substantially in a lateral direction, and left and right perimetric cell bonds extending substantially in the longitudinal direction, and wherein the compartmental bonds partly extend between the upper and lower perimetric cell bonds, wherein the compartmental bonds include perforations to allow for confluent air flow between compartments within a cell, compartments within a cell being spatially fixed relative to each other such that upon inflation of a cell; and inflates one of the inflatable cells to apply pressure to the limb by circumferentially constricting the inflated cell, the intra-cell compartments of the inflated cell, while being inflated, substantially simultaneously expanding in a direction substantially normal to a surface of the limb and contracting in a direction substantially coaxially to the surface of the limb.

Another aspect of the present invention is a device for applying pressure to a body limb having a primary axis. The device includes first and second inflatable cells, the first and second inflatable cells each including at least three intra-cell compartments, the intra-cell compartments being confluent, the intra-cell compartments being elongated along a longitudinal axis and being substantially rectangular in shape when deflated and substantially cylindrical in shape when inflated, the first and second inflatable cells being adjacent each other and arranged coaxially with respect to the primary axis of the limb, the first and second inflatable cells each including inner and outer shells of durable flexible material, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the first inflatable cell becoming circumferentially constricted when the intra-cell compartments of the first inflatable cell are inflated, the second inflatable cell becoming circumferentially constricted when the intra-cell compartments of the second inflatable cell are inflated, the first and second inflatable cells being non-confluent such that the first and second inflatable cells are separately inflatable, the intra-cell compartments, while being inflated, substantially simultaneously expanding in a direction substantially normal to a surface of the limb and contracting in a direction substantially coaxially to the surface of the limb; means for laterally coupling outermost compartments so as to form a sleeve; and a compression system console including control means for determining a temporo-spatial regime of cell inflation.

A further aspect of the present invention is an automatic portable ambulant system for applying pressure to a body limb. The system includes a sleeve including first and second inflatable cells, the first and second inflatable cells each including at least three intra-cell compartments, the intra-cell compartments being confluent, the intra-cell compartments being elongated along a longitudinal axis and being substantially rectangular in shape when deflated and substantially cylindrical in shape when inflated, the first and second inflatable cells being adjacent each other and arranged coaxially with respect to the primary axis of the limb, the first and second inflatable cells each including inner and outer shells of durable flexible material, the inner and outer shells being bonded together to form a perimetric bond about a perimeter of the inflatable cell, the perimetric bond defining the inflatable cell as a volume between the inner and outer shells and within the perimetric bond, the inner and outer shells being further bonded together to form a plurality of compartmental bonds within the inflatable cell bond, the plurality of compartmental bonds defining at least three intra-cell compartments, the perimetric cell bond including first and second perimetric cell bond portions, the first and second perimetric cell bond portions being substantially parallel thereto, wherein a portion of the compartmental bonds partly extending between the first and second perimetric cell bond portions, the compartmental bonds extending between the first and second perimetric cell bond portions including perforations to allow for confluent air flow between adjacent intra-cell compartments within a cell, the first inflatable cell becoming circumferentially constricted when the intra-cell compartments of the first inflatable cell are inflated, the second inflatable cell becoming circumferentially constricted when the intra-cell compartments of the second inflatable cell are inflated, the first and second inflatable cells being non-confluent such that the first and second inflatable cells are separately inflatable, the intra-cell compartments, while being inflated, substantially simultaneously expanding in a direction substantially normal to a surface of the limb and contracting in a direction substantially coaxially to the surface of the limb; means for laterally coupling the outermost intra-cell compartments within a cell so as to form a sleeve; and a portable hand-held compression system console including a control unit for determining the sequence of cell inflation and deflation.

A still further aspect of the present invention is a device for applying pressure to a body limb having a primary axis. The device includes an inflatable cell; the inflatable cell including at least two intra-cell compartments, the intra-cell compartments being confluent, each intra-cell compartment being elongated in a direction of the primary axis, the inflatable cell further including inner and outer shells of durable flexible material, the inner and outer shells being bonded together about a perimetric cell bond, the inner and outer shells being further bonded together along compartmental bonds within the perimetric cell bond to define each intra-cell compartment, the perimetric cell bond including upper and lower perimetric cell bonds, the compartmental bonds partly extending between the upper and lower perimetric cell bonds, the compartmental bonds including perforations to allow for confluent air flow between adjacent intra-cell compartments within the cell, adjacent intra-cell compartments being spatially fixed relative to each other, such that upon inflation, the cell becomes circumferentially constricted. The intra-cell compartments, while being inflated, substantially simultaneously expand in a direction substantially normal to a surface of the limb and contract in a direction substantially coaxially to the surface of the limb.

Another aspect of the present invention is a device for applying pressure to a body limb having a primary axis. The device includes an inflatable cell, the inflatable cell including at least two intra-cell compartments, the intra-cell compartments being confluent to allow for confluent air flow between adjacent intra-cell compartments within the cell, adjacent intra-cell compartments being spatially fixed relative to each other, such that upon inflation, the cell becomes circumferentially constricted. The intra-cell compartments, while being inflated, substantially simultaneously expand in a direction substantially normal to a surface of the limb and contract in a direction substantially coaxially to the surface of the limb.

A further aspect of the present invention is an automatic portable ambulant system for applying pressure to a body limb. The system includes an inflatable cell, the inflatable cell including at least two intra-cell compartments, the intra-cell compartments being confluent, each compartment being elongated in a direction of the primary axis, the inflatable cell further including inner and outer shells of durable flexible material, the inner and outer shells being bonded together about a perimetric cell bond, the inner and outer shells being further bonded together along compartmental bonds within the perimetric cell bond to define each intra-cell compartment, the perimetric cell bond including upper and lower perimetric cell bonds, the compartmental bonds partly extending between the upper and lower perimetric cell bonds, the compartmental bonds including perforations to allow for confluent air flow between adjacent intra-cell compartments within the cell, adjacent intra-cell compartments being spatially fixed relative to each other, such that upon inflation, the cell becomes circumferentially constricted, the intra-cell compartments, while being inflated, substantially simultaneously expanding in a direction substantially normal to a surface of the limb and contracting in a direction substantially coaxially to the surface of the limb; and a portable hand-held compression system console including a control unit for determining a sequence of cell inflation and deflation.

BRIEF DESCRIPTION OF THE DRAWINGS

The present invention may take form in various components and arrangements of components, and in various steps and arrangements of steps. The drawings are only for purposes of illustrating a preferred embodiment and are not to be construed as limiting the present invention, wherein:

FIG. 7 is a table of programmed control parameters for a control unit in the case of two three-chambered sleeves according to the concepts of the present invention;

DETAILED DESCRIPTION OF THE PRESENT INVENTION

Figure 1:
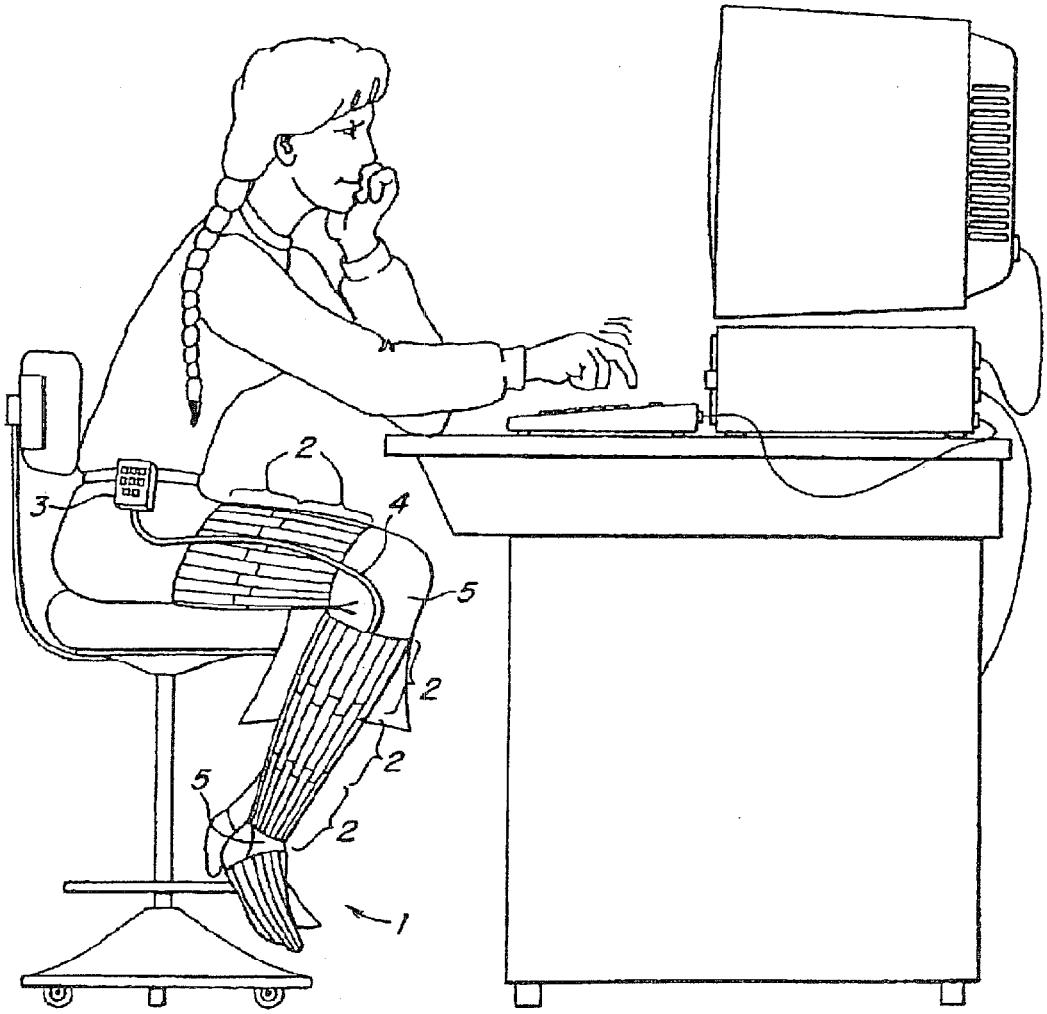
FIG. 1 is an illustration showing a massage sleeve according to the concepts of the present invention in use on the leg of a patient.

The present invention will be described in connection with preferred embodiments; however, it will be understood that there is no intent to limit the present invention to the embodiments described herein. On the contrary, the intent is to cover all alternatives, modifications, and equivalents as may be included within the spirit and scope of the present invention as defined by the appended claims.

For a general understanding of the present invention, reference is made to the drawings. In the drawings, like reference have been used throughout to designate identical or equivalent elements. It is also noted that the various drawings illustrating the present invention are not drawn to scale and that certain regions have been purposely drawn disproportionately so that the features and concepts of the present invention could be properly illustrated.

In the following, an embodiment of the present invention will be described for use on the leg of an individual. However, it is to be understood that the present invention is also intended for use on any body limb such as an arm, a foot, a part of a leg, arm or foot, and may be used on two or more limbs simultaneously.

In FIG. 1, a patient is depicted wearing a massaging sleeve 1 of the present invention on her leg while carrying out her routine duties. In FIG. 1, the trouser leg of the patient is cut away to reveal the sleeve. In practice, however, the sleeve remains concealed from view, and remains unnoticed even during operation when the cells are intermittently inflated. The sleeve 1 has an inner and outer surface composed of a durable flexible material and is divided into a plurality of cells 2 along its length and each cell is connected to the control unit 3 by a separate tube collectively labeled 4 in FIG. 1. Sections of the sleeve may be of non-inflatable elastic material 5, for example around the knee and ankle.

Figure 2:
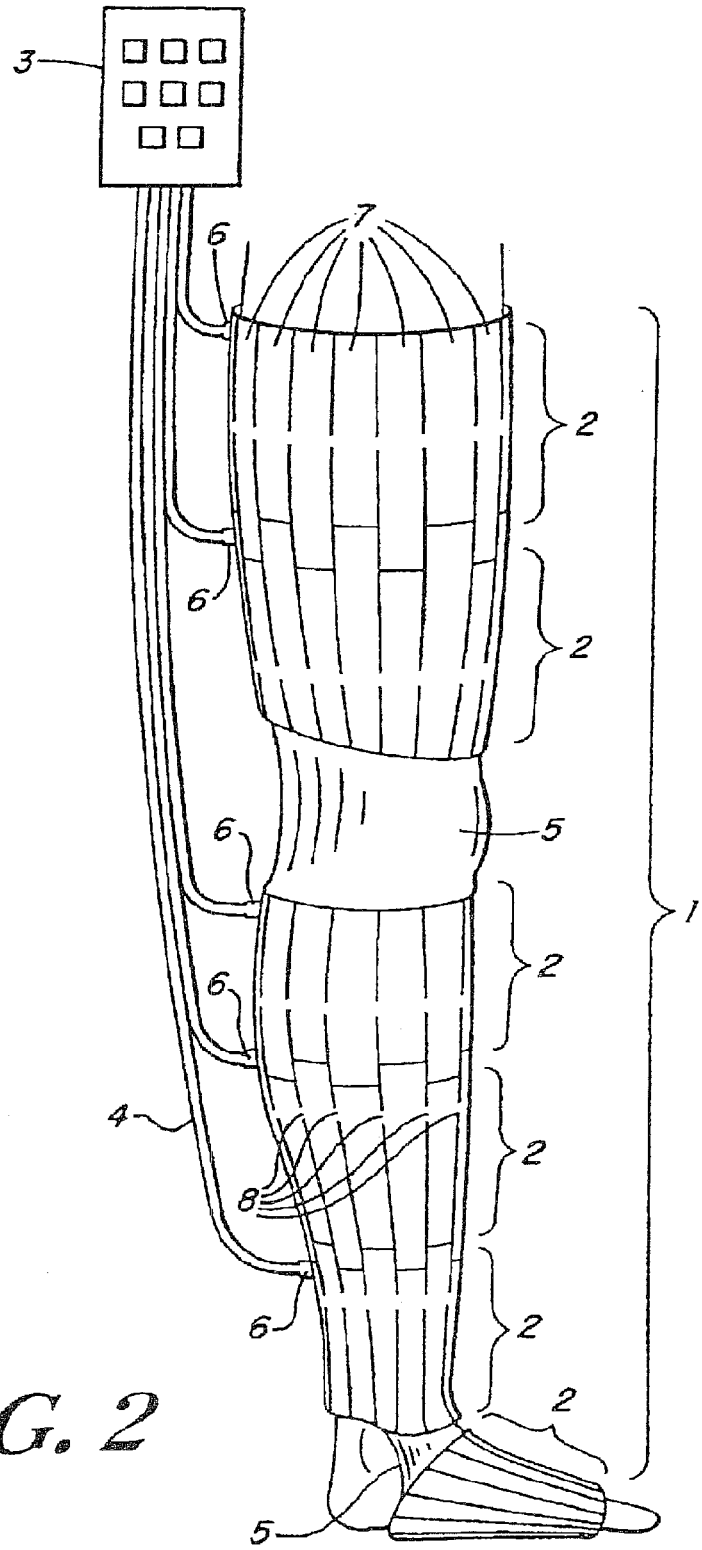
FIG. 2 is an illustration of a massage sleeve according to the concepts of the present invention mounted on the leg of a patient drawn to a larger scale.
Figure 3:
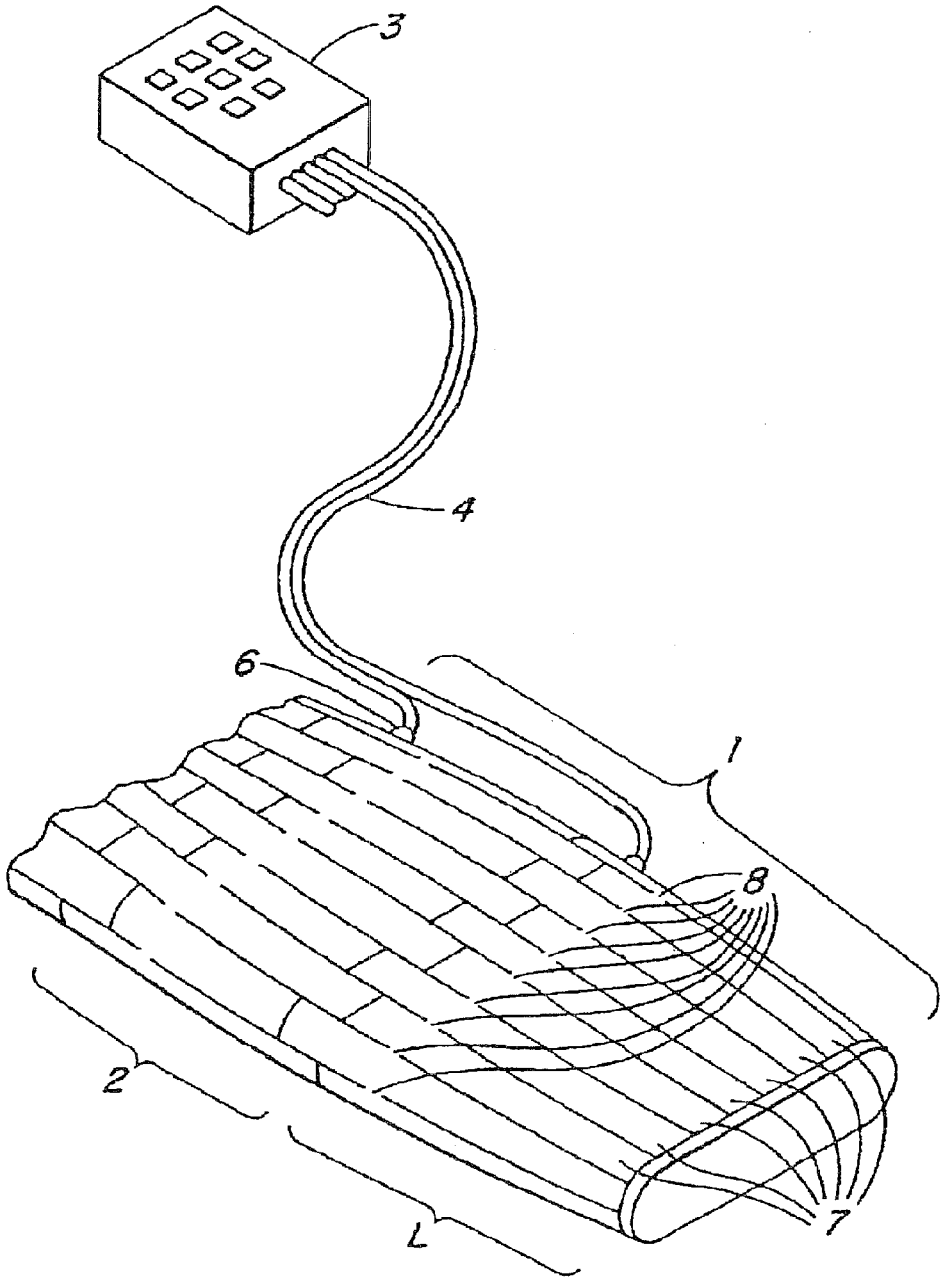
FIG. 3 is a partial perspective view of a massage sleeve according to the concepts of the present invention fitted with a control unit.

As can be seen in FIGS. 2 and 3, each cell has a fluid inlet opening 6 to which a hose 4 from the control unit 3 is attached. The control unit 3 contains a compressor capable of compressing and pumping ambient air into one or more selected cells in the sleeve via the hoses 4. The control unit 3 allows a temporo-spatial regime of inflation and deflation of the cells to be selected, e.g. a regime which generates peristaltic contractions of the sleeve so as to force fluids inside the limb towards the proximal end of the limb, or a regime which enhances the flow of the venous blood in the limb. The continuity of the peristaltic wave is enhanced by interdigitating the compartments of adjacent cells in the massaging sleeve as shown in FIGS. 2 and 3.

In accordance with the present invention, the cells are subdivided into a plurality of longitudinally extending intra-cell compartments 7. The intra-cell compartments 7 are formed, for example, by welding the inner and outer shells of the massaging sleeve along the boundaries of the intra-cell compartments. The intra-cell compartments 7 in a given cell are confluent due to perforations 8 in the seams between adjacent intra-cell compartments 7 so that all the intra-cell compartments 7 in the cell are inflated or deflated essentially simultaneously. Each intra-cell compartment 7, when inflated, assumes essentially the shape of a cylinder having its axis parallel to that of the limb.

Figure 18:
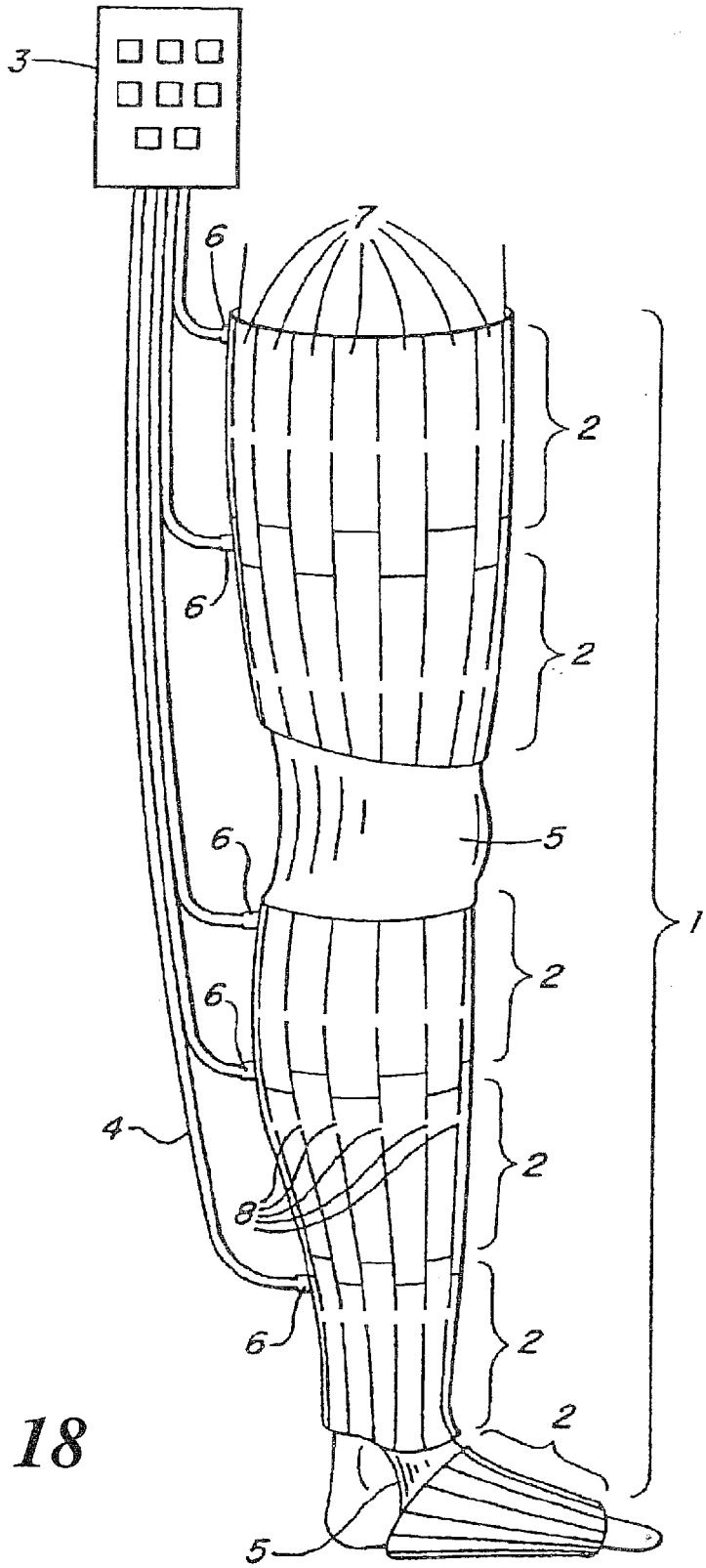
FIG. 18 is an illustration of another massage sleeve according to the concepts of the present invention mounted on the leg of a patient drawn to a larger scale.
Figure 19:
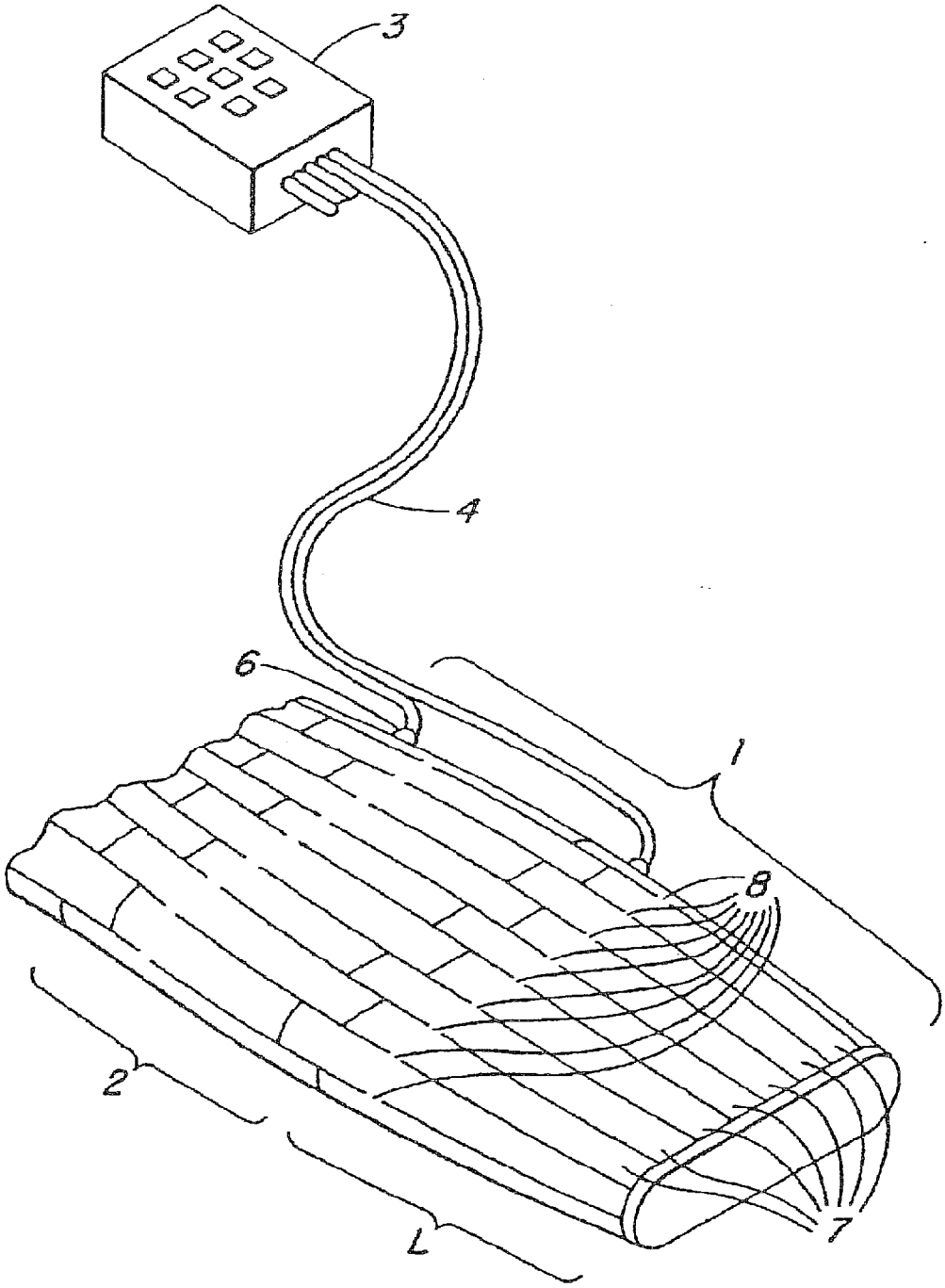
FIG. 19 is a partial perspective view of another massage sleeve according to the concepts of the present invention fitted with a control unit.

As can be seen in FIGS. 18 and 19, each cell has a fluid inlet opening 6 to which a hose 4 from the control unit 3 is attached. The control unit 3 contains a compressor capable of compressing and pumping ambient air into one or more selected cells in the sleeve via the hoses 4. The control unit 3 allows a temporo-spatial regime of inflation and deflation of the cells to be selected, e.g. a regime which generates peristaltic contractions of the sleeve so as to force fluids inside the limb towards the proximal end of the limb, or a regime which enhances the flow of the venous blood in the limb. Unlike FIGS. 2 and 3, the cells in FIGS. 18 and 19 are not interdigitated.

In accordance with the present invention, the cells of FIGS. 18 and 19 are subdivided into a plurality of longitudinally extending intra-cell compartments 7. The intra-cell compartments 7 are formed, for example, by welding the inner and outer shells of the massaging sleeve along the boundaries of the intra-cell compartments. The intra-cell compartments 7 in a given cell are confluent due to perforations 8 in the seams between adjacent intra-cell compartments 7 so that all the intra-cell compartments 7 in the cell are inflated or deflated essentially simultaneously. In one embodiment of the present invention, each intra-cell compartment 7, when inflated, assumes essentially the shape of a cylinder having its axis parallel to that of the limb.

Figure 4A:
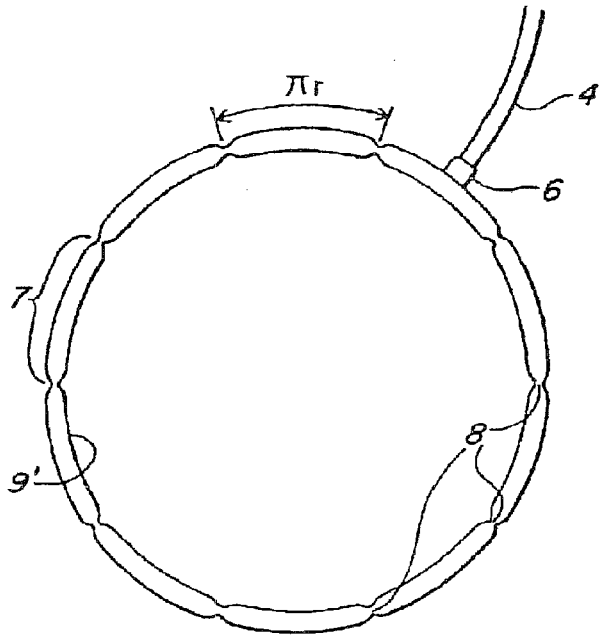
FIGS. 4A and 4B are cross-section views of a cell in the deflated and inflated states, respectively, according to the concepts of the present invention.
Figure 4B:
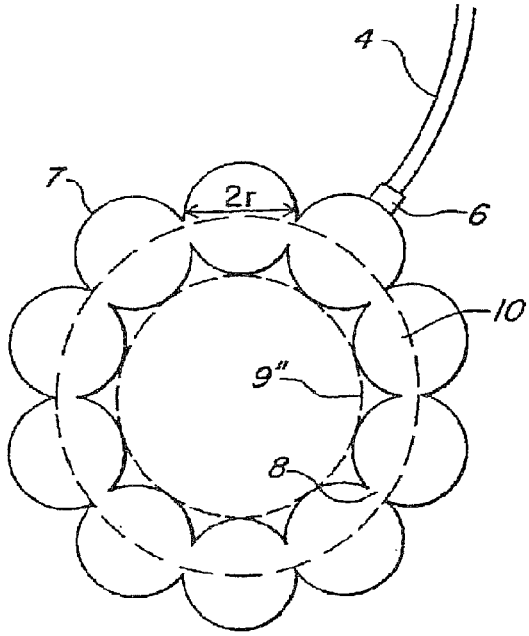

A theoretical cross-section of a deflated cell is shown in FIG. 4A, and FIG. 4B shows the same cross-section after inflation. The cell has been divided, by way of example, into ten intra-cell compartments 7, it being self-evident that any other number of intra-cell compartments may be used. If N is the number of intra-cell compartments in a given cell, and r is the radius of an inflated intra-cell compartment, then as can be seen in FIG. 4B the length of the circumference 10 that passes through the centers of the inflated intra-cell compartments 7 will be, theoretically, about 2Nr, whereas the circumference 9" of the deflated cell is, theoretically, about Nr. The theoretical fractional decrease in the circumference upon inflation is thus ((Nr−2Nr)/(Nr)) (1−2/) 0.36.

Due to various factors that will be discussed below in more detail, the length of the inner circumference 9" of the inflated cell, in actuality, will be something less than 2Nr so that the fractional decrease in the inner circumference upon inflation is thus is less than or about 0.36.

N and r are chosen so that Nr (the circumference of the deflated cell) corresponds to the original circumference of the limb segment contained within the lumen of the cell. The fractional decrease in the circumference of the cell upon inflation causes a contraction of the cell whereby pressure is applied to the limb that, as follows from the equation above, is independent of N and r.

Thus, by choosing N sufficiently large, and r correspondingly small, a sleeve is obtained having an inflated outer circumference not substantially larger than the original circumference of the limb. This is in contrast to conventional pressure sleeves, which must have a circumference greater than the initial circumference of the limb in order to achieve the same applied pressure as that produced by the present invention.

Letting now L be the height of a cell and C=Nr+w wherein w is the length attributed by the widths of the compartmental welds between the intra-cell compartments, the initial circumference of the limb contained within the cell, it is readily appreciated from FIG. 4A that the initial volume of the limb contained within the deflated cell is $V_D=(C/(2))^2L$. The final volume of the limb contained within the inflated cell is greater than $V_1=(0.64C/(2))^2L=0.4V_D$.

Inflating the cell thus leads to a decrease in the volume of the limb contained within the cell of less than or about equal to 60%. This decrease in volume represents the volume of fluid squeezed out of the limb or the work performed by the sleeve. This is accomplished by inflating the intra-cell compartments of the cell to a total volume of $V_T=Nr^2L=N(C/N)^2L=(C^2L)/N$.

In contrast to this, obtaining the same decrease in the volume of the limb by conventional compression methods requires inflating a cell to a final volume of $V_F=\{(1.36C/2)^2-(0.64C/2)^2\}L=(C^2L)/(2.8)$.

Thus, when the number of intra-cell compartments in the cell of the present invention is at least 3, the volume to which the cell must be inflated is less than that of conventional compression devices. Moreover, choosing N to be sufficiently large can obtain a decrease of 59% in the volume of the limb by inflating the cell to an arbitrarily small total volume. For example, when N=30, the total volume of the inflated cell is theoretically less than one-tenth of the volume of the inflated cell of the conventional compression devices. This allows a much smaller compressor to be used than is possible with conventional sleeves, thus permitting the patient to be ambulatory while being treated by the present invention.

Figure 33:
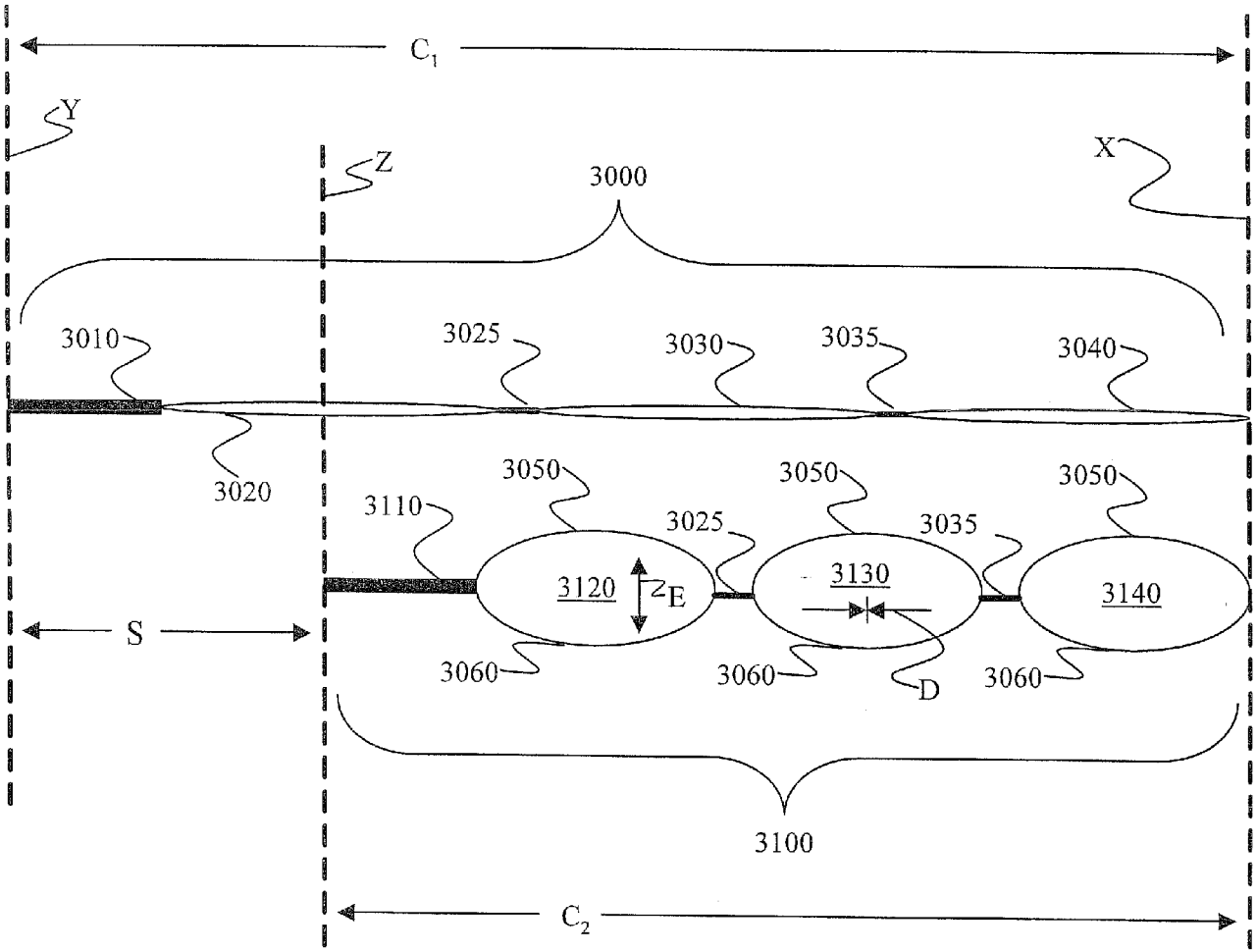
FIG. 33 illustrates the concept of circumferential constriction as employed by the present invention.

FIG. 33 provides a further illustration of the circumferential constriction concept of the present invention. As illustrated in FIG. 33, a deflated pressure sleeve 3000, includes a coupling device 3010, such as a hook and latch system, and three intra-cell compartments 3020, 3030, and 3040. It is noted that the coupling device 3010 couples or attaches to the intra-cell compartment 3040, in this example, to shape or form the pressure sleeve 3000 for therapeutic purposes.

The three intra-cell compartments 3020, 3030, and 3040 are formed from perimetric welds or bonds (not shown) and compartmental welds or bonds 3025 and 3035. Between adjacent intra-cell compartments 3020 and 3030 is compartmental weld 3025, and between adjacent intra-cell compartments 3030 and 3040 is compartmental weld 3035.

When the pressure sleeve is deflated, as shown by pressure sleeve 3000, and is decoupled, the pressure sleeve realizes a first circumference value $C_1$ as measured between points X and Y. On the other hand, as illustrated in FIG. 33, when the pressure sleeve is inflated, as shown by pressure sleeve 3100, and is decoupled, the pressure sleeve realizes a second circumference value $C_2$ as measured between points X and Z. The difference between the first circumference value $C_1$ and the second circumference value $C_2$ is a shortening value S. As noted above the greater the value S, the greater the volume decrease of the limb caused by the inflated pressure sleeve.

It is noted that the shortening value S is affected by many parameters of the sleeve, such as: (1) the chemical and physical properties of the material used in constructing the sleeve (elasticity, flexibility, etc.; (2) the thickness of the material layer; (3) as noted above, the width of the welding lines or compartmental bonds; (4) the number of layers that are welded together; (5) the specific parameters of the welding procedure that is used and how it affects the chemical and physical characteristics of the material; and (6) the inflation pressure.

The integrated effect of all these parameters is very difficult to predict and thus to practically handle their integrated effect an empirical factor f is utilized to define the shortening value S, or in other words, the amount of circumferential constriction realized by the pressure sleeve for a given pressure. Using the empirical factor f, S is defined as $f((-2)/)(C_1-((N-1)B))$ wherein $C_1$ is the actual length of the cell, as illustrated in FIG. 33, and B is the width of a single weld between two adjacent compartments; e.g., welds 3025 or 3035 as illustrated in FIG. 33.

The empirical factor f can be calculated for a pressure sleeve when it is inflated to a specific pressure.

Figure 34:
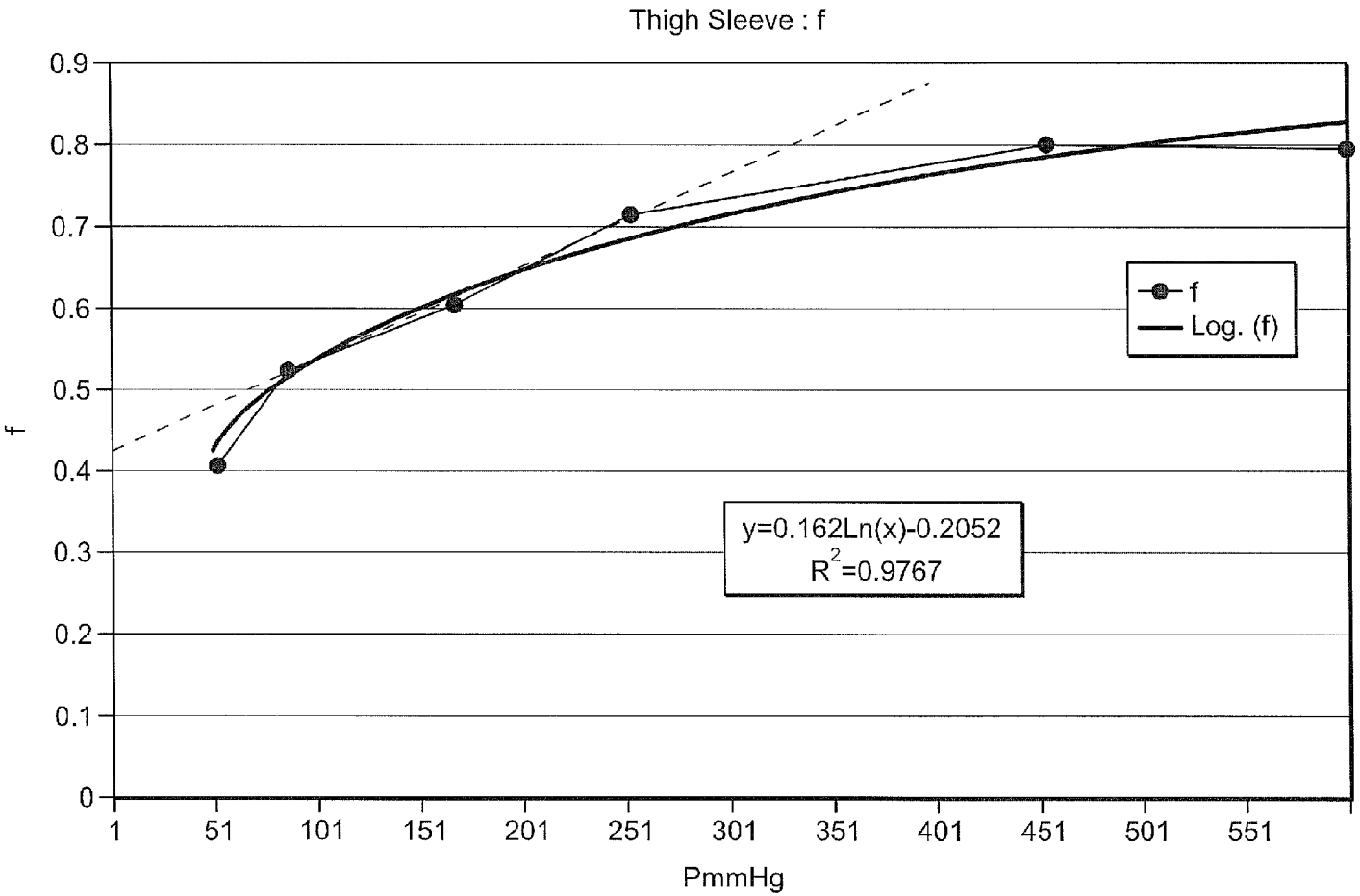
FIG. 34 graphically illustrates a relationship between pressure in an inflated pressure sleeve of the present invention and a constriction factor according to the concepts of the present invention.

For example, FIG. 34 illustrates a curve that defines the relationship between the various possible pressures within a pressure sleeve according to the concepts of the present invention and the empirical factor f. The empirical factor f was determined by filling the pressure sleeve to a predetermined pressure and then measuring its length to determine the shortening value S. Once S was determined, the above equation of $S=f((-2)/)(C_1-((N-1)B))$ was solved for f.

It is noted that pressures within the "clinical" or operational range (75 mmHg to ~250 mmHg) are the pressures of real interest, and thus, within this range, it can be seen that the pressure within a pressure sleeve has a nearly linear relationship with the empirical factor f, namely, f=a+bp where b is the slope of the line passing through the measured data points between ~75 mmHg and ~250 mmHg, a is the f-axis intercept, and p is the specific pressure within the pressure sleeve. More specifically, using the illustrated example of FIG. 34, the empirical factor f would equal 0.43+0.00116p.

Therefore, using the above-described methodology of measuring the shortening value S of the pressure sleeve at various pressures with the clinical or operational range, the empirical factor f of the specific pressure sleeve can be determined.

In using the relationships discussed above, a pressure sleeve according to the concepts of the present invention, which has an actual length ($C_1$) of 385 mm, a single weld width (B) of 1.7 mm, an empirical factor f of 0.53 at 85 mmHg, and contains 15 adjacent intra-cell compartments (N), would have a shortening value of about 68 mm. Such a shortening value would result in an about 33% reduction in the volume of the limb surrounded by the sleeve.

As can be seen from the discussion above and from FIG. 33, the present invention provides a pressure sleeve that is capable of realizing a volume reduction of up to 60% depending upon the pressure in the sleeve, the width of the welds, the material of the inner and outer shells, etc.

Another reason for the improved reduction is the present invention's utilization of the intra-cell compartments. The intra-cell compartments, through the compartment bonds or welds (3025 and 3035), enables the present invention to realize a greater volume reduction with respect to the limb with less air than the conventional devices.

More specifically, as illustrated in FIG. 33, as the intra-cell compartments are inflated, the intra-cell compartments expand dimensionally in a direction substantially normal to the surface of the limb, as illustrated by the double-ended arrow E. Moreover, as illustrated in FIG. 33, as the intra-cell compartments are inflated, the intra-cell compartments contract dimensionally in a direction substantially coaxially to the surface of the limb, as illustrated by the opposing arrows D.

The simultaneous expansion in one dimension and contraction in a substantial normal direction of the intra-cell compartments provides a circumferential constriction of the pressure sleeve and thus reducing the volume of the underlying limb and causing blood to flow from the area. Moreover, due to the simultaneous expansion in one dimension and contraction in a substantial normal direction of the intra-cell compartments, the present invention can also utilize less area and realize the same volume reduction, thus increasing the life of the air compressor and reducing the energy consumption of the device.

It is noted that a sleeve according to the present invention, e.g. such as sleeve 1 in FIGS. 1 and 2 or a smaller sleeve covering only a portion of a limb, may be used for immobilization of a fractured bone in a limb.

Figure 5:
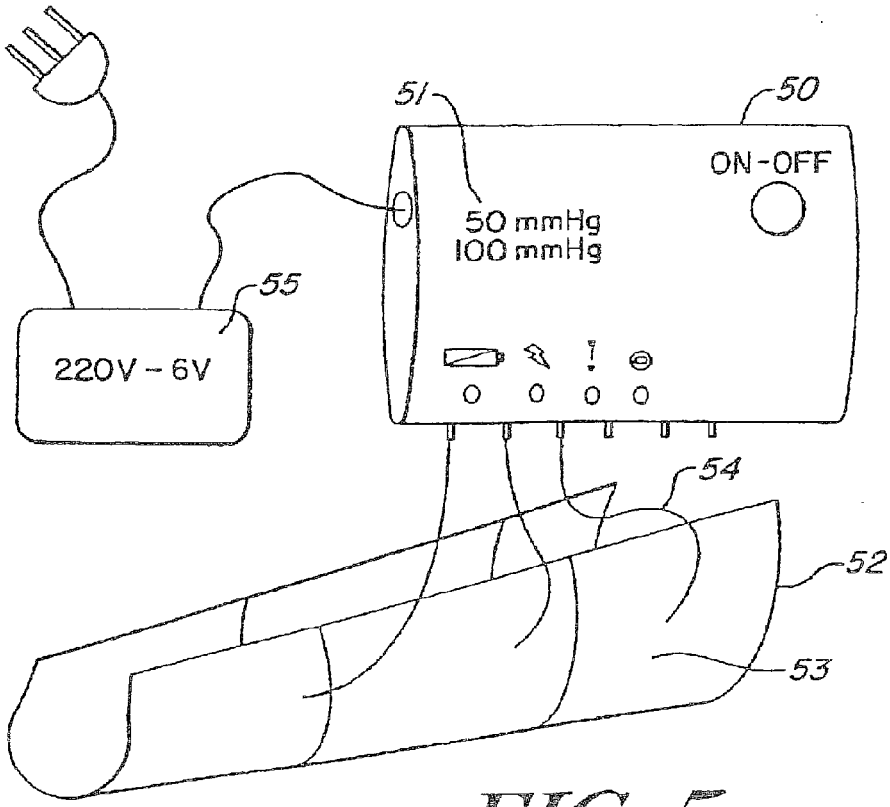
FIG. 5 is a block diagram of a pneumatic pressure system according to the concepts of the present invention.

FIG. 5 is a block diagram of a pressure system 50 includes a pump unit 51, which utilizes an electrical power supply/charger unit 55, such as a conventional electrical wall outlet, and an inflatable sleeve 52. The sleeve has a plurality of cells 53 arranged longitudinally along the sleeve. Conduits 54 connect the pump unit and the sleeve. The sleeve is placed over a limb and inflated, in some desirable cyclic manner by the pump unit, thus creating the desirable pressure cycle on the limb. It will be appreciated that the system can include at least one or more flexible sleeves 52 with single or multiple inflatable cells 53 adapted to be in contact with the body part to be treated. The best selection of a sleeve is one that requires small volume change to exert the needed pressure.

Figure 6:
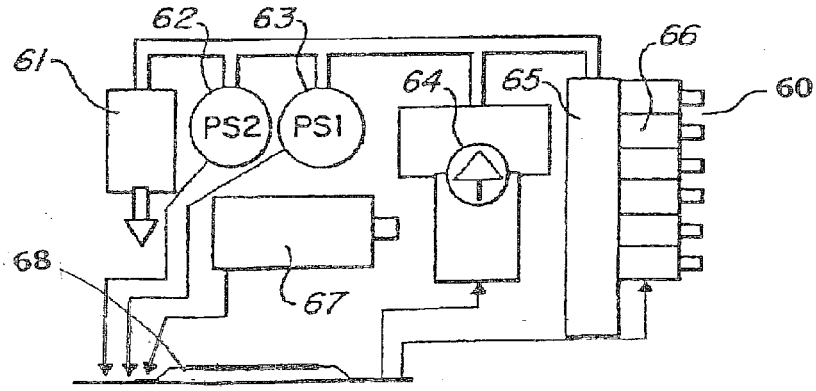
FIG. 6 is a schematic block diagram of a pump unit that corresponds to further details of the pump unit of FIG. 5, according to the concepts of the present invention.

FIG. 6 is a schematic block diagram of a pump unit 60 that corresponds to further details of the pump unit 51 of FIG. 5.

It will be appreciated that the thick interconnecting lines represent pneumatic connections, while the thin interconnecting lines represent electrical connections. The pump unit 60 includes an independent source of energy, such as a rechargeable battery pack 67, which enable the pneumatic device operation without a fixed connection to a main power outlet. The batteries can be bypassed and the device is able to operate for longer times, and the batteries can be recharged at the same time, while it is connected to the main power supply with the aid of the charger 55.

A source of compressed air, such as a compressor 64, is powered by the batteries or the main electrical outlet, and connected to the sleeve or sleeves 52 by pneumatic conduits 54. A control unit 68 is adapted to receive inputs from the operator and from pressure sensors 62 and 63. The control unit serves to read and control the operation of the compressor 64 and to control the cyclic inflating and deflating of the sleeve 53 (in FIG. 5). The control unit also controls the operation of solenoid valves 66, which receive and distribute the flow to the different cells 53 (in FIG. 5) with the aid of a manifold 65, to enable the sequential inflating and deflating of the multi-segmented sleeve's cells 53. It is noted that the compressor 64 may be housed with the control unit or may be housed separately.

Alternatively both hardware and software of the current invention enables the operation of the device from an external pressurized air and power sources. In some hospitals the source of pressurized air can be the central source of pressure-regulated supply that has wall outlets adjacent to the power outlets or that both the external power and pump sources could be an integral part of the patient's bed.

The use of miniaturized components like the compressor 64 and solenoid valves 66, together with the miniature accessories, results in small power consumption that enables the operation of the pneumatic device on batteries, while maintaining small dimensions and lightweight of the operating unit. The use of a sleeve 53 with a small-inflated volume will improve the obtained results of the operation unit for better clinical operation and results.

The operation of the system of the present invention will now be described. Pneumatic devices apply cyclic sequential pressure on a body's legs or arms. The cyclic sequential pressure is applied on the treated parts of the body by inflating and deflating each cell 53 of the sleeve 52 at a predefined timing. While being inflated, the multi-chambered segmented sleeve 52 should be encircling the part of leg to be treated. While the sleeve is inflated, a local pressure is applied at the contact area between the sleeve and the body.

The control unit 68, which can be software based, controls the operation of the compressor 64 and solenoid valves 66. The control unit can be programmed to achieve any desired inflating and deflating sequence and timing including delay intervals, in accordance with clinical application. For example, in the case of two three-chambered sleeves (six solenoid valves), the controller can be programmed to operate in accordance with the table of parameters for the control unit shown in FIG. 7.

Each time interval from the table (T1, T2 . . . T7), as illustrated in FIG. 7, can be changed independently. The patient or the therapist can control the pressure level of the treatment. An example of an exemplary operation of the system in accordance with the present invention is illustrated in the flowchart of FIGS. 8A-8E, describing self-checks and error detection processes, attached pressure device identification process for identifying pressure devices such as pressure sleeve/sleeves, pressure accumulators, or combinations thereof, as well as normal operation of the system.

Figure 8A:
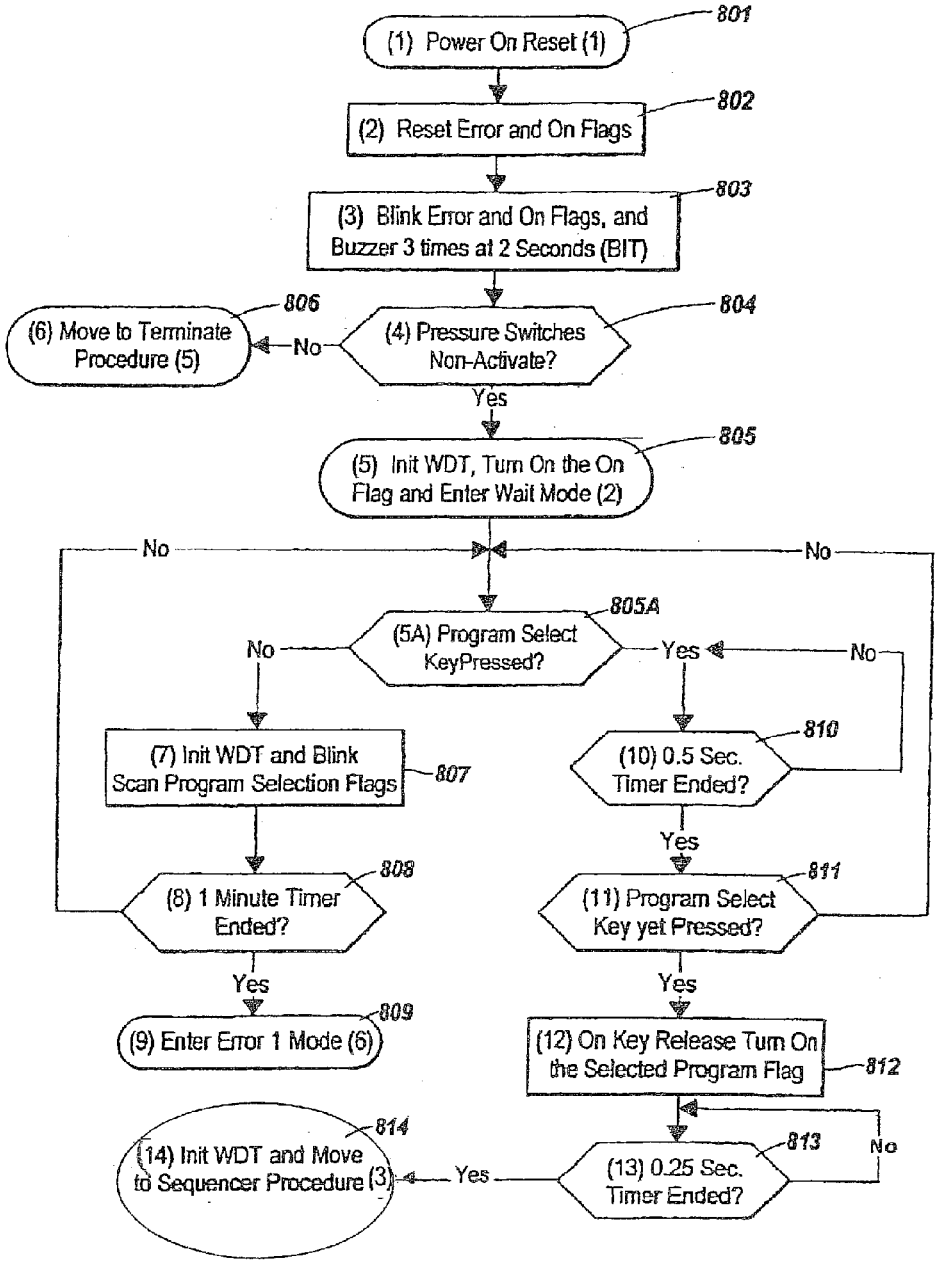
FIGS. 8A-8E illustrate flowcharts of an exemplary operation of the system according to the concepts of the present invention.

In FIG. 8A, the operation begins with on power reset (cold or hot) (801). The system initializes a built in test (BIT) procedure which checks the display, the buzzer and the pressure sensors (802, 803, 804). If the sensors are found to be activated at this stage, the system holds (through termination procedure ((806) and 837-840)). If the BIT ends correctly, the system resets the watchdog timer (WDT), which prevents locking of the system and turns on the ON Flag (on the display) (805), and enters the WAIT mode, where it waits for a program (treatment) selection.

A WAIT procedure starts at step (805A) where keys are checked. If keys are not pressed, the system blinks the program flags at the display (807). If more than 1 minute has passed without any key pressed (808), the system enters error mode 1 ((809) and (841-845)). Restarting the system is the only way to go back from this mode of operation.

If a program key is pressed, the system de-bounces for 0.5 sec and then checks the keys again (810). If no key is pressed after the de-bounce time, the system returns to the start of the WAIT procedure. If a key is pressed after the de-bounce time, the system turns on the selected program flag (on the display) (812), and after a 0.25 sec delay (813) resets the WDT and starts the sequencer procedure (815).

Figure 8B:
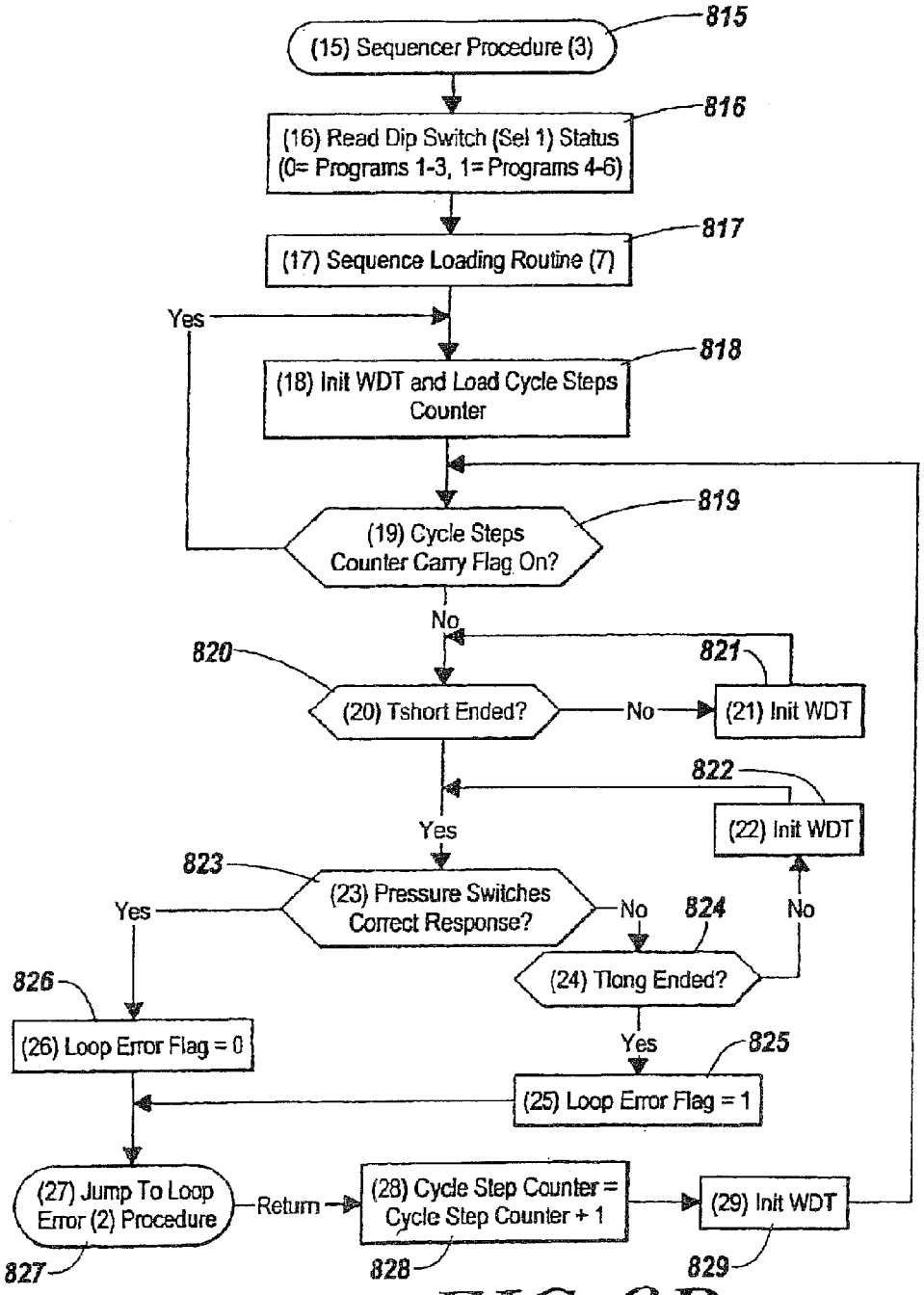

With reference now to FIG. 8B, at the first stage in the procedure reads the program group (Dip Switch) on the board (816). Note that this switch is hidden from the user. At that time, the requested treatment program is well defined, and the system starts loading data (817). This data can be loaded from two different sources, one a preloaded sequence that is part of the content of the system controlling processor. The second source is the sleeve itself, equipped with a special connector and internal memory, which enables special treatments to be supported (plug and play procedure) (Detailed data of this procedure provided in (864-868)). After the sequence has been loaded, the WDT resets again, and data is entered to the cycle counter (which holds the sequence data, as previously supplied) (818).

The sequence starts by moving data to the pump and the valves and continues with a short period delay before checking the pressure sensors (820). Until this delay is finished, the system waits (820-821). After that, the system checks the sensors (823). If the sensors do not react correctly until the max available time (823, 824, 822), a sequence step error is stored (825). Later on, those errors will be analyzed (830-836). If the sensors reacted correctly at the time window, a non-error flag is stored (826). The system branches to the error analyzing procedure (827 and 830). If the system returns (not enough errors to hold), the cycle step counter advances (828, 829) and the next step starts (819).

Figure 8C:
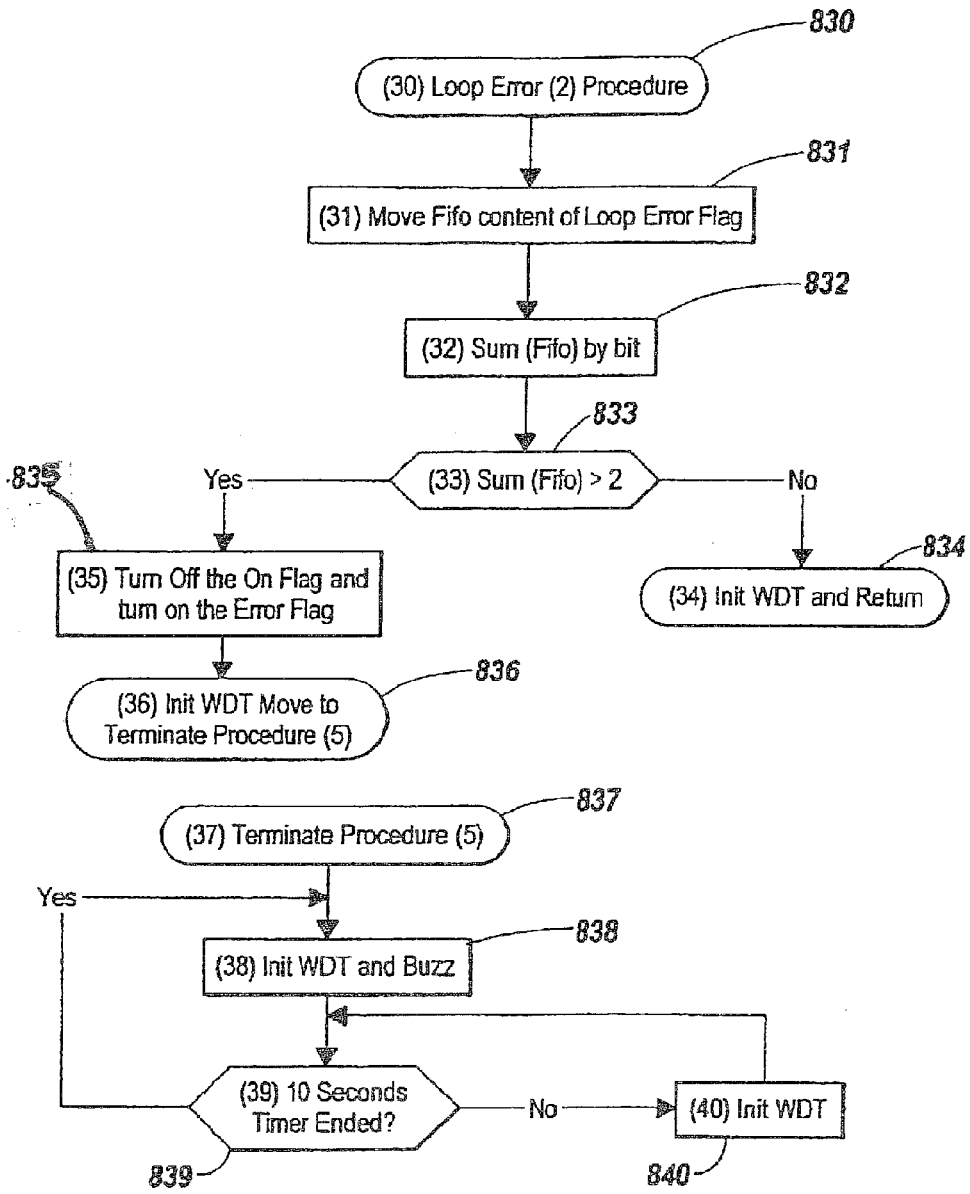

In FIG. 8C, the error analyzing procedure (830) starts by storing the last calculated error flag in a 24 bits long FIFO register (831). The number of errors in the register is counted (832) and if the number exceeds 2, i.e., 3 errors in 24 steps, the system starts a HOLD procedure (835, 836). The HOLD procedure starts turning off the ON flag on the display, and turning on the ERROR flag, and then proceeds to the termination procedure (837-840).

If the number of errors does not exceed 2, the system initializes the WDT and returns to step (827) and continues. The termination procedure is as follows. The termination procedure starts at step (837) by operating the buzzer (838), and waits 10 seconds (839, 840) before re-operating the buzzer.

Figure 8D:
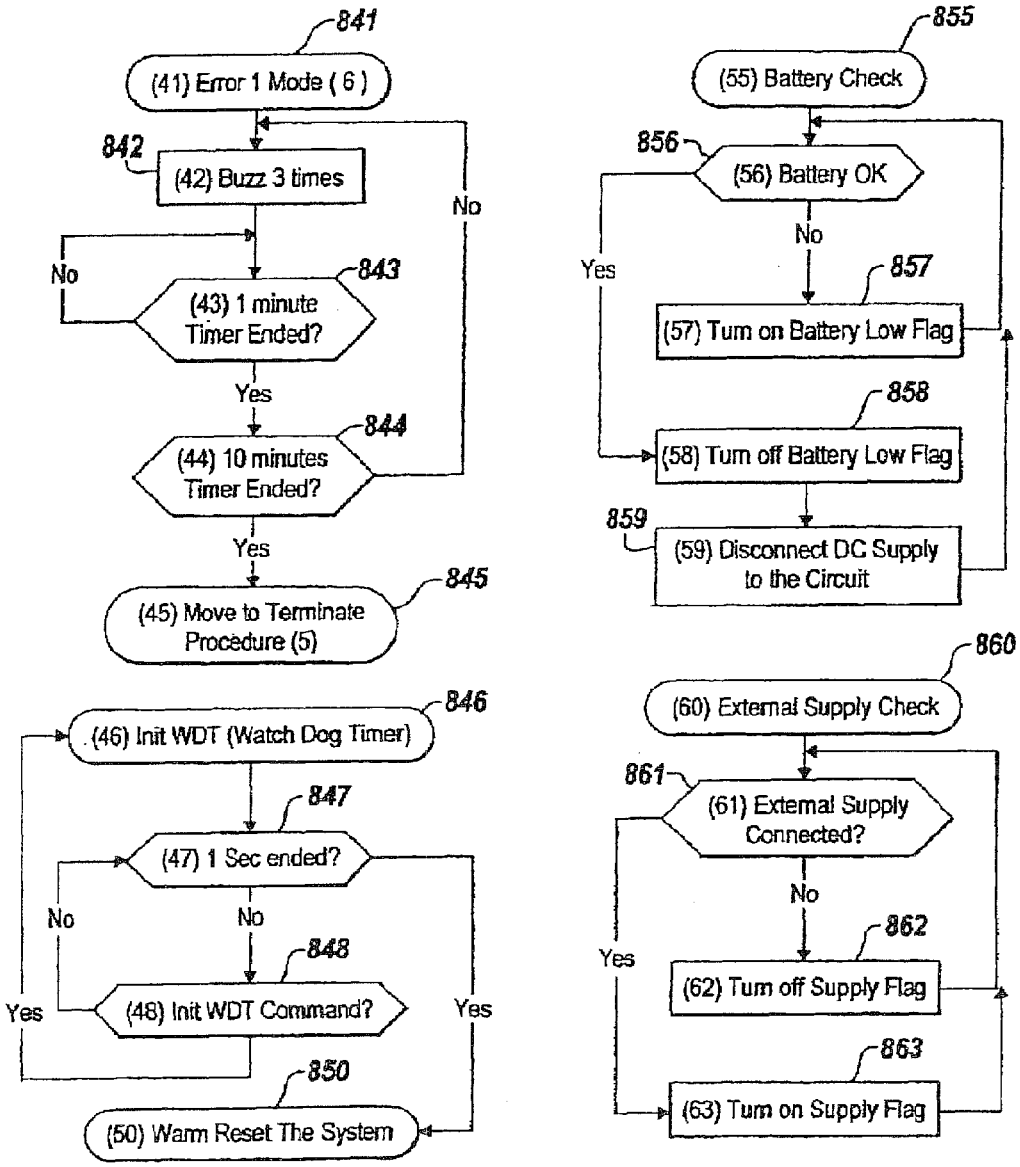

In FIG. 8D, an error 1 procedure is described. The error 1 mode starts at step (841), operates the buzzer 3 times, waits 1 minute (843), and if time from start (841) did not exceed 10 minutes (844), it repeats the buzz procedure. If yes, the system moves into the termination procedure (845 and 837).

The WDT procedure starts at step (846), by resetting and reprogramming the WDT counter to a 1 second interval. If, within this time interval (847) no WDT initialization pulse arrives (848), the WDT will reset the whole system (850).

Battery check procedure (855-859) uses hardware mechanisms that operate independently, without the software. External supply check procedure (860 to 863) uses hardware mechanisms that operate independently, without the software.

Figure 8E:
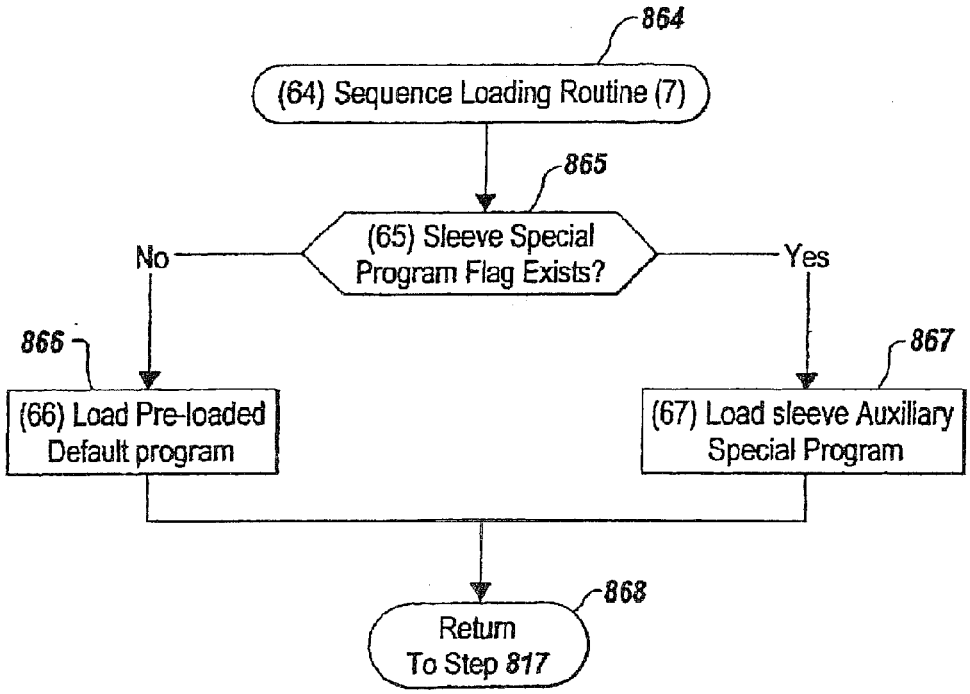

With reference to FIG. 8E, an internal/external sequence loading procedure is shown. This unique function of the system enables use of both pre-loaded treatment sequences in the pump unit processor (internal) and to receive new treatments parameters from an electronic unit placed within the sleeve's connector (external). The sleeve connector to the system includes, together with the air tubes, an electronic memory and/or processing device, the presence of which is detected by the system. Detecting such a device causes the system to load the sequence data from the sleeve memory, and not from the pre-loaded memory, which is part of the processor. This is referred to conventionally as a "plug and play" mechanism.

The procedure starts at step (864), then the system checks the presence of an intelligent sleeve (865). If one exists, the sequence is loaded from the intelligent sleeve (867). If no intelligent sleeve is detected, then the pre-loaded sequence is loaded (866). Finishing loading the system causes the program to return to the next step (817).

Figure 9:
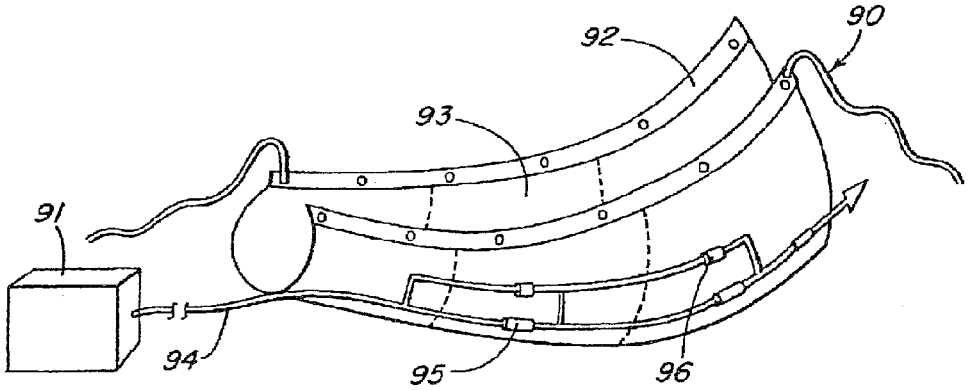
FIG. 9 is a block diagram of an alternative embodiment of a pneumatic pressure system according to the concepts of the present invention.

Additional miniaturization and mechanical simplification of the portable ambulant pneumatic pressure system of the present invention can be achieved by introducing self-operated relief valves replacing the controlled operated solenoid valves. Another embodiment of a portable pneumatic pressure system 90 of the present invention is illustrated in FIG. 9. The system includes a pump unit 91, at least one inflatable sleeve 92 with a single or multiple inflatable cells 93 adapted to be in contact with the body part to be treated.

An independent source of energy, for example rechargeable batteries, is provided which enables the pneumatic operation without a fixed connection to a main electrical power outlet, The batteries can be bypassed and thus system can operate for longer time periods while it is connected to the main power, and the batteries can be recharged at the same time.

Figure 10:
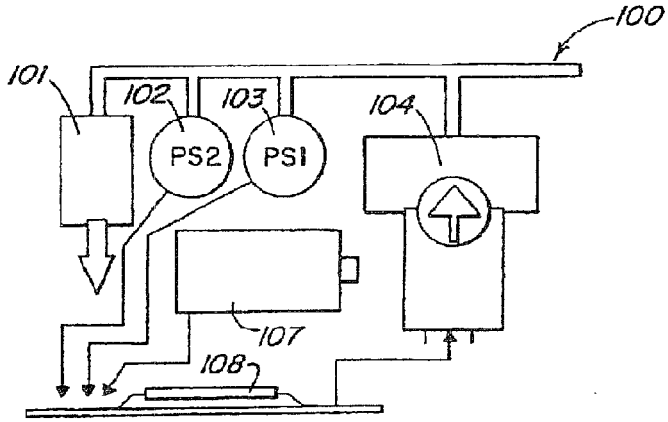
FIG. 10 is a schematic block diagram of a pump unit that corresponds to further details of the pump unit of FIG. 9.

FIG. 10 is a schematic block diagram of a pump unit 100 that corresponds to further details of the pump unit 91 of FIG. 9. It will be appreciated that the thick interconnecting lines represent pneumatic connections, while the thin interconnecting lines represent electrical connections. The pump unit 100 includes an independent source of energy, such as a rechargeable battery pack 107, which enable the pneumatic device operation without a fixed connection to a main power outlet. The batteries can be bypassed and the system is able to operate for longer times, and the batteries can be recharged at the same time.

A source of compressed air, such as a compressor 104, powered by the batteries or by the main power, is connected to the sleeve 92 or sleeves by one single pneumatic conduit 94, which enables inflating and deflating the cells 93. The compressor in this embodiment can enable the inverted flow to deflate the cells of the sleeve. It is possible to use a rotary compressor or to enable the inverted deflating flow by means of a valve, which may be solenoid operated and which is actuated by a control unit 108, or alternatively a pneumatic operated normally open valve can be used. The valve will be kept closed using the pressure of the compressor while the compressor is energized, and will open by itself when the compressor is stopped.

The control unit 108 is adapted to receive the operator's commands and control the operation of the compressor to control the cyclic inflating and deflating of the sleeve. Solenoid valves are replaced, in this embodiment, by self-operated relief valves 95, one with each chamber. The compressor is directly connected to the first cell. Each cell is connected to the next, one through a relief valve to regulate the pressure and maintain a pressure gradient. Each relief valve (except the last one) is bypassed with a conduit section including a check valve 96 to allow deflating of the cell. The last relief valve is open to the atmosphere, thus limiting the maximal pressure in the cells.

The control unit 108 controls the operation of the compressor 104 to inflate the first cell 93. The pressure in the first cell is built-up, and when it gets higher than the first relief valve 95 opening pressure, the second cell starts to be inflated. The third cell is inflated while the pressure in the second cell reaches the burst pressure of the second relief valve. The inflating process will continue in the same manner until the last cell is inflated. When the pressure in the last cell bursts the last relief valve, air will commence to flow out to the atmosphere preventing an uncontrolled pressure build-up inside the sleeve. When the operating interval of the compressor terminates, the controller de-energizes the compressor and enables all of the cells to be deflated simultaneously.

By using self-operated relief valves instead of the controlled solenoid valves, the system in accordance with the present invention will be smaller, lighter, have longer independent operation (as power consumption is reduced), and will be more cost effective. There will be a decrease in the operational flexibility because the relief valves are self-operated, and the controller is not able to control the inflating sequence of the cells.

The automatic portable ambulant pneumatic pressure system of the present invention is capable of treating more than one part of the body by connecting more than one sleeve to the pump unit. Sometimes, for medical reasons, the treatment is not symmetric on the body, i.e., treatment applied on the left calf and the right foot, and a different treatment is required in each sleeve. The sleeves used for the different treatments differ from each other by appearance because they are designed to operate on a different part of the body. They can also differ with the number of chambers and the connected conduits. The pump unit has the capability to operate each one of the sleeves with the appropriate medical treatment cycle.

The pump unit of the present invention can automatically identify the appropriate combination of treatments and/or pressures without requesting information from the operator. The operator selects the right sleeves and connects them to the pump unit. That will be sufficient for the system to identify the required treatment cycles and/or pressures and will prevent the possibility of mismatched input to the system by selecting a treatment and/or pressure, which is not suitable to the connected sleeves or vice versa.

To make a proper identification of the required treatment and or pressures, the present invention includes an identification system or process within the processor, which enables the present invention to correctly identify the combination of sleeves attached to it and automatically activates the appropriate operation algorithm. This capability is crucial if the device has to be kept as a user friendly "On/Off" device, in spite of its outstandingly high versatility depicted in its ability to operate foot/foot and calf/foot and thigh/calf/thigh sleeves and used on one or two legs with/with out pressure accumulator(s), and/or any proper combination thereof.

The identification system will now be briefly described. The present invention contains X solenoid operated valves, and each one of them is capable of connecting a pressure device, such as an air cell in a pressure sleeve or pressure accumulator, to a pressurized air source. The pressurized air source can be a central reservoir of pressurized air, internal or external air accumulator, or (usually) the air pump of the device itself. For each specific solenoid, two inflation time constants were determined: Tmax and Tmin.

A proper inflation time (Tn) of a pressure device has to be between Tmin and Tmax (Tmin<Tn<Tmax).

When Tn>Tmax in a normally functioning device, it means that either no pressure device was connected to the specific solenoid, that the pressure device that was connected is leaking, or the connected pressure device is not an authorized pressure device.

When Tn<Tmin in a normally functioning device, it means that the outflow tract of the specific solenoid is partially or completely blocked.

The above three described conditions are used by the present invention to correctly identify the pressure device or combination of pressure devices (wherein the pressure devices may be specialized pressure sleeves; such as foot pressure sleeves, calf pressure sleeves, thigh pressure sleeves or any combination thereof; pressure accumulators, or combinations thereof) attached to the present invention and automatically activates the appropriate operation algorithm A more detailed description of this identification process will be provided below in connection with the description of FIGS. 23-28.

Figure 23:
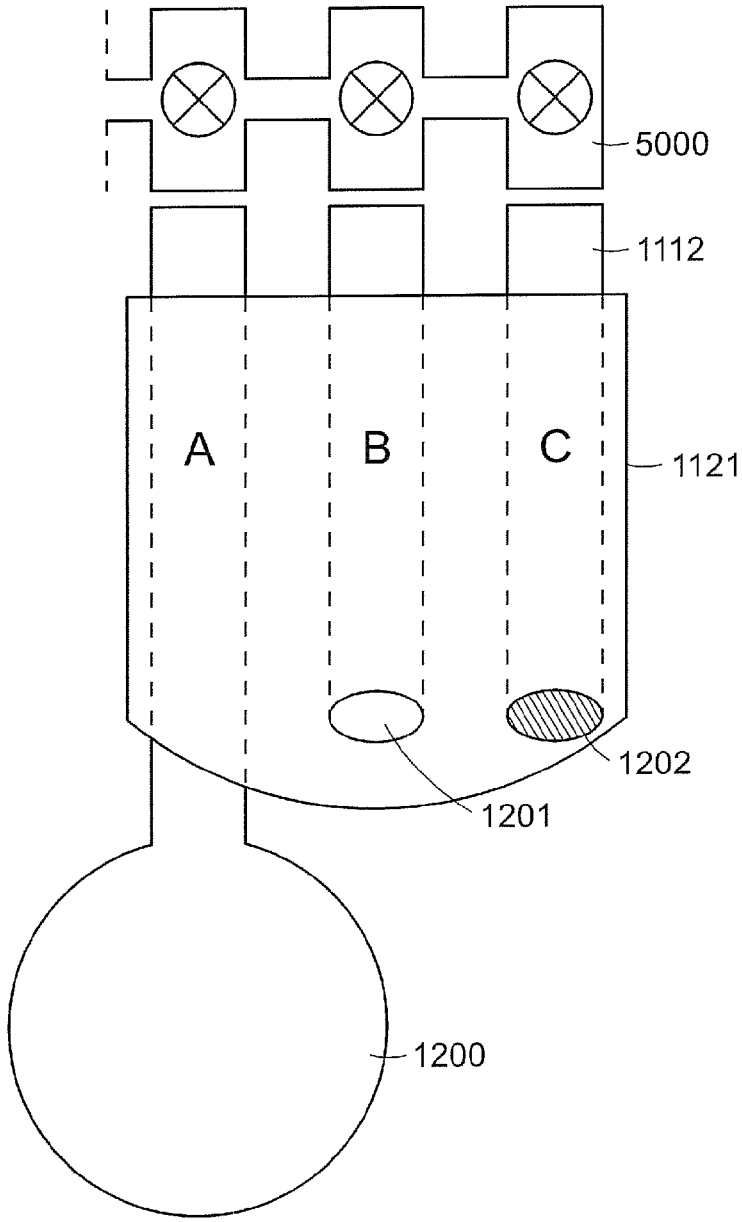
FIG. 23 illustrates possible states for an air channel or conduit connected to a pump device during an identification mode according to the concepts of the present invention.

After the present invention is turned ON, the present invention first runs a "checking program" that tests the inflation time (Tn) of each one of the X available solenoids. The test is done under "standard" pressure and pump flow conditions, and the solenoids are tested in sequence (1×). For each solenoid, the inflation time Tn can be or Normal ("A") or >Tmax ("B") or <Tmin ("C"), as illustrated in FIG. 23. More specifically, as shown in FIG. 23, an air conduit connector 1121 with air conduits or flow tracts 1112, each associated with one of X solenoids 5000, shows the three possible operational states of an air conduit or flow tract 1112 attached to a solenoid 5000.

As illustrated in FIG. 23, one of the air conduits or flow tracts is connected to an authorized pressure device (in this example, an air cell) 1200, and thus, the microprocessor detects an operational state "A." Another air conduit or flow tract is connected to an unauthorized pressure device, no pressure device, or a leaking pressure device (1201), and thus, the microprocessor detects an operational state "B." Lastly, a third air conduit or flow tract is connected to a pressure device that is partially or completely blocked or a solenoid that is partially or completely blocked (1202), and thus, the microprocessor detects an operational state "C."

The sequence of the results in all X solenoids creates a specific code that is representative of the state of the pressure device and/or the type of the pressure device connected to each solenoid. If this code is recognized by the microprocessor as a valid one (one that appears in its lookup table), the microprocessor will switch the device from the "checking program" into the specific operation process or algorithm. If the created code does not appear in the lookup table, the created code will be identified as invalid, and the microprocessor will deactivate the device. In a preferred embodiment, an audiovisual alarm will be activated. Examples of the possible code generation are illustrated in FIGS. 24 through 28.

Figure 24:
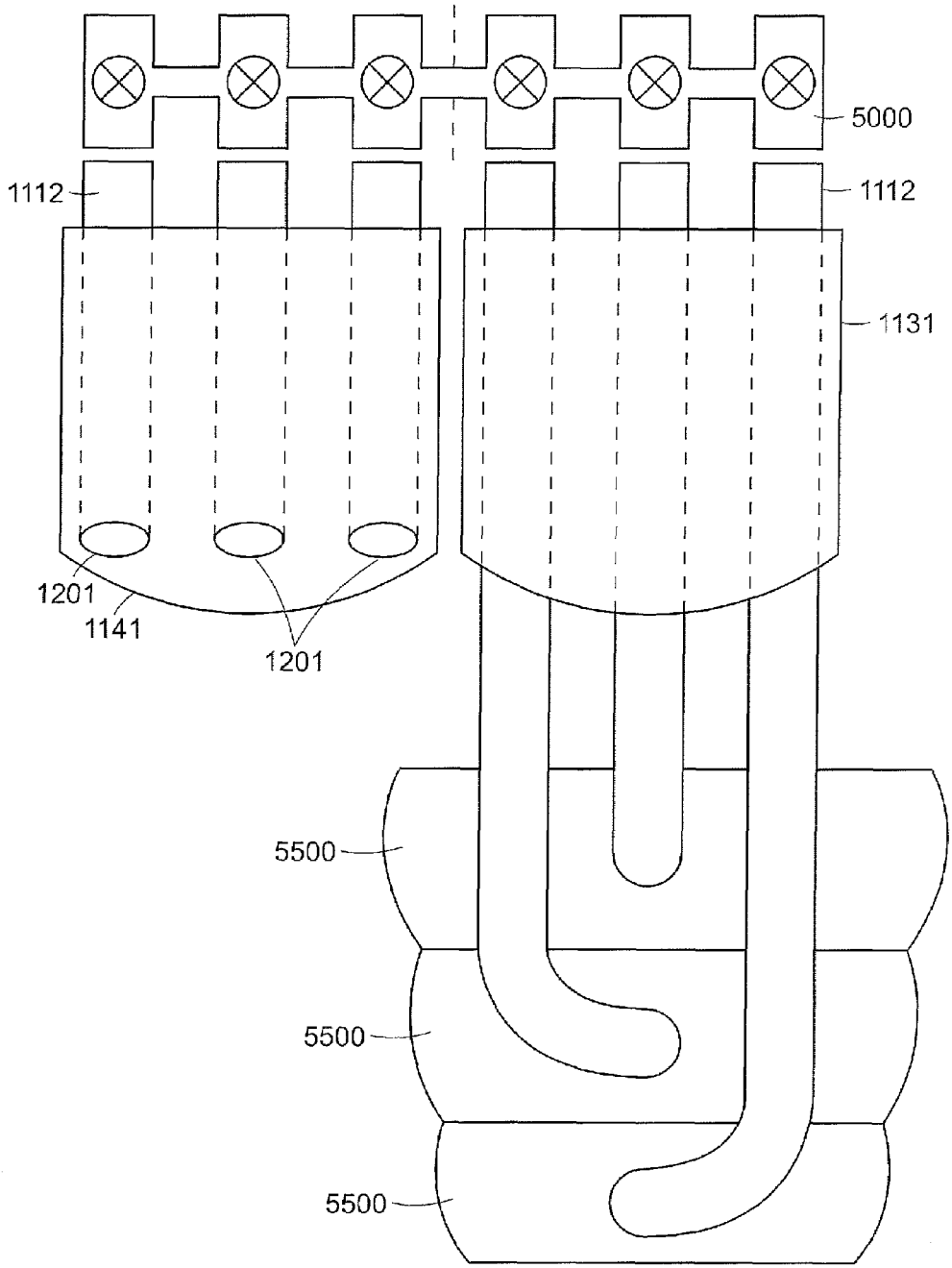
FIGS. 24-28 illustrate some of the possible combinations of pressure sleeve or pressure accumulator device connections to a pump device according to the concepts of the present invention.

In FIG. 24, an air conduit connector 1141 that has three air conduits or flow tracts 1112 connected to three solenoids 5000 will cause the microprocessor to create a code "BBB". As illustrated in FIG. 24, the code "BBB," in this example, is associated with air conduit connector 1141 being connected to no pressure devices (1201). Moreover, in FIG. 24, an air conduit connector 1131 that has three air conduits or flow tracts 1112 connected to three solenoids 5000 will cause the microprocessor to create a code "BBB". As illustrated in FIG. 24, the code "BBB," in this example, is associated with air conduit connector 1131 being connected to air cells 5500 of an unauthorized pressure device.

Figure 25:
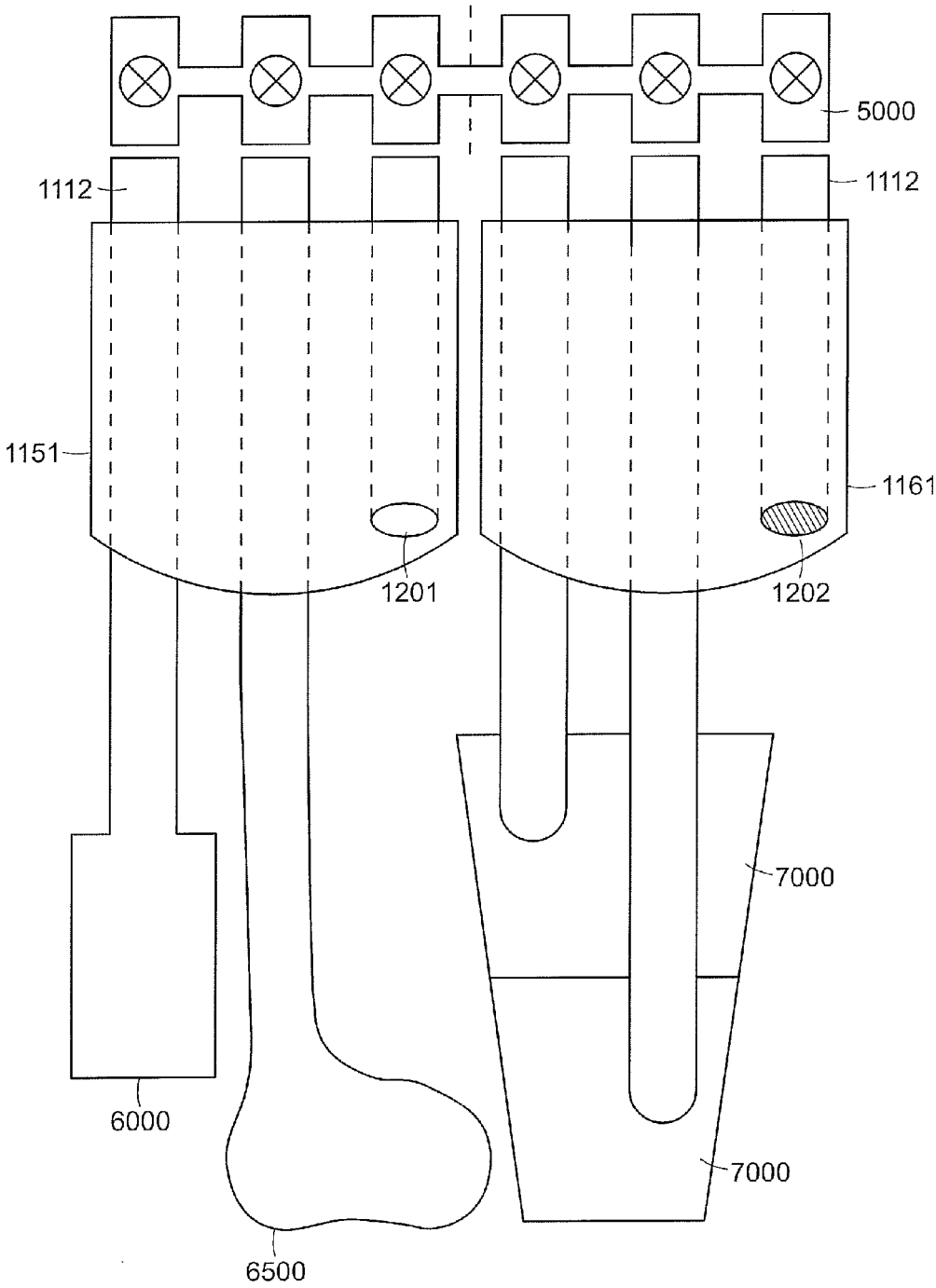

In FIG. 25, an air conduit connector 1151 that has three air conduits or flow tracts 1112 connected to three solenoids 5000 will cause the microprocessor to create a code "AAB". As illustrated in FIG. 25, the code "AAB," in this example, is associated with air conduit connector 1151 being connected to a pressure device comprising a pressure accumulator 6000, an air cell 6500 of a foot pressure sleeve, and no air cell 1201. Moreover, in FIG. 25, an air conduit connector 1161 that has three air conduits or flow tracts 1112 connected to three solenoids 5000 will cause the microprocessor to create a code "AAC". As illustrated in FIG. 25, the code "AAC", in this example, is associated with air conduit connector 1161 being connected to a pressure device having air cells 7000 of a double cell calf or thigh sleeve and blocked passage 1202.

Figure 26:
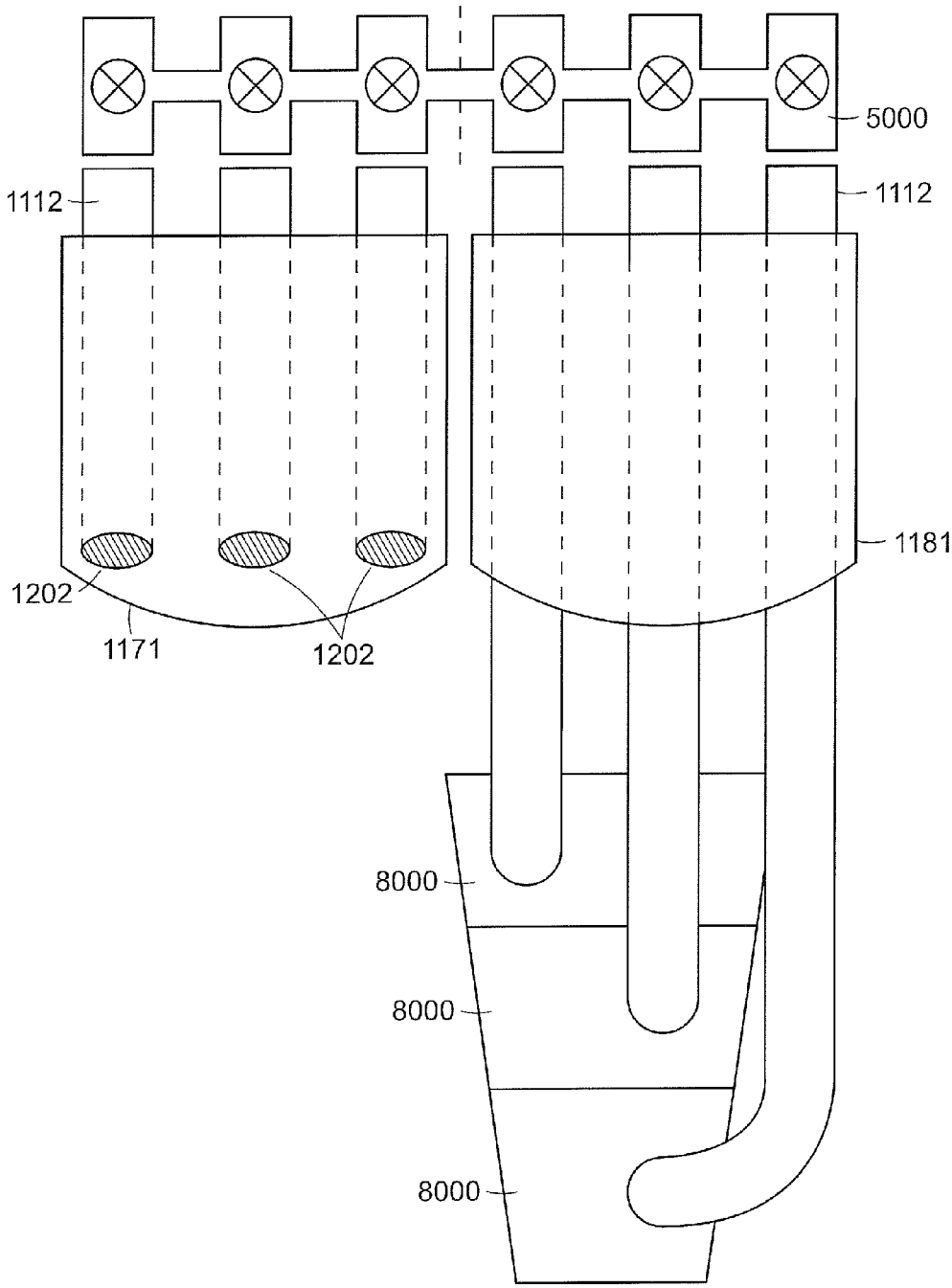

In FIG. 26, an air conduit connector 1171 that has three air conduits or flow tracts 1112 connected to three solenoids 5000 will cause the microprocessor to create a code "CCC". As illustrated in FIG. 26, the code "CCC," in this example, is associated with air conduit connector 1171 being connected to pressure devices (1202) that are partially or completely blocked or solenoid(s) (1202) that are partially or completely blocked. Moreover, in FIG. 26, an air conduit connector 1181 that has three air conduits or flow tracts 1112 connected to three solenoids 5000 will cause the microprocessor to create a code "AAA". As illustrated in FIG. 26, the code "AAA", in this example, is associated with air conduit connector 1181 being connected to a pressure device having air cells 8000 of a triple cell calf or thigh sleeve.

Figure 27:
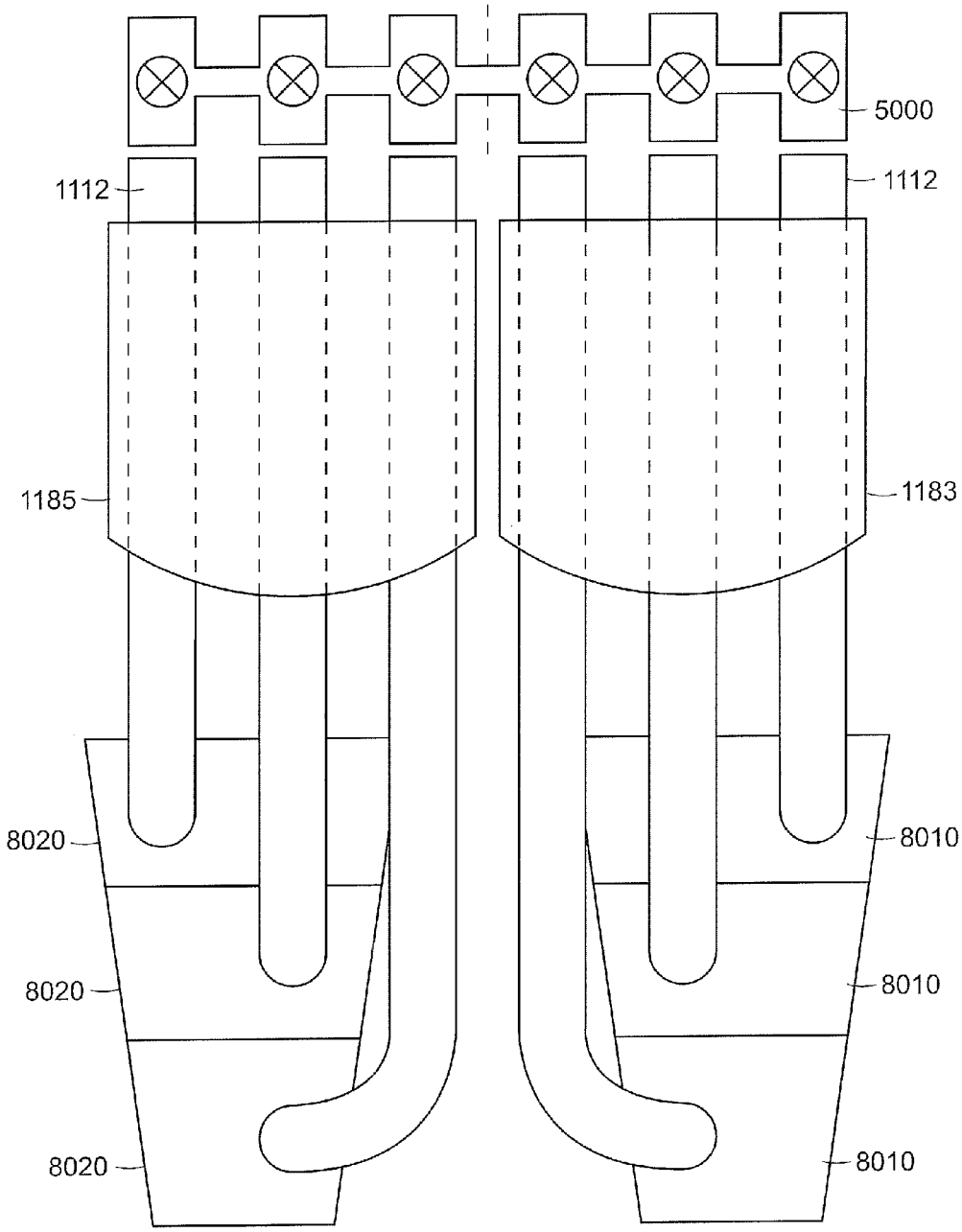

In FIG. 27, an air conduit connector 1185 that has three air conduits or flow tracts 1112 connected to three solenoids 5000 will cause the microprocessor to create a code "AAA". As illustrated in FIG. 27, the code "AAA", in this example, is associated with air conduit connector 1185 being connected to a pressure device having air cells 8020 of a triple cell calf or thigh sleeve. Moreover, in FIG. 27, an air conduit connector 1183 that has three air conduits or flow tracts 1112 connected to three solenoids 5000 will cause the microprocessor to create a code "AAA". As illustrated in FIG. 27, the code "AAA", in this example, is associated with air conduit connector 1183 being connected to a pressure device having air cells 8010 of a triple cell calf or thigh sleeve.

Figure 28:
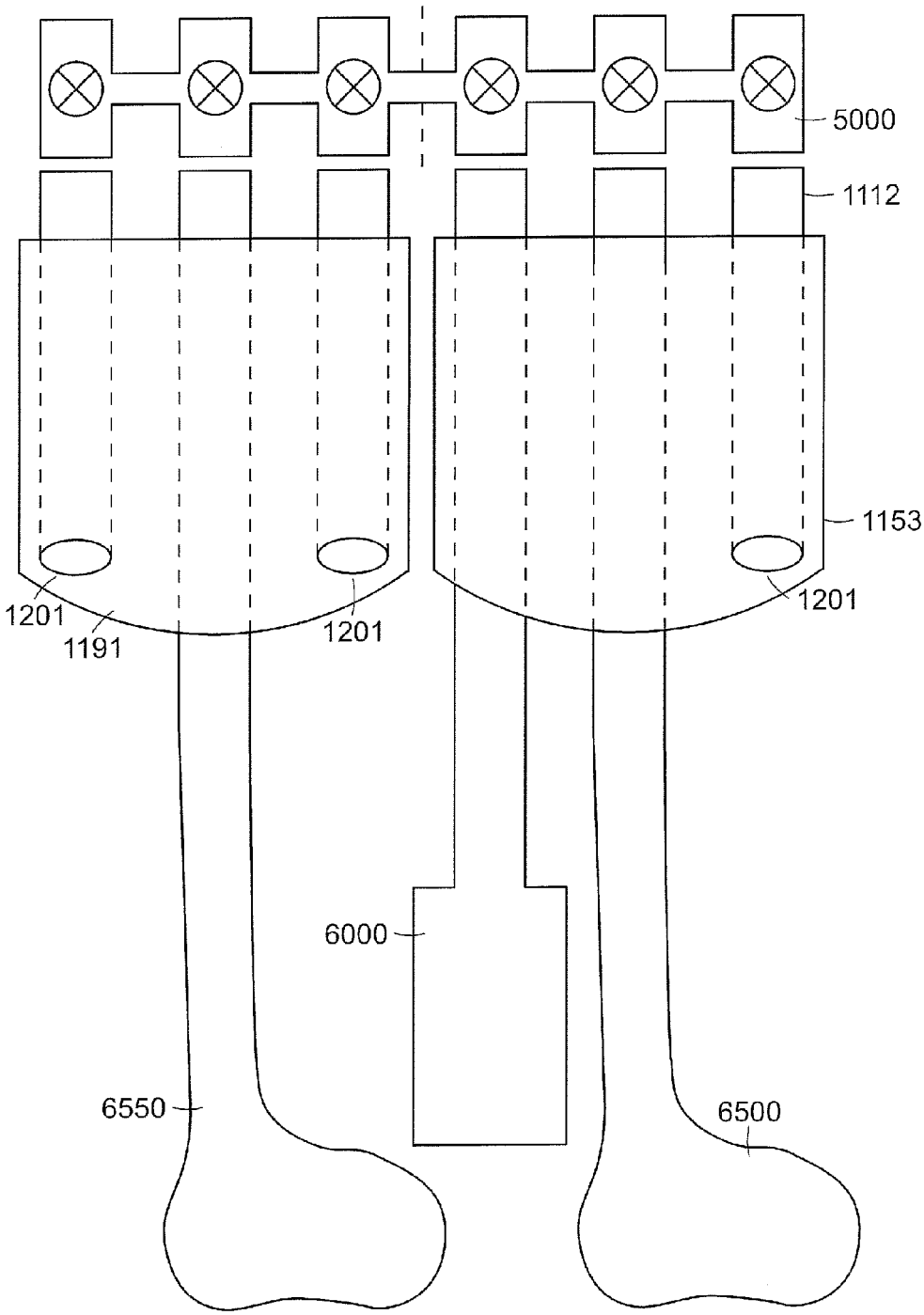

In FIG. 28, an air conduit connector 1191 that has three air conduits or flow tracts 1112 connected to three solenoids 5000 will cause the microprocessor to create a code "BAB". As illustrated in FIG. 28, the code "BAB," in this example, is associated with air conduit connector 1191 being connected to a pressure device having an air cell 6550 of a foot pressure sleeve and no air cells 1201. Moreover, in FIG. 28, an air conduit connector 1153 that has three air conduits or flow tracts 1112 connected to three solenoids 5000 will cause the microprocessor to create a code "AAB". As illustrated in FIG. 28, the code "AAB," in this example, is associated with air conduit connector 1153 being connected to a pressure device having a pressure accumulator 6000, an air cell 6500 of a foot pressure sleeve, and no air cell 1201.

Figure 22:
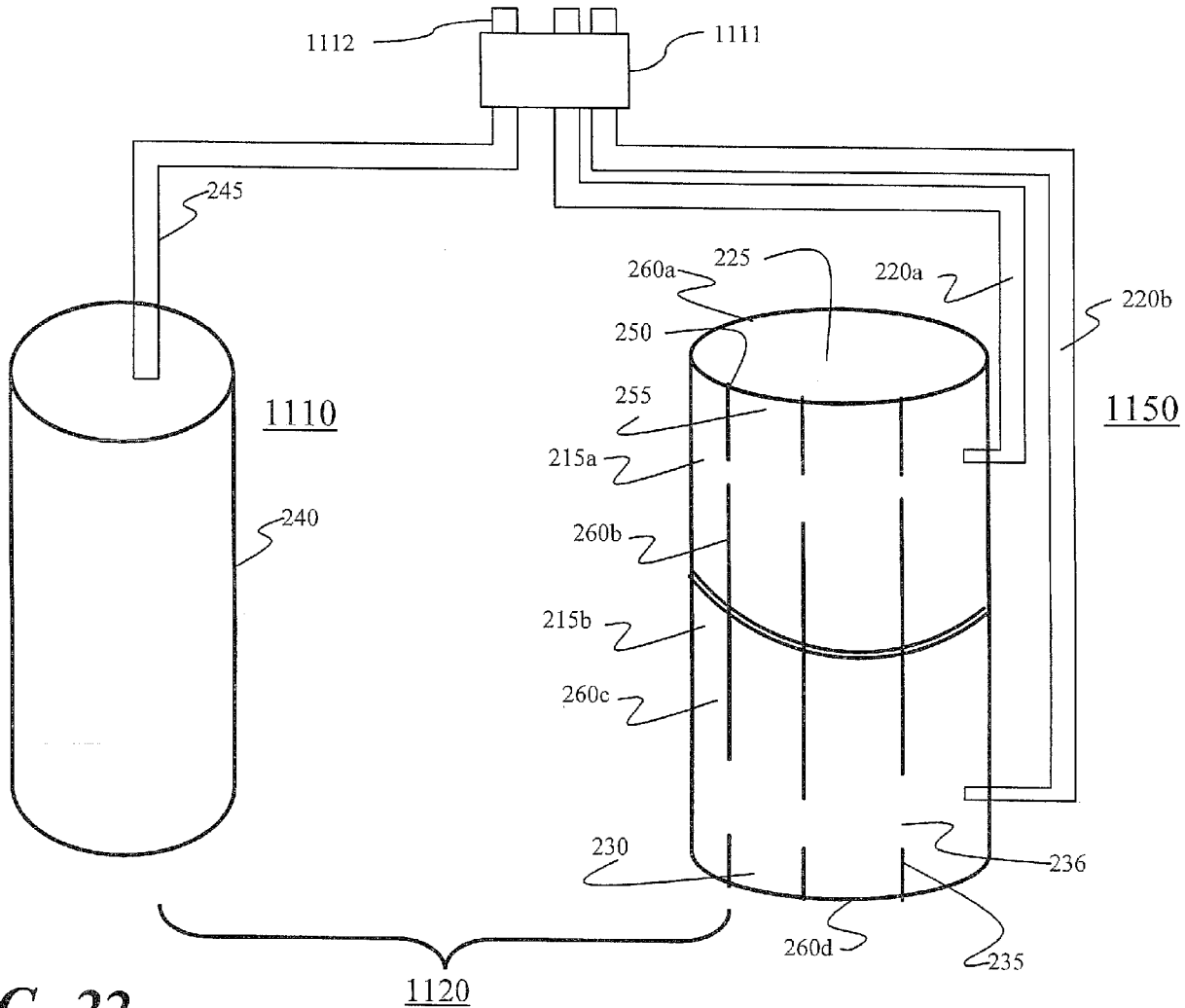
FIG. 22 is another embodiment of a pressure sleeve-pressure accumulator combination according to the concepts of the present invention.

It is noted that the code "A" can be further modified to be "A", "$A_1$", "$A_2$" . . . "$A_n$", to provide a more specific identification of the sleeve of combination of sleeves attached to the pump device of the present invention. For example, code "A" could be associated with a foot sleeve wherein $T_1$>Tn>Tmin. Moreover, code "$A_1$" could be associated with a one cell of a calf sleeve wherein $T_2$>Tn>$T_1$. Lastly, code "$A_n$" could be associated with a pressure accumulator wherein Tmax>Tn>$T_{n-1}$. By providing more flexibility with the generation of code "A", the present invention could be enable to operate with an air conduit connector 1111 that has three air conduits or flow tracts 1112, which are connected to a double cell calf sleeve 1150 and a pressure accumulator 1110, as illustrated in FIG. 22.

This "identification system" is very simple to apply and no special hardware changes are necessary. It enables the device to remain an "On-Off" device in spite of its high versatility. It prevents the use of defective sleeves, undesired sleeve combinations, or unauthorized sleeves.

FIGS. 23-28 demonstrate the potential of this "identification system" to differentiate between different pressure devices or different sleeves combinations, in a device that contains six solenoids and pressure devices or sleeves that are connected to the device with an air conduit connector that has three air conduits or flow tracts.

Alternatively the control unit, within the pump unit, can read the input information about the required treatment by reading the coding of the sleeves connectors. While starting any new treatment cycle, the control unit will start the treatment by a quick identification of the type of sleeves connected and will apply the appropriate operating cycle. The coding of the sleeve connectors can be made by state of the art mechanical or electro-mechanical components wherein each air conduit connector has a mechanical tag, an electronic tag, an optical tag, or an electromechanical tag, all which could be read by the pump unit. This would replace the pressure generation measurement identification process. It is also possible to store the required treatment parameters on the sleeve's connector as part of the mechanical tag, an electronic tag, an optical tag, or an electromechanical tag according to the sleeve's projected treatment. On start-up of the system, the data will be transferred to the pump unit through either mechanical, electrical, optical means, or a combination thereof, and the treatment cycle will be compatible to the selected sleeve. Moreover, it contemplated that the therapist will be able to program the sleeve's parameters through manipulation of the mechanical tag, the electronic tag, the optical tag, the electromechanical tag, or combination thereof to fit the treatment to the specific patient.

Figure 11:
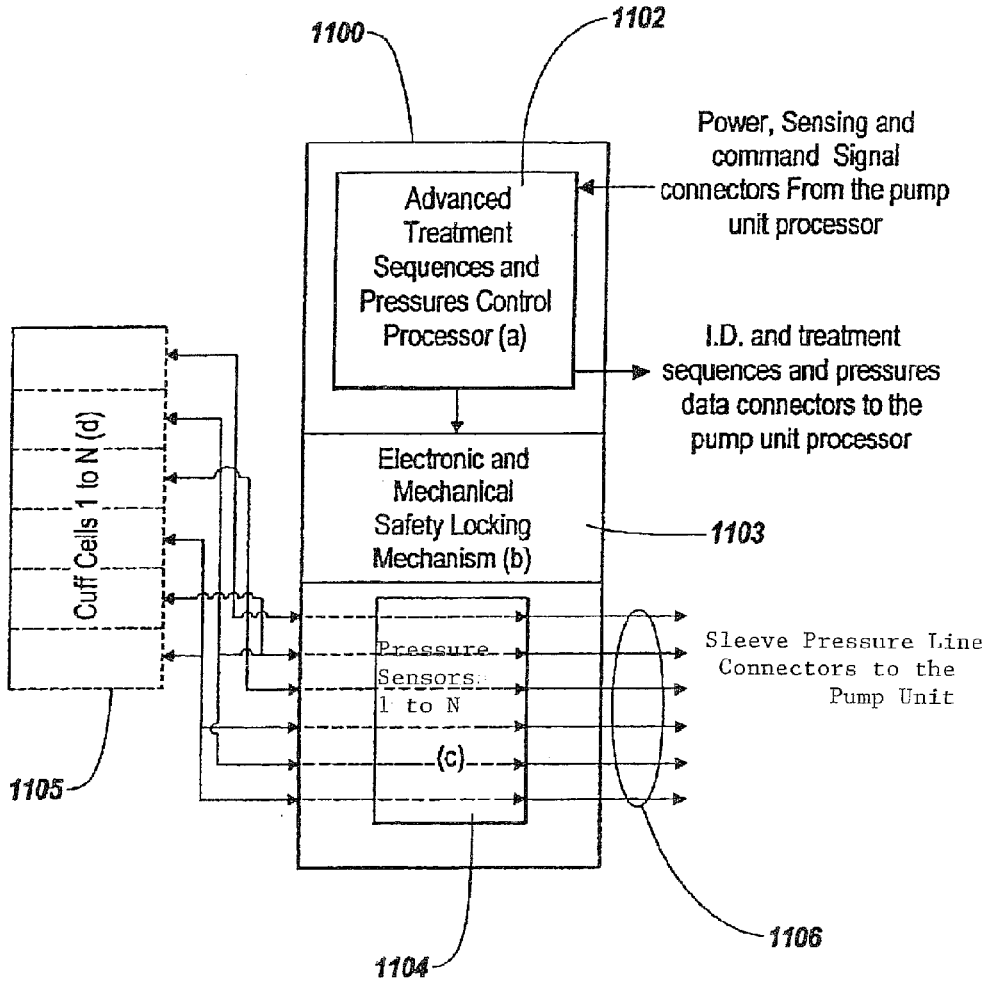
FIG. 11 is a simplified functional block diagram of an exemplary connector assembly according to the concepts of the present invention.

FIG. 11 is a simplified functional block diagram of an exemplary embodiment of a connector assembly 1100 for an associated sleeve 1105 in accordance with the present invention. The assembly 1100 includes an electronic memory and/or control processor unit 1102 that is capable of detecting and transmitting electronic signals. When connected to a pump unit and on power reset of the pump unit, the processor unit, which can be part of the conduits of the sleeve, receives DC power and sends back an identification signal which initiates the communication procedures. The treatment data will be loaded to the pump unit. The second phase of this operation is to lock the cuff of the sleeve, with an electromechanical safety locking mechanism 1103. This operation is done for safety reasons, to prevent undesired release of the cuff, during normal operation.

Another feature is that a pressure sensors array 1104 measures the pressure at the end of each pressure line 1106. The data collected at this stage is transmitted, via the processor unit 1102, to the processor in the pump unit, in order to evaluate the status of the system. The sleeve 1105 has several cells that can be independently inflated by the pump unit. The number of cells in the sleeve can vary, according to desired treatments.

Figure 12:
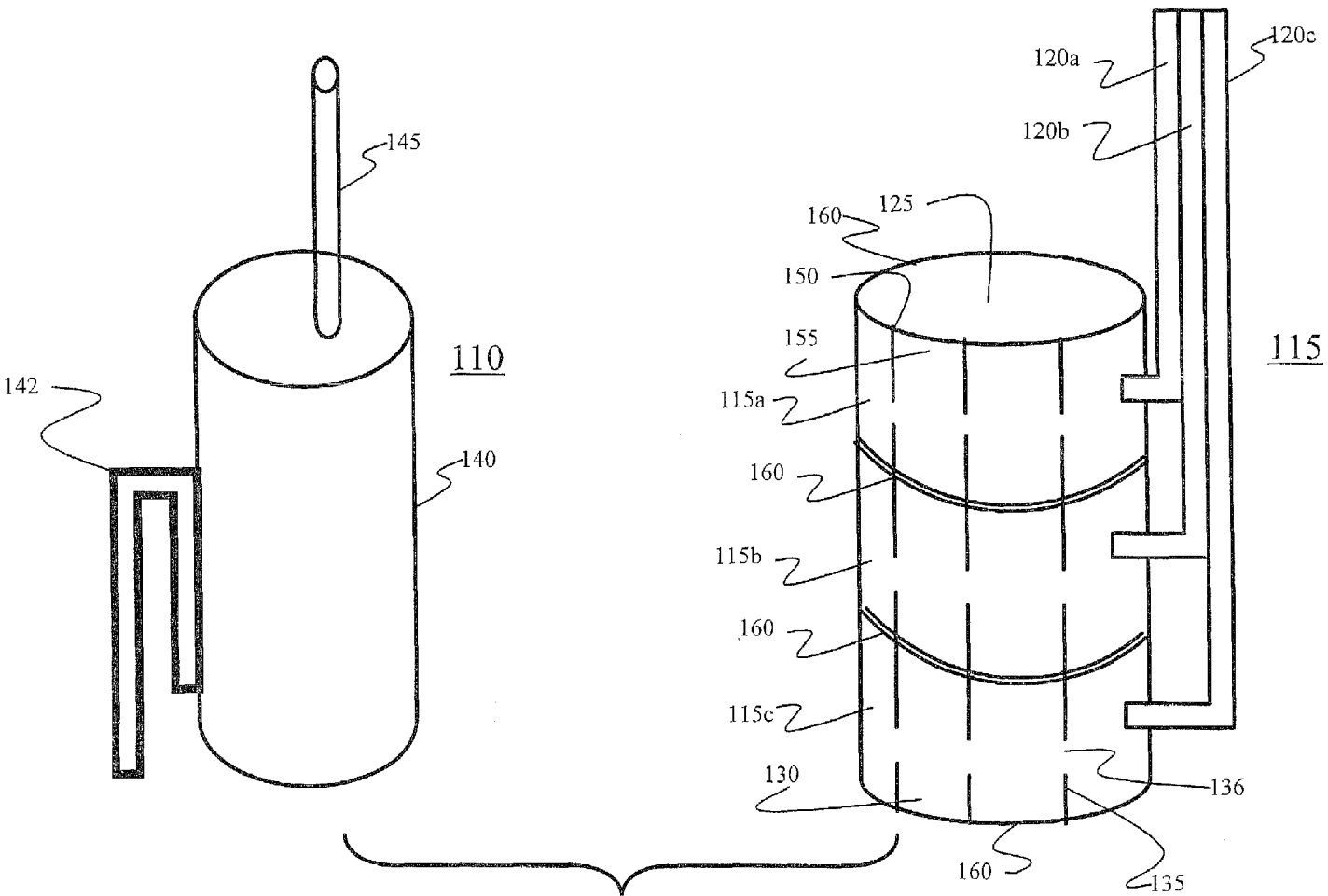
FIG. 12 is one embodiment of a pressure sleeve-pressure accumulator combination according to the concepts of the present invention.

FIG. 12 shows a pressure device having a pressure sleeve-pressure accumulator combination generally indicated by 112 in accordance with another embodiment of the present invention. The combination 112 comprises a pressure sleeve 105 and a pressure accumulator 110. The pressure sleeve 105 may be any known pressure sleeve, but preferably the pressure sleeve is a pressure sleeve with the multiple intra-cell compartments as described above so that a small volume of air or fluid provides for beneficial circumferential constriction of the pressure sleeve upon the limb. The pressure sleeve 105 includes one or more individually inflatable toroidal cells 115.

In FIG. 12, three cells 115*a*, 115*b*, and 115*c* are shown. This is by way of example only, and the pressure sleeve 105 may comprise any number of cells 115. Each cell 115 has an associated tubular conduit 120*a*, 120*b*, and 120*c*. The conduits 120*a*, 120*b*, and 120*c* serve as both an inlet for fluid into the associated cells 115*a*, 115*b*, and 115*c*, respectively, as well as an outlet for fluid out of the associated cell 115*a*, 115*b*, and 115*c*, respectively.

The cells 115*a*, 115*b*, and 115*c* are formed from a flexible, fluid imperious material such as cloth-lined rubber or canvas. The pressure sleeve 105 may be formed for example from an inner cylindrical shell 150 and an outer cylindrical shell 155 formed from a flexible fluid impervious material. Seams 160 at the boundaries of cells 115*a*, 115*b*, and 115*c* are formed by welding the inner cylindrical shell 150 and outer cylindrical shell 155 together at the seams.

The flow of a pressurized fluid through conduits 120*a*, 120*b*, and 120*c* into the associated cell 115*a*, 115*b*, and 115*c*, respectively, inflates the cell so as to exert a pressure on a limb contained in a lumen 125 of the pressure sleeve 105, as explained above. One or more of the cells 115*a*, 115*b*, and 115*c* may optionally be divided into two or more intra-cell compartments 130, as shown, for example, for the cell 115*c*. The intra-cell compartments 130 are formed by seams 135 extending in a longitudinal direction of the pressure sleeve 105. The seams 135 are incomplete at perforations 136 so that the intra-cell compartments 130 are inflated essentially simultaneously when pressurized fluid enters the cell 115*c*. As explained above, this decreases the volume of the cell 115*c* so that a predetermined pressure on a limb positioned in the lumen 125 of the pressure sleeve 105 is realized.

The pressure accumulator 110 comprises a container 140 formed from a fluid impervious material. The container 140 may be made from a flexible material such as cloth-lined rubber or canvas. Alternatively, the container 140 may be made from a rigid material such as plastic or metal. The accumulator 110 further comprises a tubular conduit 145 that serves both as an inlet for pressurized fluid into the container 140 as well as an outlet for fluid out of the container 140.

The pressure accumulator 110 enables the compression system to provide intermittent pneumatic compression, fast intermittent pneumatic compression, fast inflation, less complexity, lower costs, and greater patient comfort. Moreover, the pressure accumulator 110 enables the compression system to provide effective therapeutic venous flow acceleration.

It is noted, according to the concepts of the present invention, that the pressure accumulator 110, as illustrated in the embodiment of FIG. 12, is not part of a console. In this embodiment of the present invention, the pressure accumulator 110 is a device that is separate, e.g., non-integral, from the other components of the compression system. The pressure accumulator 110 can then be located at any convenient location that the user desires. As illustrated in FIG. 12, the pressure accumulator 110 includes a clip or fastening device 142 that enables the pressure accumulator 110 to be located on the belt of the user or hook onto another proximately located object. This fastening device 142 may also include a strap to fasten around the waist or limb of the user. Thus, the pressure accumulator 110 is flexibly tethered to the compression system of the present invention to provide mobility and flexibility.

Figure 13:
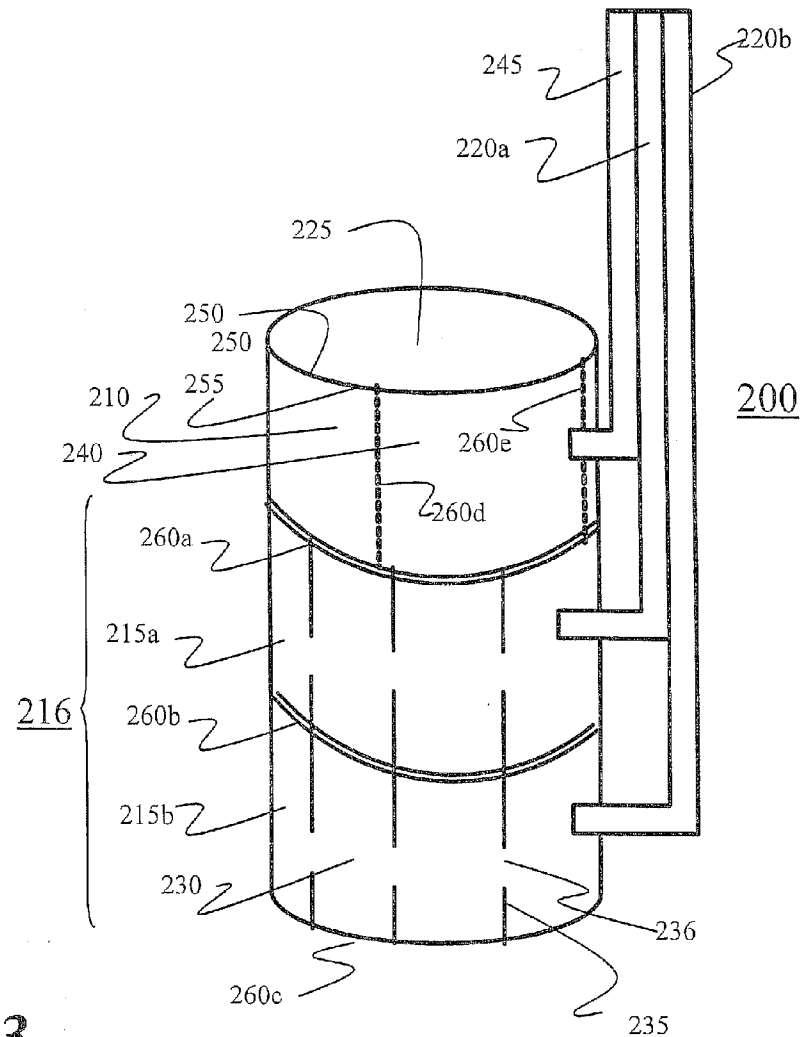
FIG. 13 shows another embodiment of pressure sleeve-pressure accumulator combination in which the accumulator is integral with the sleeve according to the concepts of the present invention.

FIG. 13 shows a pressure device having a pressure sleeve-pressure accumulator combination generally indicated by 200 in accordance with a further embodiment of the present invention. In this embodiment a pressure accumulator 210 is integrated into a pressure sleeve 205, thereby making the pressure accumulator 210 integral with the pressure sleeve 205. As illustrated in FIG. 13, the pressure sleeve 205 is divided into the pressure accumulator 210 and a pressure application section 216 made up of cells 215*a* and 215*b*.

This is by way of example only, and the pressure sleeve 205 may comprise any number of cells. As with the sleeve shown in FIG. 12, each cell has an associated tubular conduit (220*a* and 220*b*) that serves as both a fluid inlet and outlet for the cell. The cells are formed from a flexible, fluid impervious material such as cloth-lined rubber or canvas. One or more of the cells may be divided into intra-cell compartments 230, as explained above with reference to FIG. 12, having seams 235 and perforations 236 so that the intra-cell compartments are inflated essentially simultaneously when pressurized fluid enters the cell.

The pressure accumulator 210 comprises a container 240 formed from a fluid impervious material. The accumulator 210 further comprises a tubular conduit 245 that serves both as an inlet for pressurized fluid into the container 240 as well as an outlet for fluid out of the container 240. The outside part of the container 240 may be made from a flexible material such as cloth-lined rubber or canvas; however, the inside part of the container 240 should be made from a rigid material, such as a hard plastic or metal, to prevent any pressure from the pressure accumulator from being incorrectly transmitted to the patient. Alternatively, the entire container 240 may be made from a rigid material, such as a hard plastic or metal. The container 240 may partially surround the lumen 225 of the pressure sleeve 205 as shown in FIG. 13. Alternatively, the container 240 may completely surround the lumen 225 of the pressure sleeve 205 (not shown).

In a preferred embodiment, the pressure sleeve 205 is formed from an inner cylindrical shell 250 and an outer cylindrical shell 255 formed from a flexible fluid impervious material. Seams (260*a*, 260*b*, 260*c*, 260*d*, and 260*e*) at the boundaries of the cells, at the boundaries of the container 240 or at the boundary between the container 240 and the cell 215*a* are formed by welding the inner and outer sleeves together at the seams.

FIG. 22 shows a pressure device having a pressure sleeve-pressure accumulator combination generally indicated by 1120 in accordance with a further embodiment of the present invention. In this embodiment a pressure accumulator 1110 is separate from a pressure sleeve 1150. As illustrated in FIG. 22, the pressure sleeve 1150 is divided into pressure application cells 215*a* and 215*b*.

This is by way of example only, and the pressure sleeve 1150 may comprise any number of cells. As with the sleeve shown in FIG. 13, each cell has an associated tubular conduit (220*a* and 220*b*) that serves as both a fluid inlet and outlet for the cell. The cells (215*a* and 215*b*) are formed from a flexible, fluid impervious material such as cloth-lined rubber or canvas. One or more of the cells may be divided into intra-cell compartments 230, as explained above with reference to FIG. 13, having seams 235 and perforations 236 so that the intra-cell compartments are inflated essentially simultaneously when pressurized fluid enters the cell.

The pressure accumulator 1110 comprises a container 240 formed from a fluid impervious material. The accumulator 210 further comprises a tubular conduit 245 that serves both as an inlet for pressurized fluid into the container 240 as well as an outlet for fluid out of the container 240. The container 240 may be made from a flexible material such as cloth-lined rubber or canvas. Alternatively, the container 240 may be made from a rigid material such as plastic or metal.

In a preferred embodiment, the pressure sleeve 1150 is formed from an inner cylindrical shell 250 and an outer cylindrical shell 255 formed from a flexible fluid impervious material. Seams (260*a*, 260*b*, 260*c*, and 260*d*) at the boundaries of the cells are formed by welding the inner and outer sleeves together at the seams.

As noted above, the pressure sleeve-pressure accumulator combination 1120 is connected via tubular conduit (220*a*, 220*b*, and 245) to air conduit connector 1111 that has three air conduits or flow tracts 1112.

Figure 14:
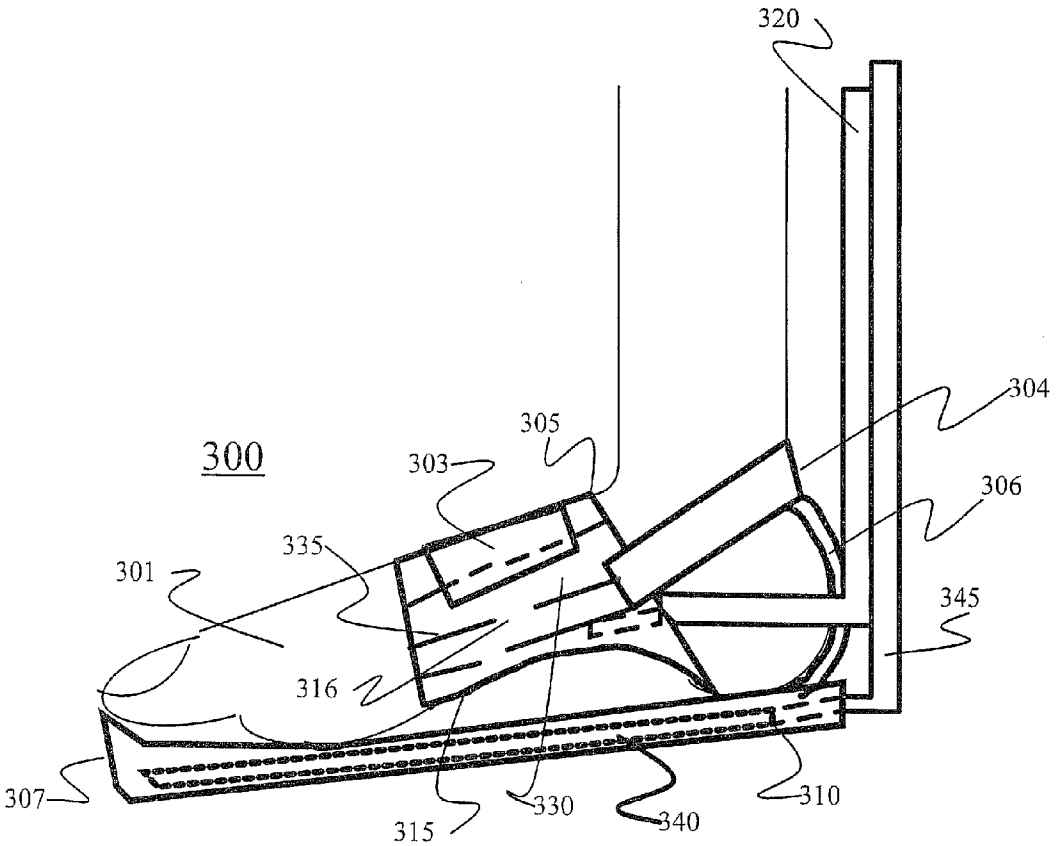
FIG. 14 shows a third embodiment of a pressure sleeve-pressure accumulator combination in the form of a slipper according to the concepts of the present invention.

FIG. 14 shows a pressure device having a pressure sleeve-pressure accumulator combination generally indicated by 300 in accordance with another embodiment of the present invention. In this embodiment, the combination 300 is formed into a slipper 307 to be worn on a foot 301. The combination 300 comprises a pressure sleeve 305 that comprises one cell 315. This is by way of example only, and the pressure sleeve 305 may comprise any number of cells. The cell or cells 315 may be divided into intra-cell compartments 330, as discussed above in reference to FIG. 12, having seams 335 and perforations 336 so that the intra-cell compartments are inflated essentially simultaneously when pressurized fluid enters the cell. The cell 315 has an associated tubular conduit 320.

The combination 300 further comprises a pressure accumulator 310. The pressure accumulator 310 has been incorporated into the sole of the slipper 307. The pressure accumulator 310 comprises a container 340 formed from a fluid impervious material that is sufficiently flexible so as to allow it to bend for comfortable walking while being sufficiently rigid so that it does not collapse under the weight of the user. The container 340 may be formed, for example, from reinforced rubber. The pressure accumulator 310 further comprises a tubular conduit 345 that serves both as an inlet for pressurized fluid into the container 340 as well as an outlet for fluid out of the container 340.

The combination 300 lastly comprises a foot fastener 303 that causes the pressure sleeve 305 to be snug around the foot 301. This foot fastener 303 may be a Velcro™ strap or other device that enables the pressure sleeve 305 to be formed around the foot 301. An ankle strap 304 is provided to prevent the pressure sleeve 305 and slipper 307 from shifting or coming disengaged from the foot 301. The ankle strap 306 may be a Velcro™ strap or other device that prevents the pressure sleeve 305 and slipper 307 from shifting or coming disengaged from the foot 301. The ankle strap 304 is provided with a heel support 306 that prevents the foot from sliding out of the back of the slipper 304. The heel support 306 may be of a rigid material, such as a plastic, or a flexible material, such as cloth.

Figure 29:
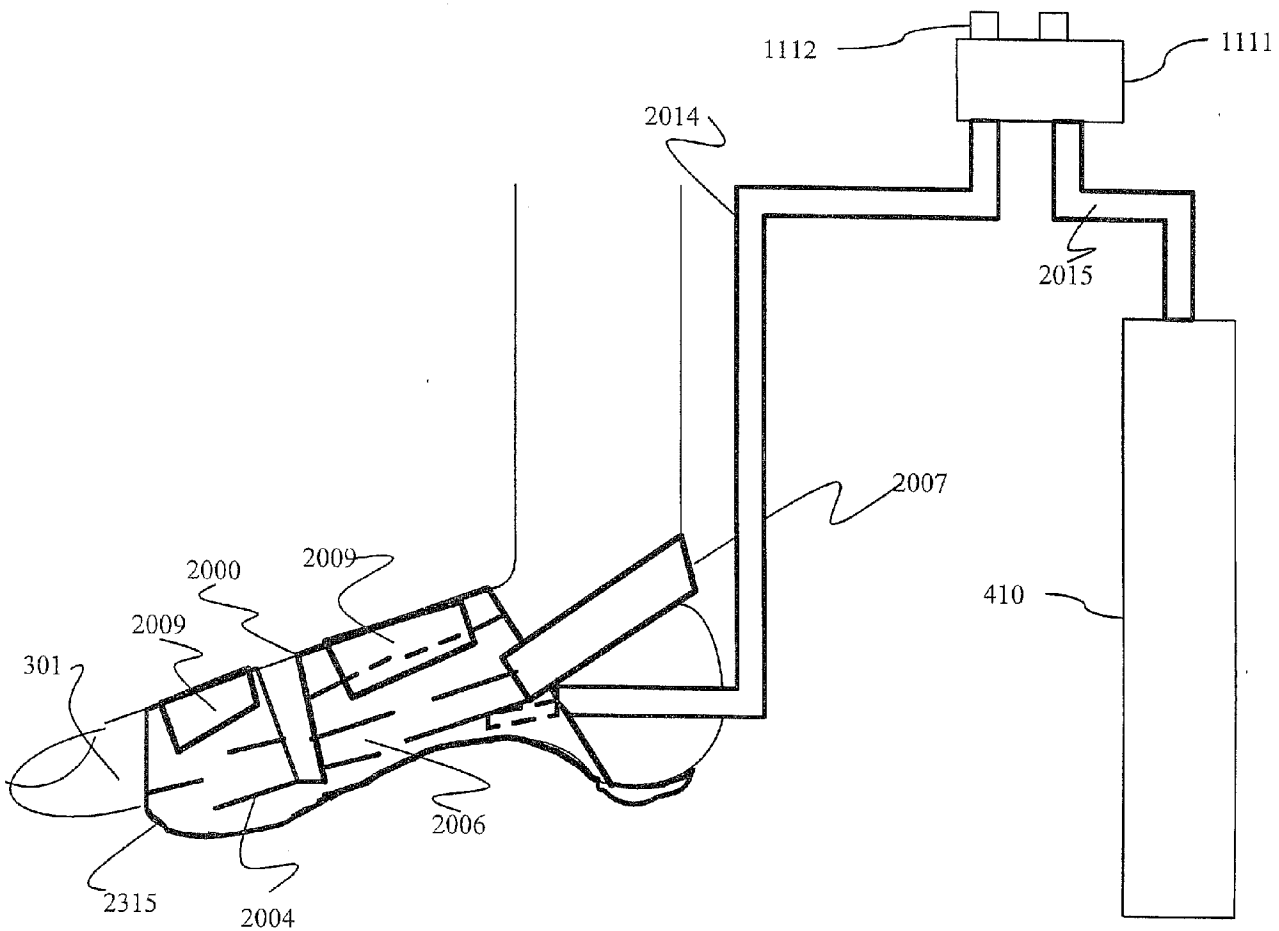
FIG. 29 shows an embodiment of a foot pressure sleeve-pressure accumulator according to the concepts of the present invention.

FIG. 29 shows another pressure device having a pressure sleeve-pressure accumulator combination in accordance with another embodiment of the present invention. In this embodiment, the combination comprises a pressure sleeve 2000 that comprises one cell 2315. This is by way of example only, and the pressure sleeve 2000 may comprise any number of cells. The cell or cells 2315 may be divided into intra-cell compartments 2006, as discussed above in reference to FIG. 12, having seams 2004 and perforations so that the intra-cell compartments are inflated essentially simultaneously when pressurized fluid enters the cell. The cell 2315 has an associated tubular conduit 2014.

The pressure sleeve-pressure accumulator combination further comprises a pressure accumulator 410. The pressure accumulator 410 is separate from the pressure sleeve 2000. The pressure accumulator 410 comprises a container formed from a fluid impervious material. The container may be formed, for example, from a flexible material such as cloth-lined rubber or canvas or from a rigid material such as plastic or metal. The pressure accumulator 410 further comprises a tubular conduit 2015 that serves both as an inlet for pressurized fluid into the container as well as an outlet for fluid out of the container.

The combination lastly comprises foot fasteners 2009 that cause the pressure sleeve 2000 to be snug around the foot 301. The foot fasteners 2009 may be Velcro™ straps or other devices that enable the pressure sleeve 2000 to be formed around the foot 301. An ankle strap 2007 is provided to prevent the pressure sleeve 2000 from shifting or coming disengaged from the foot 301. The ankle strap 2007 may be a Velcro™ strap or other device that prevents the pressure sleeve 2000 from shifting or coming disengaged from the foot 301.

Figure 20:
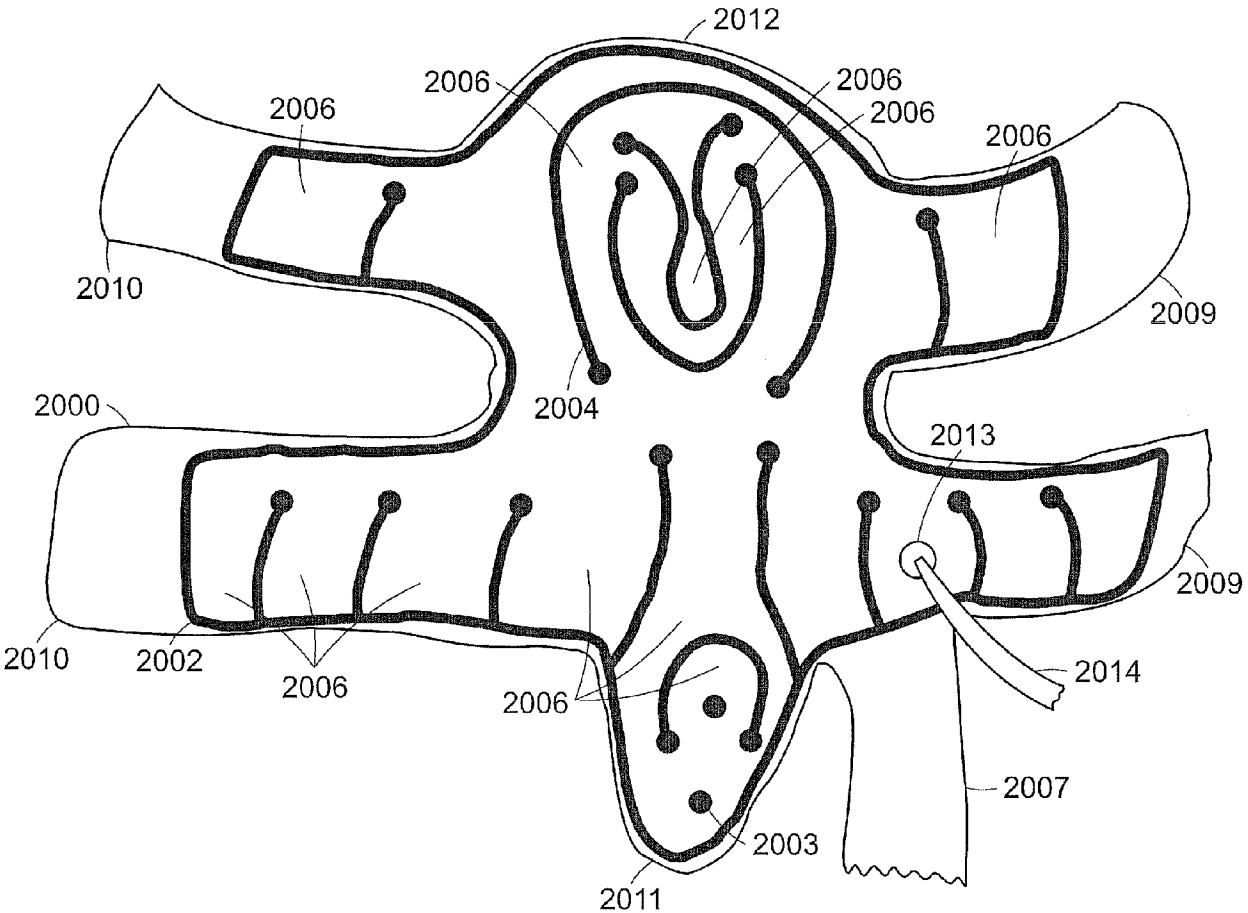
FIG. 20 shows an embodiment of a foot pressure sleeve according to the concepts of the present invention.

A more detail illustration of the pressure sleeve of FIG. 29 is shown in FIG. 20. As illustrated in FIG. 20, a foot pressure sleeve 2000 is constructed from two shells that have been welded together. The shells are a fluid impervious and flexible material such as cloth-lined rubber or canvas. The foot pressure sleeve 2000 contains a cell formed by weld 2002. This is by way of example only, and the pressure sleeve 2000 may comprise any number of cells. The cell or cells contain multiple intra-cells 2006 formed by intra-cell linear-welds 2004 and intra-cell spot-welds 2003. The foot pressure sleeve 2000 has a forward section 2012 that can extend from an arch portion of a patient's foot to under either the ball of a patient's foot or the toes of a patient's foot. The foot pressure sleeve 2000 also has a rearward section 2011 that substantially extends under the heel of a patient's foot. The cell has an associated tubular conduit 2014.

The foot pressure sleeve 2000 comprises foot fasteners 2009 and 2010 that causes the pressure sleeve 2000 to be snug around the foot. The foot fasteners 2009 and 2010 may be Velcro™ straps or other devices that enable the pressure sleeve 2000 to be formed around the foot. An ankle strap 2007 is provided to prevent the pressure sleeve 2000 from shifting or coming disengaged from the foot. The ankle strap 2007 may be a Velcro™ strap or other device that prevents the pressure sleeve 2000 from shifting or coming disengaged from the foot.

Figure 39:
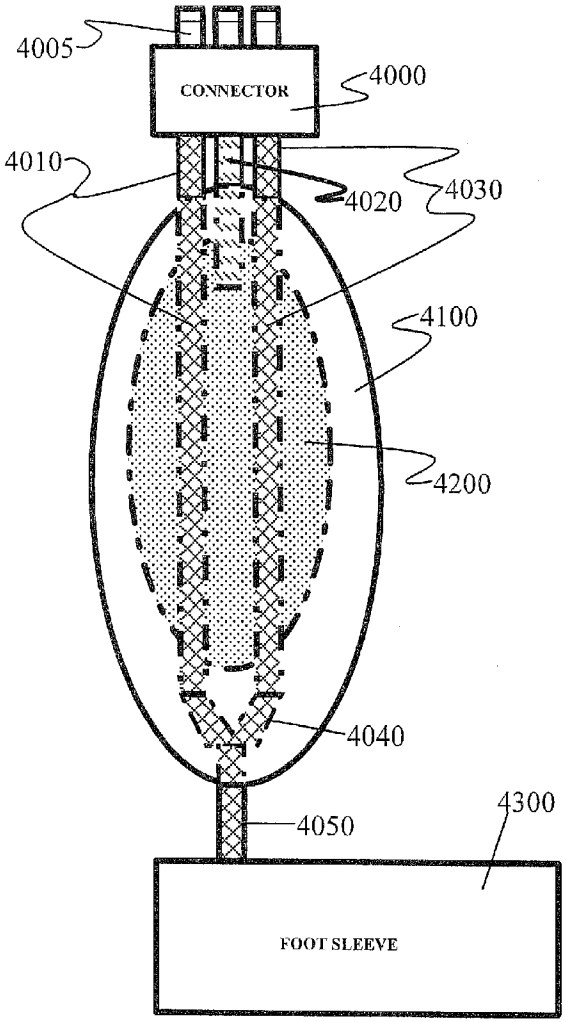
FIG. 39 illustrates a pressure sleeve and pressure accumulator combination according to the concepts of the present invention.
Figure 40:
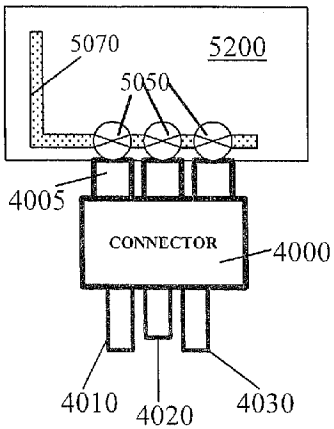
FIG. 40 illustrates a coupling of a pressure sleeve and pressure accumulator combination to a console housing a compressor.

FIG. 39 shows another pressure device having a pressure sleeve-pressure accumulator combination (pressure device) in accordance with another embodiment of the present invention. In this embodiment, the pressure device comprises a foot pressure sleeve 4300. In this example, the foot pressure sleeve 4300 comprises a single cell; however the foot pressure sleeve 4300 may comprise any number of cells. The foot pressure sleeve 4300 has an associated tubular conduit 4010, 4030, 4040, and 4050 connected to the connector 4000. The connector 4000 includes coupler 4005 to connect to valves 5050 that are connected to conduit 5070, as illustrated in FIG. 40.

The pressure device further comprises a pressure accumulator 4200 that is located in a pressure accumulator flexible housing 4100. The pressure accumulator 4200 is separate from the foot pressure sleeve 4300. The pressure accumulator 4200 comprises a container formed from a fluid impervious material. The container may be formed, for example, from a flexible material such as cloth-lined rubber or canvas or from a rigid material such as plastic or metal. The pressure accumulator 4200 further comprises a tubular conduit 4020 that serves both as an inlet for pressurized fluid into the container as well as an outlet for fluid out of the container.

Lastly, as illustrated in FIG. 39, the conduits 4010 and 4030 may be housed in or pass through the pressure accumulator flexible housing 4100. Moreover, if the foot pressure sleeve 4300 contains a single cell, the conduits 4010 and 4030 may be connected together by a y-joint 4040 within the pressure accumulator flexible housing 4100, with the y-joint 4040 being connected to conduit 4050 leading to the foot pressure sleeve 4300.

Figure 30:
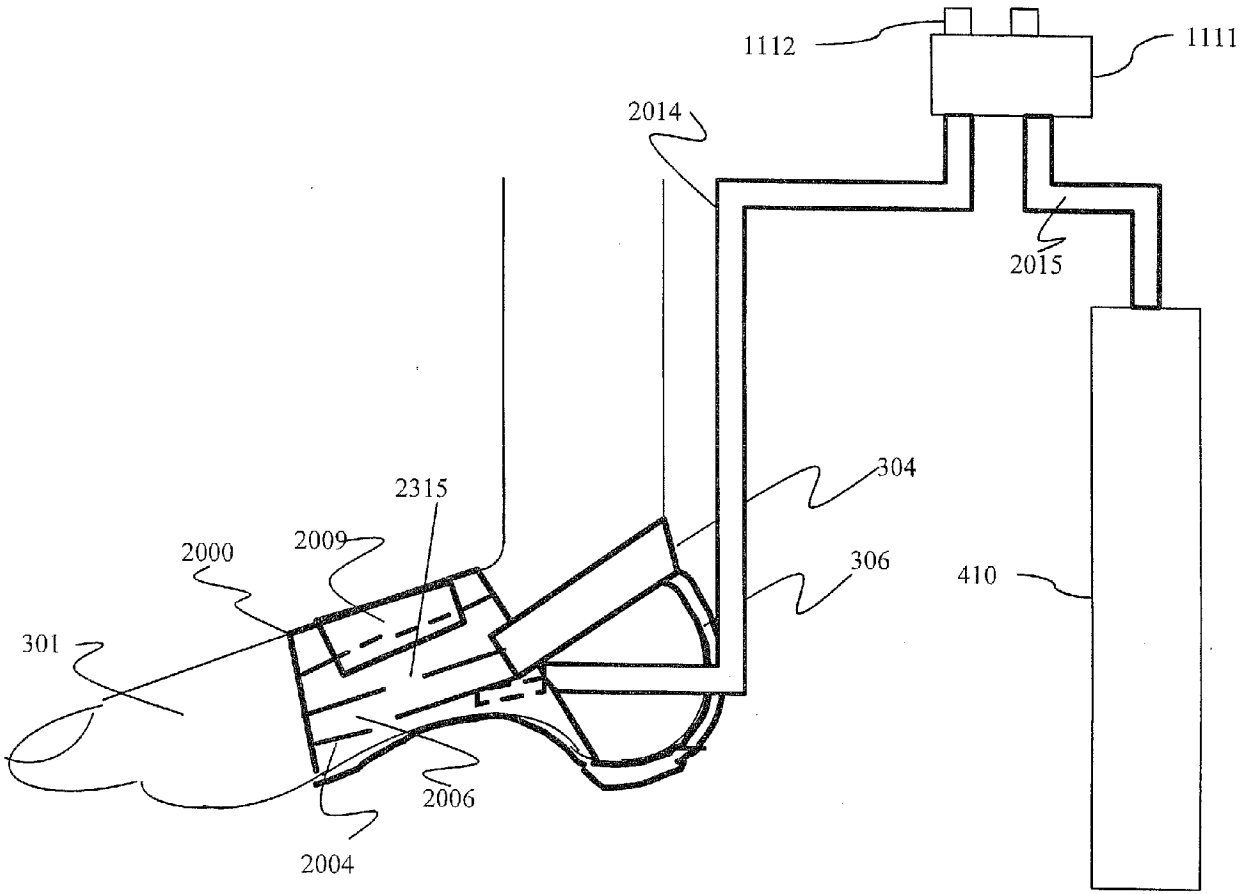
FIG. 30 shows another embodiment of a foot pressure sleeve-pressure accumulator according to the concepts of the present invention.

FIG. 30 shows another pressure device having a pressure sleeve-pressure accumulator combination in accordance with another embodiment of the present invention. In this embodiment, the combination comprises a pressure sleeve 2000 that comprises one cell 2315. This is by way of example only, and the pressure sleeve 2000 may comprise any number of cells. The cell or cells 2315 may be divided into intra-cell compartments 2006, as discussed above in reference to FIG. 12, having seams 2004 and perforations so that the intra-cell compartments are inflated essentially simultaneously when pressurized fluid enters the cell. The cell has an associated tubular conduit 2014 connected through port 2013.

The pressure sleeve-pressure accumulator combination further comprises a pressure accumulator 410. The pressure accumulator 410 is separate from the pressure sleeve 2000. The pressure accumulator 410 comprises a container formed from a fluid impervious material. The container may be formed, for example, from a flexible material such as cloth-lined rubber or canvas or from a rigid material such as plastic or metal. The pressure accumulator 410 further comprises a tubular conduit 2015 that serves both as an inlet for pressurized fluid into the container as well as an outlet for fluid out of the container.

The combination lastly comprises a foot fastener 2009 that causes the pressure sleeve 2000 to be snug around the foot 301. The foot fastener 2009 may be a Velcro™ strap or another device that enables the pressure sleeve 2000 to be formed around the foot 301. An ankle strap comprising an ankle portion 304 and a heel portion 306 is provided to prevent the pressure sleeve 2000 from shifting or coming disengaged from the foot 301. The ankle strap comprising ankle portion 304 and heel portion 306 may include a Velcro™ strap or other device that prevents the pressure sleeve 2000 from shifting or coming disengaged from the foot 301.

Figure 21:
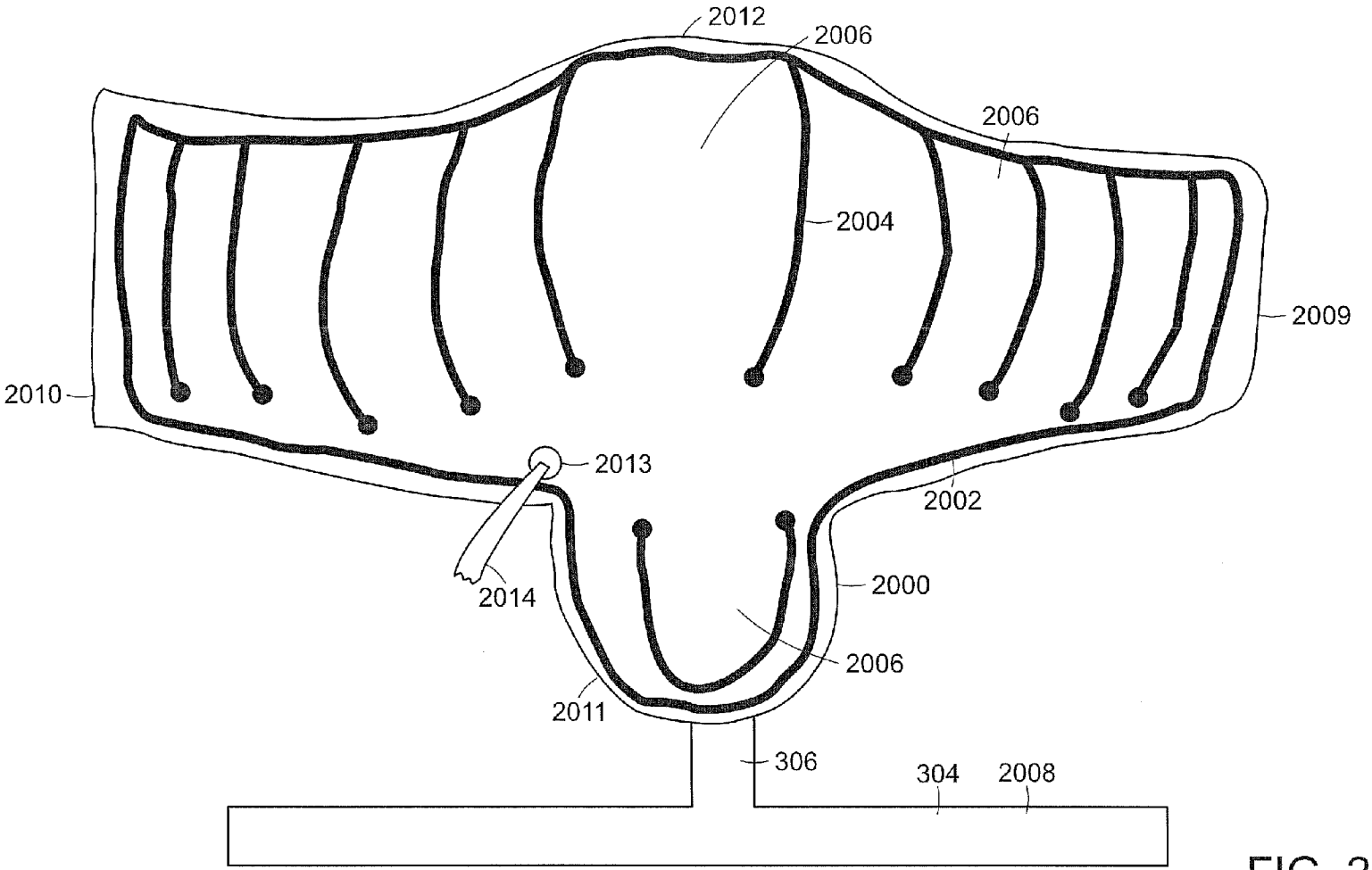
FIG. 21 shows another embodiment of a foot pressure sleeve according to the concepts of the present invention.

A more detail illustration of the pressure sleeve of FIG. 30 is shown in FIG. 21. As illustrated in FIG. 21, a foot pressure sleeve 2000 is constructed from two shells that have been welded together. The shells are a fluid impervious and flexible material such as cloth-lined rubber or canvas. The foot pressure sleeve 2000 contains a cell formed by weld 2002. This is by way of example only, and the pressure sleeve 2000 may comprise any number of cells. The cell or cells contain multiple intra-cells 2006 formed by intra-cell linear-welds 2004 and intra-cell spot-welds 2003. The foot pressure sleeve 2000 has a forward section 2012 that can extend from an arch portion of a patient's foot to the ball of a patient's foot. The foot pressure sleeve 2000 also has a rearward section 2011 that substantially extends under the heel of a patient's foot.

The cell has an associated tubular conduit 2014 connected through port 2013.

The foot pressure sleeve 2000 comprises foot fasteners 2009 and 2010 that causes the pressure sleeve 2000 to be snug around the foot. The foot fasteners 2009 and 2010 may be Velcro™ straps or other devices that enable the pressure sleeve 2000 to be formed around the foot. An ankle strap 2008 comprising an ankle portion 304 and a heel portion 306 is provided to prevent the pressure sleeve 2000 from shifting or coming disengaged from the foot. The ankle strap 2008 comprising an ankle portion 304 and a heel portion 306 may include a Velcro™ strap or other device that prevents the pressure sleeve 2000 from shifting or coming disengaged from the foot.

Figure 31:
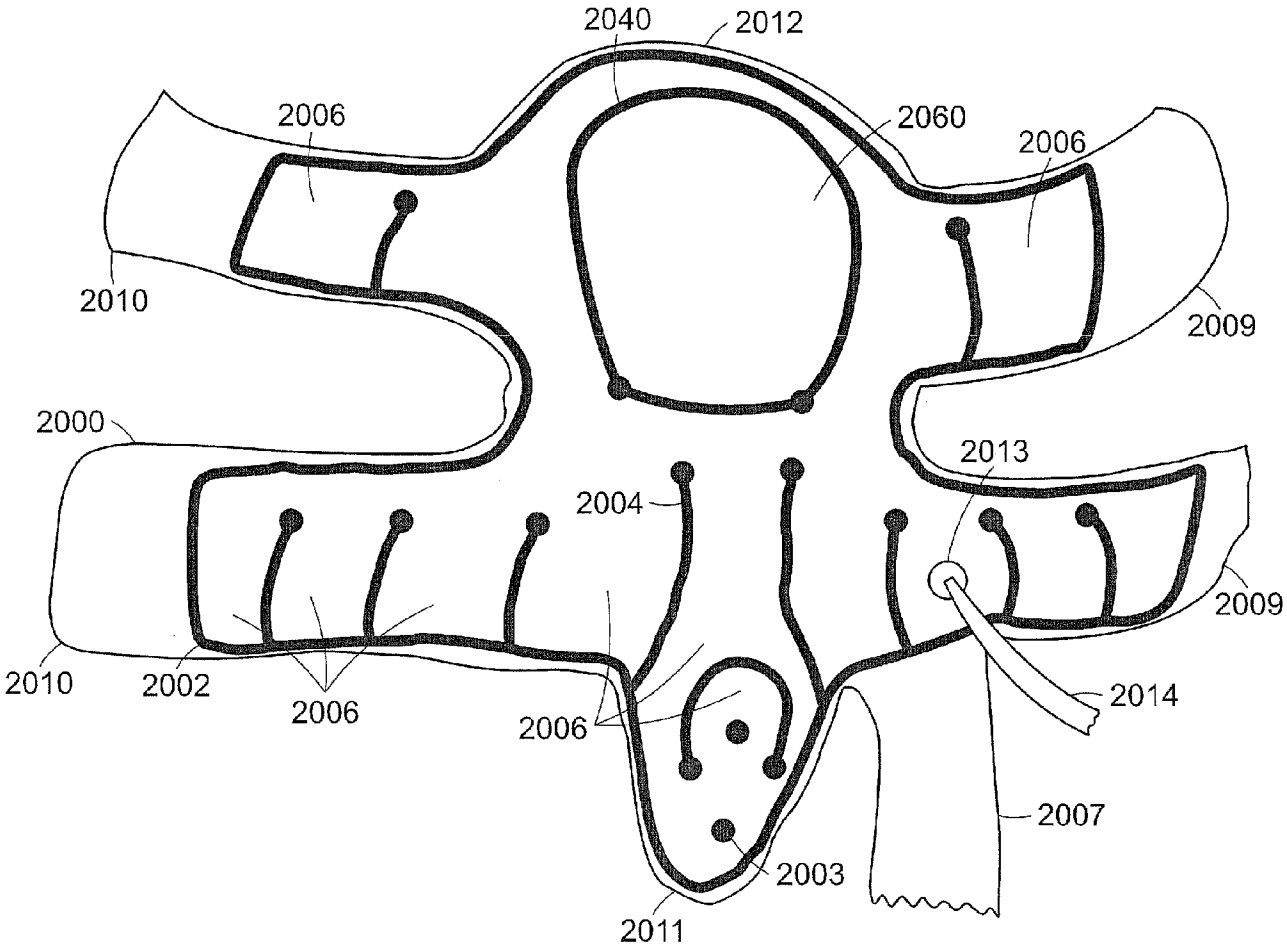
FIGS. 31 and 32 show further embodiments of a foot pressure sleeve according to the concepts of the present invention.

FIG. 31 shows another example of a pressure device having a foot pressure sleeve according to the concepts of the present invention. As illustrated in FIG. 31, a foot pressure sleeve 2000 is constructed from two shells that have been welded together. The shells are a fluid impervious and flexible material such as cloth-lined rubber or canvas. The foot pressure sleeve 2000 contains a cell formed by weld 2002. This is by way of example only, and the pressure sleeve 2000 may comprise any number of cells. The cell or cells contain multiple intra-cells 2006 formed by intra-cell linear-welds 2004 and intra-cell spot-welds 2003.

The foot pressure sleeve 2000 has a forward section 2012 that can extend from an arch portion of a patient's foot to under either the ball of a patient's foot or the toes of a patient's foot. The forward section 2012, as illustrated in FIG. 31, includes a weld 2040 that is used to form a non-inflating section 2060. The non-inflating section 2060 is formed substantially from an arch portion of a patient's foot to under either the ball of a patient's foot or the toes of a patient's foot so that no significant pressure is applied to a bottom portion of the patients' foot associated with the non-inflating section 2060.

The foot pressure sleeve 2000 also has a rearward section 2011 that substantially extends under the heel of a patient's foot. The cell has an associated tubular conduit 2014.

The foot pressure sleeve 2000 comprises foot fasteners 2009 and 2010 that causes the pressure sleeve 2000 to be snug around the foot. The foot fasteners 2009 and 2010 may be Velcro™ straps or other devices that enable the pressure sleeve 2000 to be formed around the foot. An ankle strap 2007 is provided to prevent the pressure sleeve 2000 from shifting or coming disengaged from the foot. The ankle strap 2007 may be a Velcro™ strap or other device that prevents the pressure sleeve 2000 from shifting or coming disengaged from the foot.

Figure 32:
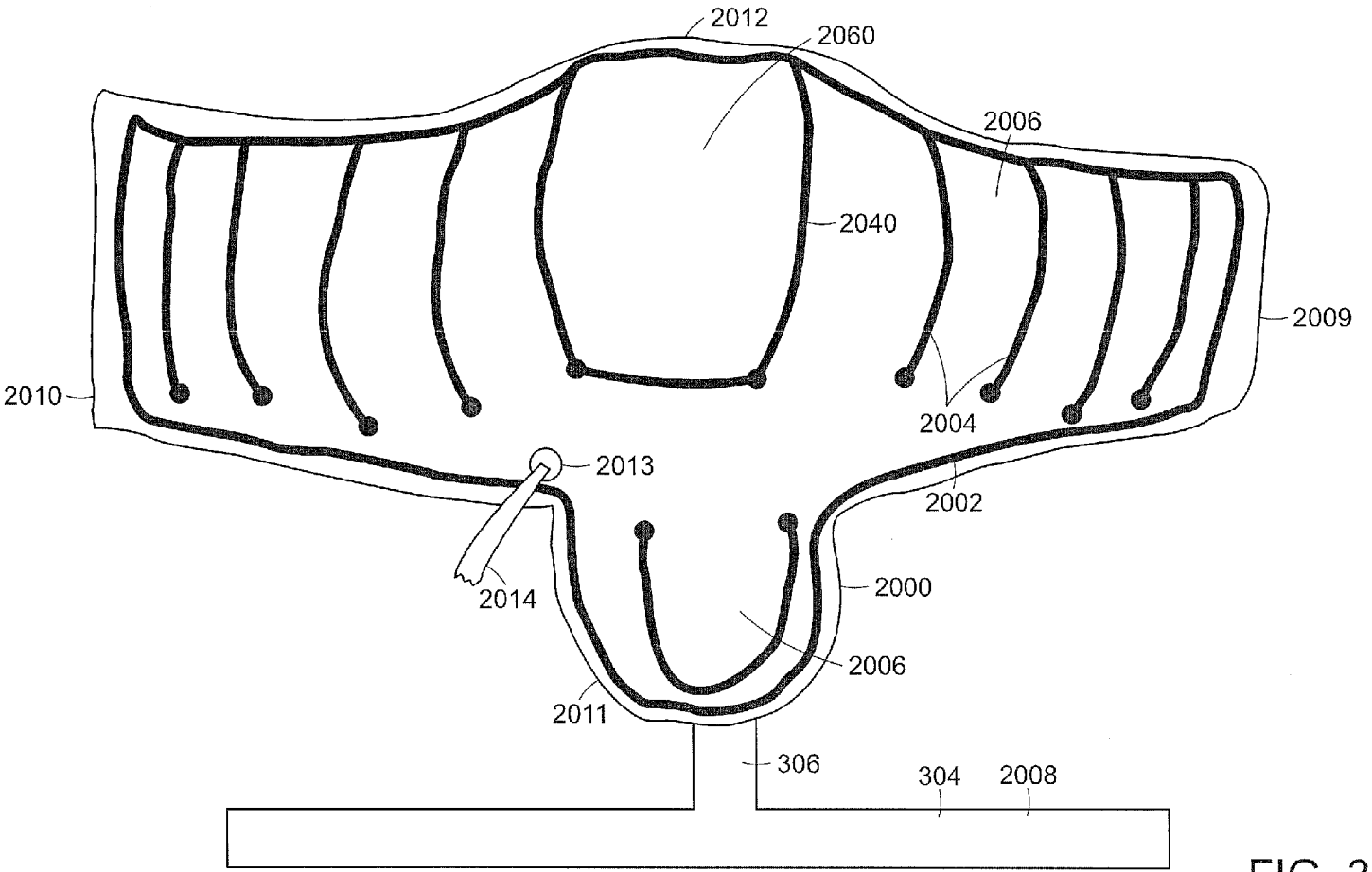

FIG. 32 shows a further example of a pressure device having a foot pressure sleeve according to the concepts of the present invention. As illustrated in FIG. 32, a foot pressure sleeve 2000 is constructed from two shells that have been welded together. The shells are a fluid impervious and flexible material such as cloth-lined rubber or canvas. The foot pressure sleeve 2000 contains a cell formed by weld 2002. This is by way of example only, and the pressure sleeve 2000 may comprise any number of cells. The cell or cells contain multiple intra-cells 2006 formed by intra-cell linear-welds 2004 and intra-cell spot-welds 2003.

The foot pressure sleeve 2000 has a forward section 2012 that can extend from an arch portion of a patient's foot to under the ball of a patient's foot. The forward section 2012, as illustrated in FIG. 32, includes a weld 2040 that is used to form a non-inflating section 2060. The non-inflating section 2060 is formed substantially from an arch portion of a patient's foot to under the ball of a patient's foot so that no significant pressure is applied to a bottom portion of the patients' foot associated with the non-inflating section 2060.

The foot pressure sleeve 2000 also has a rearward section 2011 that substantially extends under the heel of a patient's foot. The cell has an associated tubular conduit 2014 connected through port 2013.

The foot pressure sleeve 2000 comprises foot fasteners 2009 and 2010 that causes the pressure sleeve 2000 to be snug around the foot. The foot fasteners 2009 and 2010 may be Velcro™ straps or other devices that enable the pressure sleeve 2000 to be formed around the foot. An ankle strap 2008 comprising an ankle portion 304 and a heel portion 306 is provided to prevent the pressure sleeve 2000 from shifting or coming disengaged from the foot. The ankle strap 2008 comprising an ankle portion 304 and a heel portion 306 may include a Velcro™ strap or other device that prevents the pressure sleeve 2000 from shifting or coming disengaged from the foot.

Figure 15:
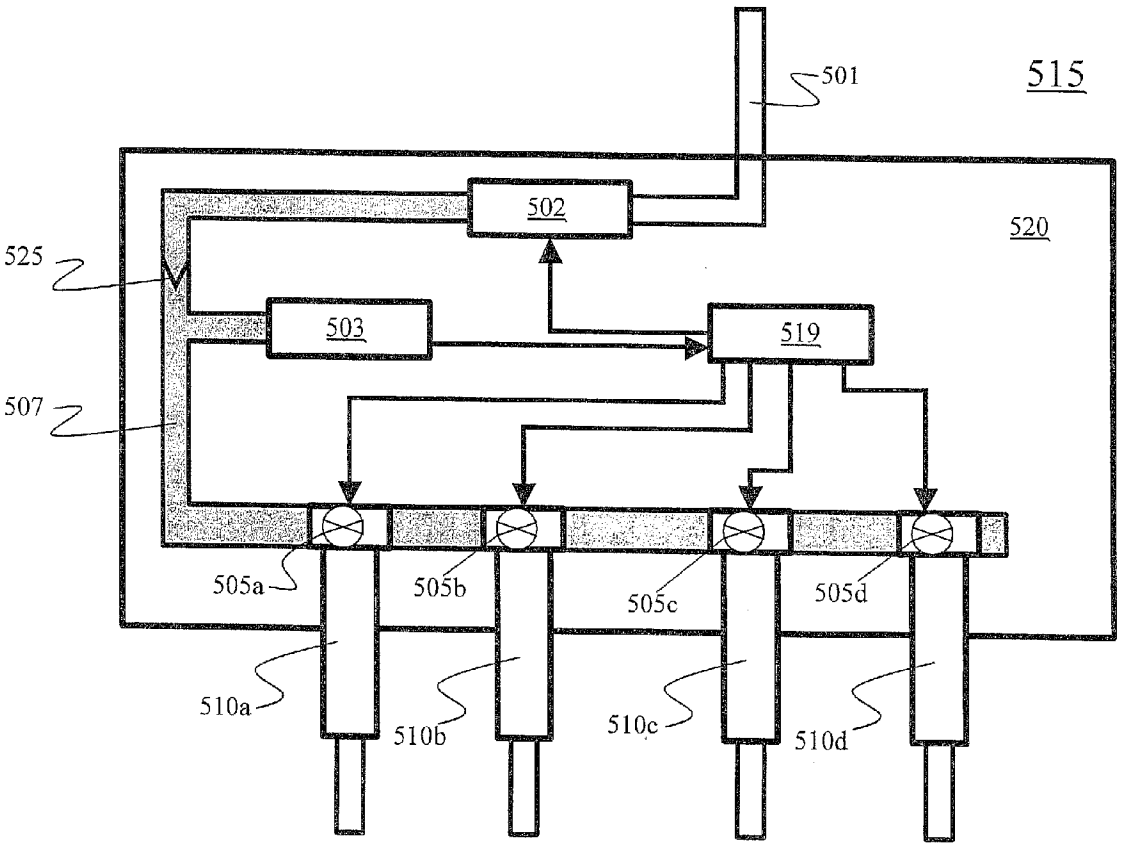
FIG. 15 shows a system for applying pressure to a body limb according to the concepts of the present invention.
Figure 16:
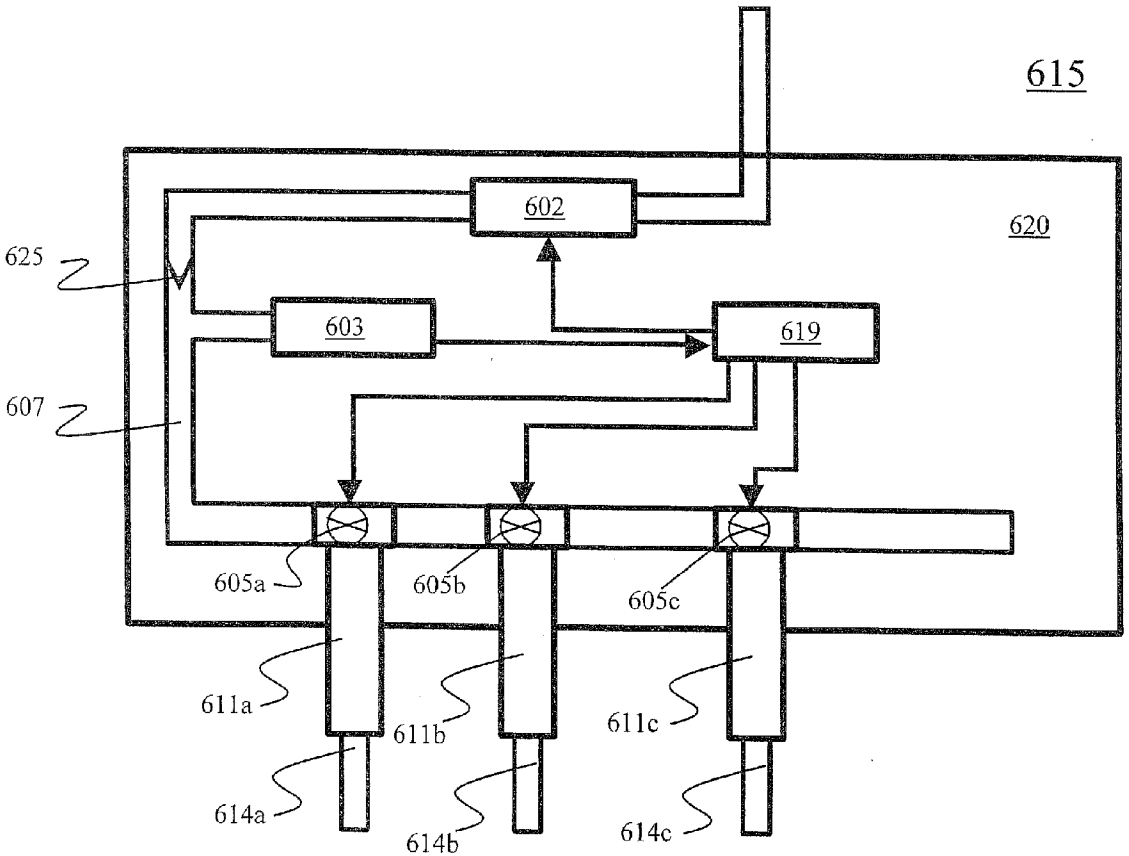
FIG. 16 (Prior Art)
FIG. 16 shows a prior art system not having a pressure accumulator for applying pressure to a body limb.
Figure 17:
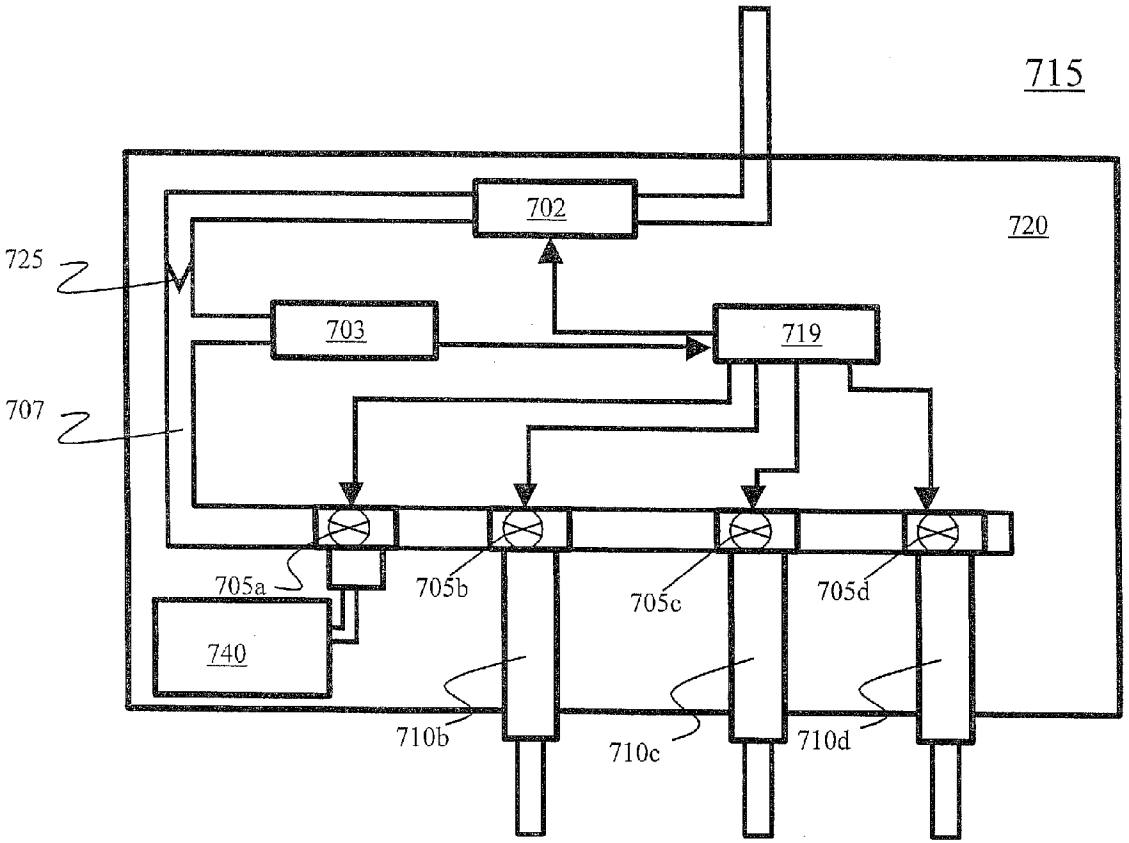
FIG. 17 (Prior Art)
FIG. 17 shows a prior art system having a pressure accumulator located inside the housing of a console for applying pressure to a body limb.

FIG. 15 shows a console system generally indicated by 515 for enabling the application of pressure to a body limb. The system 515, as illustrated in FIG. 15, can be utilized in conjunction with the pressure sleeve-pressure accumulator combination 112 described above in reference to FIG. 12.

The pressure sleeve used in conjunction with the console 515 preferably contains one or more cells divided into longitudinally extending compartments that are inflated and deflated essentially simultaneously. The console 515 is preferably portable and battery operated and includes an air compressor 502.

It is noted that air compressor 502 may be bypassed with pressurized air from an external source. The pressurized air would be introduced into the console 515 through pressurized air inlet 501.

The console 515 is also preferably configured to be carried on a user's body. For example, the console 515 may have clips (not shown) that allow the console 515 to be attached to the user's belt.

The console system shown in FIG. 15 is used when it is desired to apply pressure rapidly to a portion of a body limb. In this application, the valve 505*a* is opened while the valves 505*b*, 505*c*, and 505*d* are closed, causing pressurized air to flow in the conduit 507 from the compressor 502 through the valve 505*a* into the tubular conduit 510*a* associated with a pressure accumulator, such as pressure accumulator 110 of FIG. 12. When the pressure in the pressure accumulator reaches a predetermined value $P_A$, as determined by the pressure gauge 503, the processor 519 opens the valve 505*b* causing air to flow from the associated pressure accumulator into the cell, such as cell 115*a* of FIG. 12.

The flow of air in the conduit 507 from the pressure accumulator towards the compressor 502 is prevented by the one-way valve 525. The pressure in the cell will rise rapidly to a pressure $P_C$. $P_A$ and $P_C$ satisfy the relationship $P_A V_A = P_C(V_A + V_C)$ where $V_A$ is the volume of the container of the pressure accumulator and $V_C$ is the volume of the cell when inflated. Next, another cell, such as cell 115*b* of FIG. 12, may be inflated by opening the valve 505*c*. A next cell, such as cell 115*c* of FIG. 12, is inflated by opening the valve 505*d*. The cells are then deflated and the cycle can begin again.

FIGS. 35-38 illustrate the operation of the present invention when a console, as illustrated in FIG. 15, is connected to a pressure device, such as the pressure sleeve and pressure accumulator of FIGS. 39 and 40 as described above.

Figure 35:
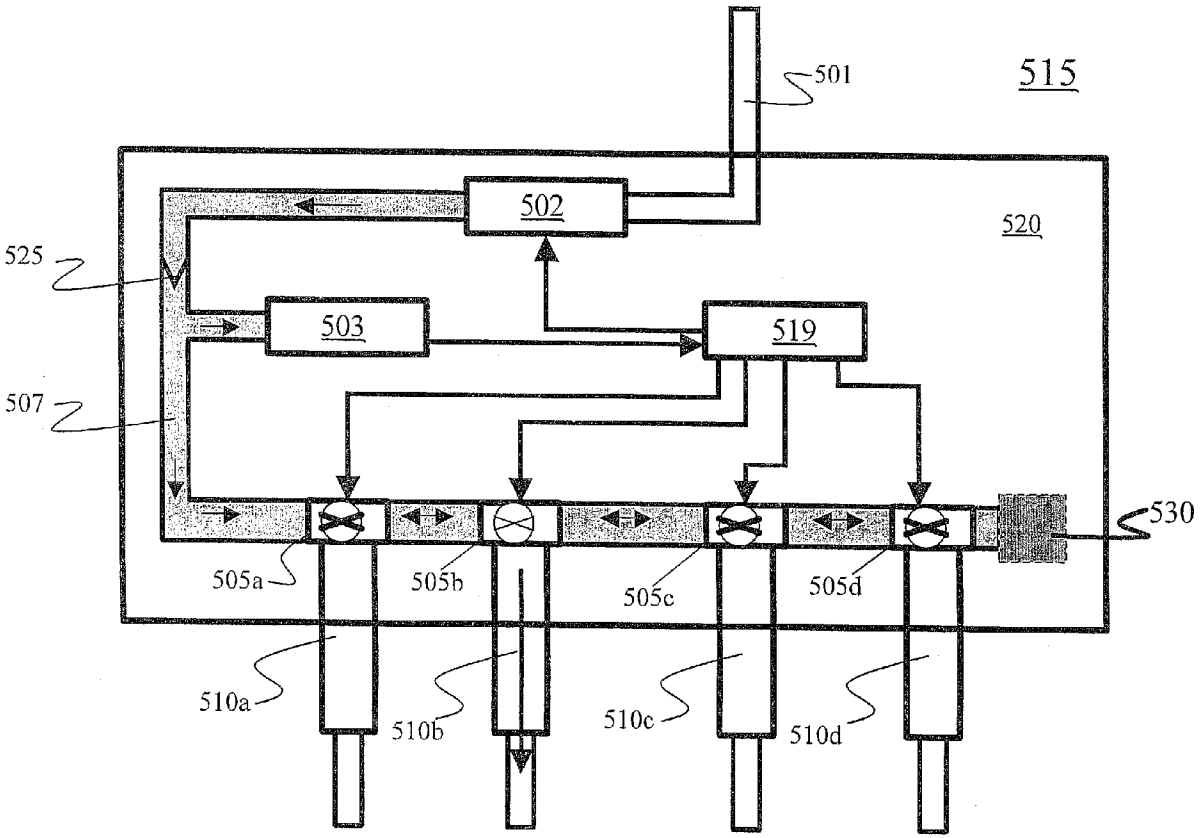
FIGS. 35-38 illustrate an inflation scheme according to one embodiment of the present invention.

FIG. 35 shows a console system generally indicated by 515 for enabling the application of pressure to a body limb. It is assumed for this discussion that the system 515, as illustrated in FIG. 35, is connected to a pressure sleeve-pressure accumulator combination as illustrated in FIG. 39.

The console system shown in FIGS. 35-38 is used when it is desired to apply pressure rapidly to a portion of a body limb. The console 515 is preferably portable and battery operated and includes an air compressor 502.

It is noted that air compressor 502 may be bypassed with pressurized air from an external source. The pressurized air would be introduced into the console 515 through pressurized air inlet 501.

In this application, the valve 505*b* is opened (in FIGS. 35-38, an open valve is denoted by light or non-bolded crossed lines) while the valves 505*a*, 505*c*, 505*d*, and release valve 530 are closed (in FIGS. 35-38, a closed valve is denoted by heavy or bolded crossed lines), causing pressurized air to flow in the conduit 507 (in FIGS. 35-38, arrows within the conduit 507 generally show the flow of air and double-ended arrows indicate either non-air flow or air flowing in both direction as dictated by the present pressure drops in the conduit 507) from the compressor 502 through the valve 505*b* into the tubular conduit 510*b* associated with a pressure accumulator (arrow indicating air flow away from console 520 to the accumulator connected to conduit 510*b*). It is noted that release valve 530 may also include a self-operated valve to allow the user to directly release the pressurized air from the system.

Figure 36:
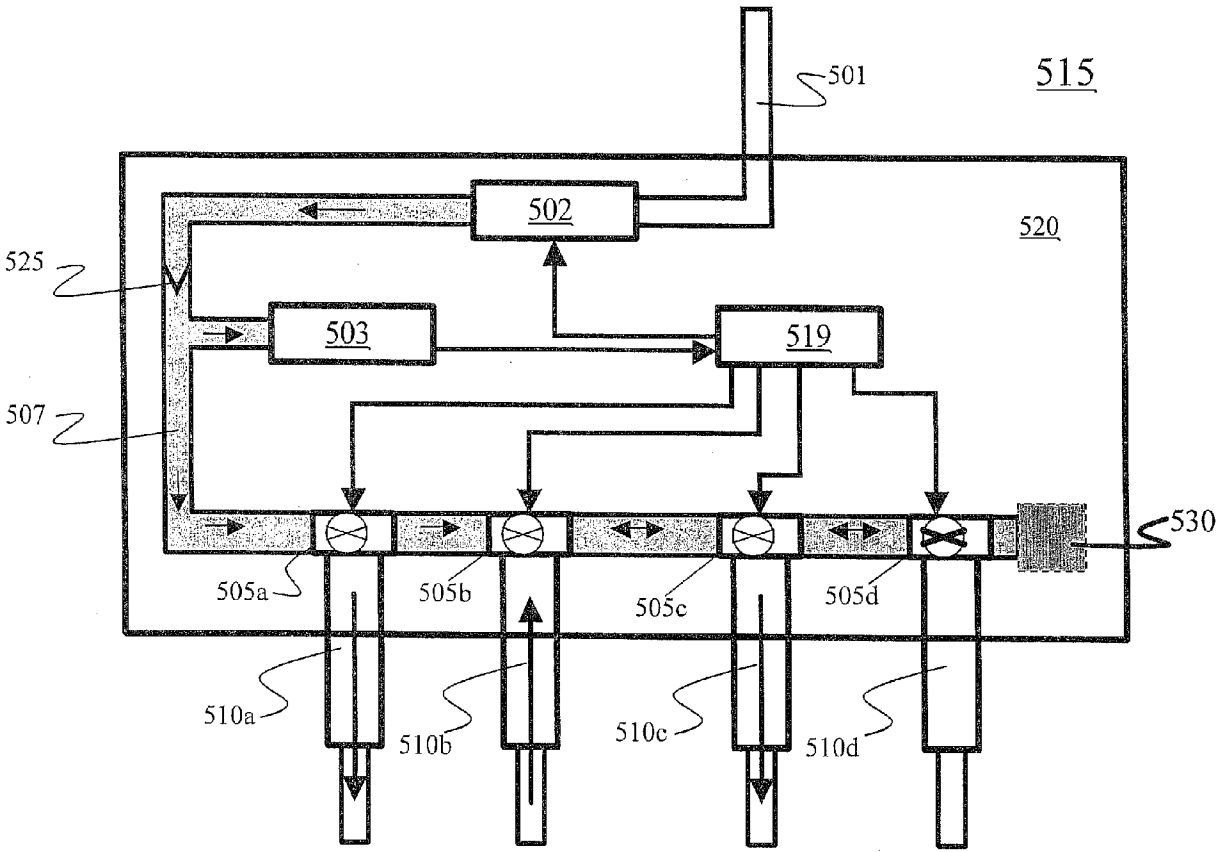

FIG. 36 illustrates the situation when the pressure in the pressure accumulator reaches a predetermined value $P_A$, as determined by the pressure gauge 503. As illustrated in FIG. 36, the processor opens the valve 505*a* causing air to flow from the associated pressure accumulator (see arrow indicating air flow from accumulator) into the cell (see arrow indicating air flow to cell). In this situation, valves 505*a*, 505*b*, and 505*c* are open, and valve 505*d* and the release valve 530 are closed. The one-way valve 525 prevents the flow of air in the conduit 507 from the pressure accumulator towards the compressor 502.

Figure 37:
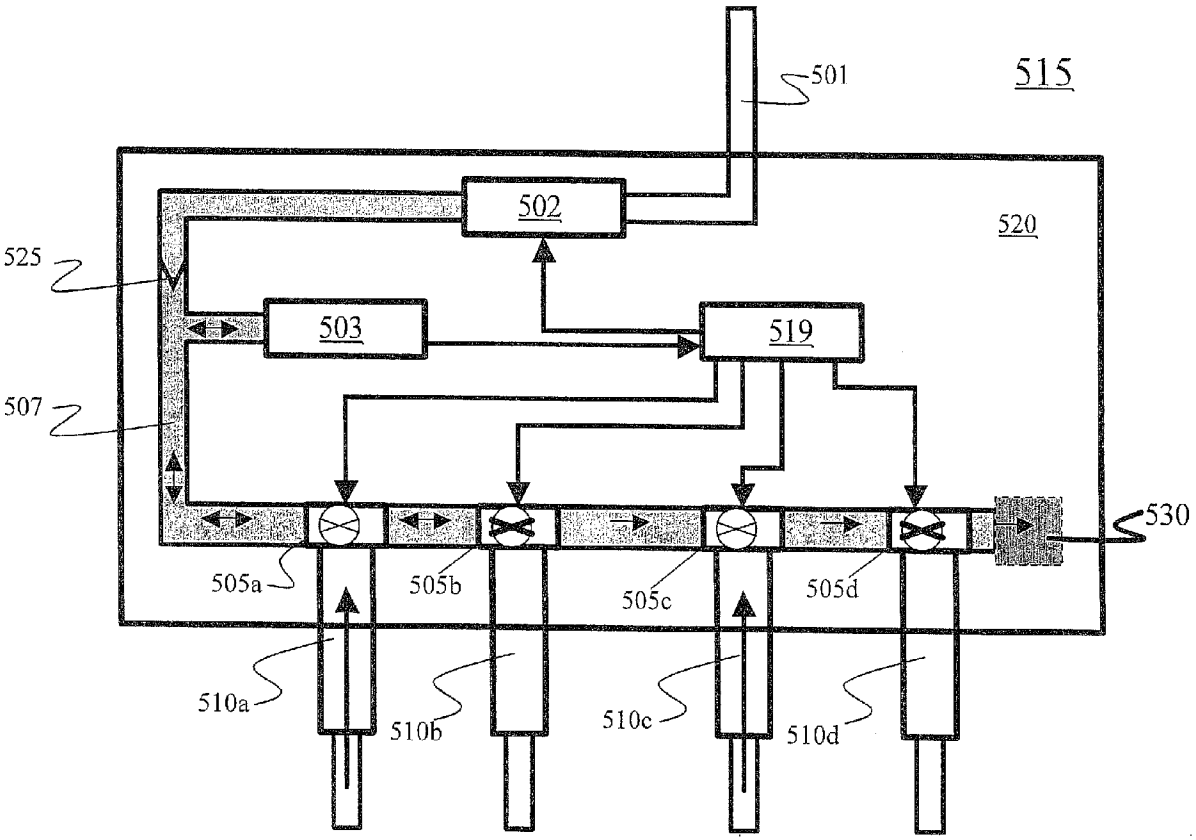

FIG. 37 illustrates the situation when the cell connected to the conduits 510*a* and 510*c* is deflated. As illustrated in FIG. 37, the processor closes the valve 505*b*. In this situation, valves 505*a* and 505*c* and the release valve 530 are open, and valves 505*b* and 505*d* are closed. The process illustrated in FIGS. 35-37 is repeated until the therapy is terminated.

Figure 38:
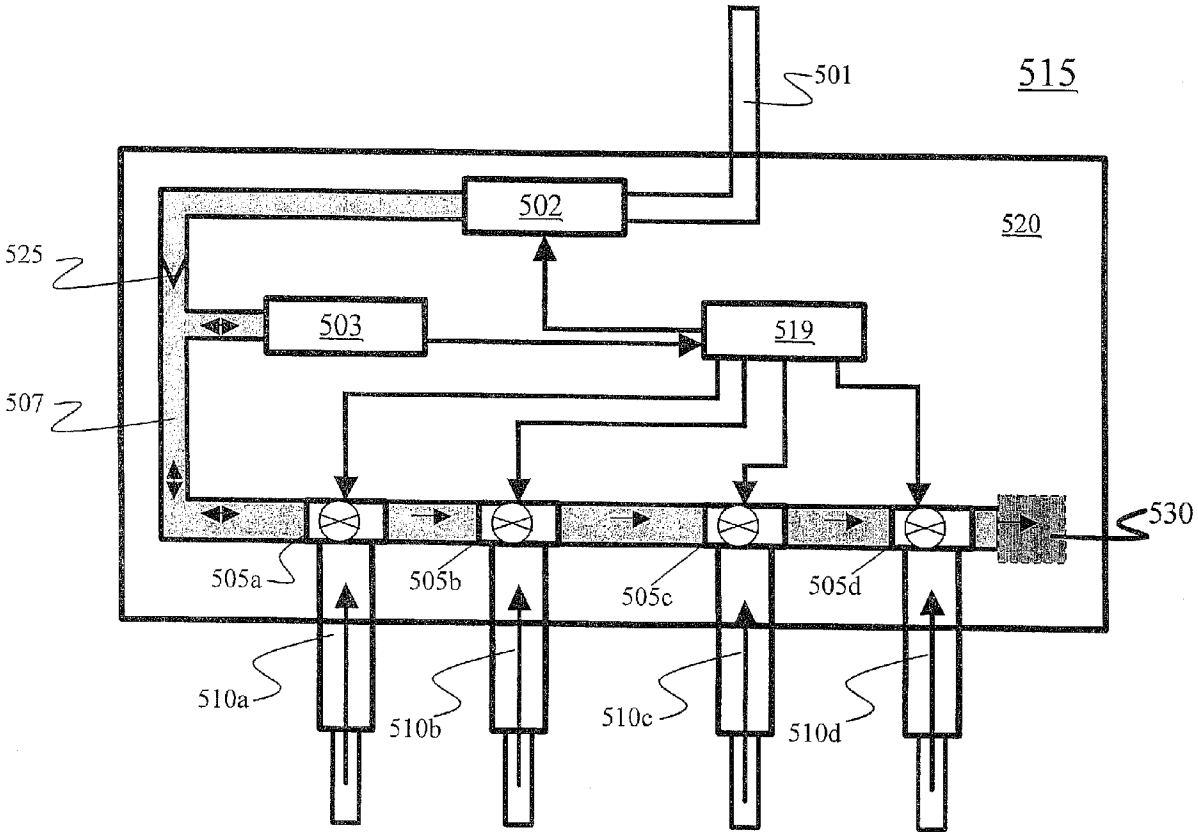

FIG. 38 illustrates the situation at the end of operations and all connected sleeves are deflated. As illustrated in FIG. 38, the processor opens all the valves to allow any pressurized air in a connected pressure device to be expelled through the release valve 530.

In summary, the present invention is directed to a compression system for applying therapeutic pressure to a limb of a body that includes a pressure sleeve; a compression system console, pneumatically connected to the pressure sleeve, having a controller and compressor to provide controlled pressurized fluid to the pressure sleeve; and a pressure accumulator, flexibly tethered and pneumatically connected to the compression system console, to provide controlled pneumatic compression.

The pressure sleeve may include an inflatable cell. The inflatable cell may include at least two intra-cell compartments, the intra-cell compartments being confluent and each compartment being elongated in a direction of the primary axis. The inflatable cell may further include inner and outer shells of durable flexible material, the inner and outer shells being bonded together about a perimetric cell bond ands being further bonded together along compartmental bonds within the perimetric cell bond to define each intra-cell compartment. The perimetric cell bond includes upper and lower perimetric cell bonds. The compartmental bonds partly extend between the upper and lower perimetric cell bonds and include perforations to allow for confluent airflow between adjacent intra-cell compartments within the cell. Adjacent intra-cell compartments are spatially fixed relative to each other, such that upon inflation of the cell, the cell becomes circumferentially constricted.

The bonds include welds. The adjacent intra-cell compartments are contiguous, and the perforations are located adjacent the perimetric cell bond. The perforations are also located between compartmental bonds extending from the upper and lower perimetric bonds.

The pressure accumulator includes a fastener device to fasten the pressure accumulator to a user of the compression system. The compression console system is portable, battery operated with a rechargeable battery. The compression system indicates an appropriate inflation and deflation sequence.

The pressure sleeve of the present invention may include an integral pressure accumulator and an inflatable cell operatively pneumatically connected to the integral pressure accumulator. The pressure sleeve of the present invention may also be a therapeutic foot device that includes a pressure sleeve; a sole member; and a pressure accumulator provided in the sole member and operatively pneumatically connected to the pressure sleeve.

As described above, the present invention also contemplates a therapeutic pressure system that includes a pressure sleeve and a compression system console, pneumatically connected to the pressure sleeve, having a controller and compressor to provide controlled pressurized fluid to the pressure sleeve. The controller, upon entering a first mode, identifies a type of the pressure sleeve connected to the compression system console. The therapeutic pressure system further includes a plurality of solenoids to convey pressurized air from the compressor to air conduits. The controller causes individual solenoids to activate so that the compressor supplies pressurized air through the activated solenoid to determine if a proper pressure device is connected thereto through an associated air conduit.

Although the various embodiments of the pressure sleeves of the present invention have been described in conjunction with a portable compression system console or small compression system console wherein the source of the pressurized air was within the console, the pressure sleeves of the present invention can be used with any compression system wherein the source of pressurized air may be without the console.

For example, it is contemplated by the present invention that the source of the air pressure for inflation of the pressure sleeves can be located in the patient's bed or be built into the wall of a room. This source of pressurized air can be directly connected to the pressure sleeves via proper air conduits (assuming that a pressure control device that regulates or control the delivery of pressurized air to the pressure sleeves is associated with the pressurized air source) or can be connected to the pressure sleeves of the present invention through a control device or system that regulates or control the delivery of pressurized air to the pressure sleeves of the present invention.

In other words, the present invention contemplates a system where the source of pressurized air is integral with the pressure control device or a system where the source of pressurized air is not integral with the pressure control device.

While various examples and embodiments of the present invention have been shown and described, it will be appreciated by those skilled in the art that the spirit and scope of the present invention are not limited to the specific description and drawings herein, but extend to various modifications and changes all as set forth in the following claims.

What is claimed is:

1. A compression system for applying therapeutic pressure to a limb of a body, comprising:

a pressure sleeve including an inflatable cell;

a compression system console, pneumatically connected to said pressure sleeve, having a controller to provide controlled pressurized fluid to said pressure sleeve; and a pressure accumulator, non-integral with said compression system console, pneumatically connected to said compression system console, to receive pressurized fluid from said compression system console and to provide controlled pneumatic compression;

said pressure accumulator including a fastening device to locate said pressure accumulator, separately from said compression system console, at a user selected location.

2. The compression system as claimed in claim 1, wherein said pressure sleeve comprises:

said inflatable cell including at least two intra-cell compartments;

said intra-cell compartments being confluent;

said inflatable cell further including inner and outer shells of durable flexible material;

said inner and outer shells being bonded together to form a perimetric cell bond;

said inner and outer shells being further bonded together along compartmental bonds;

said perimetric cell bond including upper and lower perimetric cell bonds;

said compartmental bonds partly extending between said upper and lower perimetric cell bonds to allowing for confluent airflow between adjacent intra-cell compartments within said cell.

3. The compression system as claimed in claim 2, wherein the bond comprises a weld.

4. The compression system as claimed in claim 2, wherein adjacent intra-cell compartments are contiguous.

5. The compression system as claimed in claim 1, wherein said pressure sleeve comprises:

an inflatable cell, said inflatable cell including at least two intra-cell compartments; said intra-cell compartments being confluent to allow for confluent airflow between adjacent intra-cell compartments within said cell, adjacent intra-cell compartments being spatially fixed relative to each other, such that upon inflation of said cell, said cell becomes circumferentially constricted;

said inflatable cell having a first circumference when said intra-cell compartments are deflated and a second circumference when said intra-cell compartments are inflated, said second circumference being less than said first circumference so as to provide for circumferential constriction, said second circumference being defined as a circumference passing through center points of each contiguous inflated intra-cell compartment.

6. The compression system as claimed in claim 1, wherein said compression system console includes a compressor.

7. The compression system as claimed in claim 6, wherein said compression system console is portable.

8. The compression system as claimed in claim 6, wherein said compression system console is battery operated.

9. The compression system as claimed in claim 8, wherein said compression system console comprises a rechargeable battery.

10. The compression system as claimed in claim 6, wherein said compression system console indicates an appropriate inflation and deflation sequence.

11. The compression system as claimed in claim 1, wherein said compression system console includes a pressurized air inlet to receive pressurized air for inflating said pressure sleeve and said pressure accumulator.

12. The compression system as claimed in claim 1, wherein said compression system console includes a plurality of solenoid driven valves, operatively connected to said controller;

said controller controlling an opening and closing of each of said solenoid driven valves to control the flow of said pressurized fluid to and from said pressure sleeve and to and from said pressure accumulator.

13. The compression system as claimed in claim 1, wherein said compression system console includes a self-operated valve.

14. A device comprising:

a pressure sleeve;

said pressure sleeve including, an inner shell having a flexible material portion and a rigid material portion, and an outer shell having a flexible material portion;

said inner shell and said outer shell being bonded together to form a first inflatable cell and a second inflatable cell;

said first inflatable cell including a first portion of said outer shell and said rigid material portion of said inner shell to form a pressure accumulator;

said second inflatable cell including a second portion of said outer shell and said flexible material portion of said inner shell to form a pressure application inflatable cell.

15. The device as claimed in claim 14, wherein said second inflatable cell includes two intra-cell compartments;

said intra-cell compartments being confluent, each compartment being elongated in a direction of the primary axis;

said inner and outer shells being further bonded together along compartmental bonds to define each intra-cell compartment in said second inflatable cell;

said compartmental bonds allowing for confluent airflow between adjacent intra-cell compartments within said second inflatable cell.

16. The device as claimed in claim 15, wherein the bond comprises a weld.

17. The device as claimed in claim 15, wherein adjacent intra-cell compartments are contiguous.

18. The device as claimed in claim 15, wherein said inner shell and said outer shell are bonded together to form a third inflatable cell;

said second inflatable cell including a second portion of said outer shell and said flexible material portion of said inner shell to form a second pressure application inflatable cell.

19. The device as claimed in claim 18, wherein said second inflatable cell includes at least two intra-cell compartments;

said intra-cell compartments being confluent, each compartment being elongated in a direction of the primary axis;

said inner and outer shells being further bonded together along compartmental bonds to define each intra-cell compartment in said second inflatable cell;

said compartmental bonds allowing for confluent airflow between adjacent intra-cell compartments within said second inflatable cell.

20. A compression system for applying therapeutic pressure to a limb of a body, comprising:

a pressure sleeve; and said pressure sleeve including, an inner shell having a flexible material portion and a rigid material portion, and an outer shell having a flexible material portion, said inner shell and said outer shell being bonded together to form a first inflatable cell and a second inflatable cell, said first inflatable cell including a first portion of said outer shell and said rigid material portion of said inner shell to form a pressure accumulator, said second inflatable cell including a second portion of said outer shell and said flexible material portion of said inner shell to form a pressure application inflatable cell;

a compression system console, pneumatically connected to said pressure sleeve, having a controller to provide controlled pressurized fluid to said pressure sleeve.

21. The compression system as claimed in claim 20, wherein said second inflatable cell includes two intra-cell compartments;

said intra-cell compartments being confluent, each compartment being elongated in a direction of the primary axis;

said inner and outer shells being further bonded together along compartmental bonds to define each intra-cell compartment in said second inflatable cell;

said compartmental bonds allowing for confluent airflow between adjacent intra-cell compartments within said second inflatable cell.

22. The compression system as claimed in claim 20, wherein said second inflatable cell includes two intra-cell compartments;

said intra-cell compartments being confluent to allow for confluent airflow between adjacent intra-cell compartments within said second inflatable cell.

23. The compression system as claimed in claim 20, wherein said compression system console includes a compressor.

24. The compression system as claimed in claim 20, wherein said compression system console includes a pressurized air inlet to receive pressurized air for inflating said pressure sleeve and said pressure accumulator.

25. The compression system as claimed in claim 20, wherein said compression system console includes a plurality of solenoid driven valves, operatively connected to said controller;

said controller controlling an opening and closing of each of said solenoid driven valves to control the flow of said pressurized fluid to and from said pressure sleeve and to and from said pressure accumulator.

26. The compression system as claimed in claim 20, wherein said compression system console includes a self-operated valve.

27. A therapeutic pressure system, comprising:

a pressure sleeve; and said pressure sleeve including, an inflatable cell, a pneumatic tube having a first end and a second end, said second end being connected to said inflatable cell, and a connection device connected at said first end of said pneumatic tube, said connection device including a tag, said tag providing information corresponding to a type of pressure sleeve;

a compression system console, pneumatically connected to said pressure sleeve, having a controller to provide controlled pressurized fluid to said pressure sleeve;

said controller, upon entering a first mode, identifying, from said tag of said connection device, a type of said pressure sleeve connected to said compression system console.

28. The therapeutic pressure system as claimed in claim 27, further comprising a plurality of solenoids to convey pressurized air from said compressor to air conduits.

29. The therapeutic pressure system as claimed in claim 27, wherein said controller causes individual solenoids to activate so that said compressor supplies pressurized air through the activated solenoid to determine if a proper pressure device is connected thereto through an associated air conduit.

30. The therapeutic pressure system as claimed in claim 27, wherein said tag is a mechanical tag to provide pressure device type information to said controller.

31. The therapeutic pressure system as claimed in claim 30, wherein said mechanical tag provides treatment type information to said controller.

32. The therapeutic pressure system as claimed in claim 27, wherein said tag is an electronic tag to provide pressure device type information to said controller.

33. The therapeutic pressure system as claimed in claim 32, wherein said electronic tag provides treatment type information to said controller.

34. The therapeutic pressure system as claimed in claim 27, wherein said tag is an optical tag to provide pressure device type information to said controller.

35. The therapeutic pressure system as claimed in claim 34, wherein said optical tag provides treatment type information to said controller.

36. The compression system as claimed in claim 27, wherein said compression system console includes a compressor.

37. The compression system as claimed in claim 27, wherein said compression system console includes a pressurized air inlet to receive pressurized air for inflating said pressure sleeve.

38. The compression system as claimed in claim 27, wherein said compression system console includes a plurality of solenoid driven valves, operatively connected to said controller;

said controller controlling an opening and closing of each of said solenoid driven valves to control the flow of said pressurized fluid to and from said pressure sleeve.

39. The compression system as claimed in claim 27, wherein said compression system console includes a self-operated valve.

40. A device for applying pressure to a body limb having a primary axis comprising:

a pressure sleeve including an inflatable cell;

said inflatable cell including three intra-cell compartments;

said intra-cell compartments being confluent;

said inflatable cell including inner and outer shells of durable flexible material;

said inner and outer shells being bonded together to form a perimetric bond;

said inner and outer shells being further bonded together to form a plurality of compartmental bonds within said inflatable cell, said plurality of compartmental bonds and said perimetric bond defining said intra-cell compartments;

said compartmental bonds allowing for confluent airflow between adjacent intra-cell compartments within said inflatable cell;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated; and a compression system console including control means for determining the temporo-spatial regime of cell inflation.

41. The device as claimed in claim 40, wherein a ratio of said second intra-cell compartmental dimension value to said first intra-cell compartmental dimension value is greater than 0.64.

42. An automatic portable ambulant system for applying pressure to a body limb comprising:

a sleeve including an inflatable cell;

said inflatable cell including three intra-cell compartments;

said intra-cell compartments being confluent;

said inflatable cell including inner and outer shells of durable flexible material;

said inner and outer shells being bonded together to form a perimetric bond;

said inner and outer shells being further bonded together to form a plurality of compartmental bonds within said inflatable cell, said plurality of compartmental bonds and said perimetric bond defining said intra-cell compartments;

said compartmental bonds allowing for confluent airflow between adjacent intra-cell compartments within said inflatable cell;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated; and a portable hand-held console unit for providing pressurized air to the sleeve via a conduit, said console unit including a control unit for determining the sequence of cell inflation and deflation.

43. The system as claimed in claim 42, wherein said console unit is battery operated.

44. The system as claimed in claim 43, wherein said console unit comprises a rechargeable battery.

45. The system as claimed in claim 42, wherein said console unit comprises an air compressor.

46. The system as claimed in claim 42, wherein said console unit includes a pressurized air inlet to receive pressurized air for inflating said sleeve.

47. The system as claimed in claim 42, wherein said console unit includes a plurality of solenoid driven valves, operatively connected to said controller;

said controller controlling an opening and closing of each of said solenoid driven valves to control the flow of said pressurized fluid to and from said sleeve.

48. The system as claimed in claim 42, wherein said console unit includes a self-operated valve.

49. The system as claimed in claim 42, wherein said conduit comprises a single tube for delivering fluid to said sleeve.

50. The system as claimed in claim 49, wherein said conduit comprises means for indicating to said control unit an appropriate inflation and deflation sequence.

51. The system as claimed in claim 42, wherein a ratio of said second intra-cell compartmental dimension to said first intra-cell compartmental dimension is greater than 0.64.

52. A device for applying pressure to a body limb having a primary axis comprising:

a pressure sleeve including first and second inflatable cells;

said first and second inflatable cells each including at least three intra-cell compartments;

said intra-cell compartments being confluent;

said intra-cell compartments being elongated along a longitudinal axis and being substantially rectangular in shape when deflated and substantially cylindrical in shape when inflated;

said first and second inflatable cells being adjacent each other and arranged coaxially with respect to the primary axis of the limb;

said first and second inflatable cells each including inner and outer shells of durable flexible material;

said first and second inflatable cells each including inner and outer shells of durable flexible material;

said inner and outer shells being bonded together to form a perimetric bond about a perimeter of the inflatable cell, said perimetric bond defining the inflatable cell as a volume between said inner and outer shells and within the perimetric bond;

said inner and outer shells being further bonded together to form a plurality of compartmental bonds within the inflatable cell bond, said plurality of compartmental bonds defining at least three intra-cell compartments;

said perimetric cell bond including first and second perimetric cell bond portions, said first and second perimetric cell bond portions being substantially parallel thereto, wherein a portion of said compartmental bonds partly extending between said first and second perimetric cell bond portions;

said compartmental bonds extending between said first and second perimetric cell bond portions including perforations to allow for confluent airflow between adjacent intra-cell compartments within a cell;

said first inflatable cell becoming circumferentially constricted when said intra-cell compartments of said first inflatable cell are inflated;

said second inflatable cell becoming circumferentially constricted when said intra-cell compartments of said second inflatable cell are inflated;

said first and second inflatable cells being non-confluent such that said first and second inflatable cells are separately inflatable;

means for laterally coupling outermost compartments so as to form a sleeve such that the sleeve has a first circumference value when said intra-cell compartments are deflated and a second circumference value when said intra-cell compartments are inflated, said second circumference value being less than said first circumference value so as to provide for circumferential constriction, said first circumference value being a length between the outermost intra-cell compartments of said sleeve when laterally uncoupled and deflated, said second circumference value being a length between the outermost intra-cell compartments of said sleeve when laterally uncoupled and inflated; and a compression system console including control means for determining a temporo-spatial regime of cell inflation.

53. The device as claimed in claim 52, wherein a ratio of said second circumference value to said first circumference value is greater than 0.64.

54. The device as claimed in claim 52, wherein said compression system console includes a compressor.

55. The device as claimed in claim 52, wherein said compression system console includes a pressurized air inlet to receive pressurized air for inflating said pressure sleeve.

56. The device as claimed in claim 52, wherein said compression system console includes a plurality of solenoid driven valves, operatively connected to said controller;

said controller controlling an opening and closing of each of said solenoid driven valves to control the flow of said pressurized fluid to and from said pressure sleeve.

57. The device as claimed in claim 52, wherein said compression system console includes a self-operated valve.

58. An automatic portable ambulant system for applying pressure to a body limb comprising:

a sleeve including first and second inflatable cells;

said first and second inflatable cells each including at least three intra-cell compartments;

said intra-cell compartments being confluent;

said intra-cell compartments being elongated along a longitudinal axis and being substantially rectangular in shape when deflated and substantially cylindrical in shape when inflated;

said first and second inflatable cells being adjacent each other and arranged coaxially with respect to the primary axis of the limb;

said first and second inflatable cells each including inner and outer shells of durable flexible material;

said inner and outer shells being bonded together to form a perimetric bond about a perimeter of the inflatable cell, said perimetric bond defining the inflatable cell as a volume between said inner and outer shells and within the perimetric bond;

said inner and outer shells being further bonded together to form a plurality of compartmental bonds within the inflatable cell bond, said plurality of compartmental bonds defining at least three intra-cell compartments;

said perimetric cell bond including first and second perimetric cell bond portions, said first and second perimetric cell bond portions being substantially parallel thereto, wherein a portion of said compartmental bonds partly extending between said first and second perimetric cell bond portions;

said compartmental bonds extending between said first and second perimetric cell bond portions including perforations to allow for confluent airflow between adjacent intra-cell compartments within a cell;

said first inflatable cell becoming circumferentially constricted when said intra-cell compartments of said first inflatable cell are inflated;

said second inflatable cell becoming circumferentially constricted when said intra-cell compartments of said second inflatable cell are inflated;

said first and second inflatable cells being non-confluent such that said first and second inflatable cells are separately inflatable;

means for laterally coupling the outermost intra-cell compartments within a cell so as to form a sleeve such that the sleeve has a first circumference value when said intra-cell compartments are deflated and a second circumference value when said intra-cell compartments are inflated, said second circumference value being less than said first circumference value so as to provide for circumferential constriction, said first circumference value being a length between the outermost intra-cell compartments of said sleeve when laterally uncoupled and deflated, said second circumference value being a length between the outermost intra-cell compartments of said sleeve when laterally uncoupled and inflated; and a portable hand-held compression system console for providing pressurized air to inflate selected cells of the sleeve via a conduit;

said compression system console including a control unit for determining the sequence of cell inflation and deflation.

59. The system as claimed in claim 58, wherein a ratio of said second circumference value to said first circumference value is greater than 0.64.

60. The system as claimed in claim 58, wherein said conduit comprises a single tube for delivering fluid to said sleeve.

61. The system as claimed in claim 58, wherein said conduit comprises means for indicating to said control unit an appropriate inflation and deflation sequence.

62. The system as claimed in claim 58, wherein said compression system console includes a compressor.

63. The system as claimed in claim 58, wherein said compression system console includes a pressurized air inlet to receive pressurized air for inflating said pressure sleeve.

64. The compression system as claimed in claim 58, wherein said compression system console includes a plurality of solenoid driven valves, operatively connected to said controller;

said controller controlling an opening and closing of each of said solenoid driven valves to control the flow of said pressurized fluid to and from said pressure sleeve.

65. The system as claimed in claim 58, wherein said compression system console includes a self-operated valve.

66. A device for applying pressure to a body limb having a primary axis comprising:

a pressure sleeve including an inflatable cell;

said inflatable cell including two intra-cell compartments;

said intra-cell compartments being confluent;

said inflatable cell further including inner and outer shells of durable flexible material;

said inner and outer shells being bonded together to form a perimetric cell bond;

said inner and outer shells being further bonded together to form compartmental bonds;

said compartmental bonds allowing for confluent airflow between adjacent intra-cell compartments within said inflatable cell;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated.

67. The device as claimed in claim 66, wherein a ratio of said second intra-cell compartmental dimension value to said first intra-cell compartmental dimension value is greater than 0.64.

68. The device as claimed in claim 66, further comprising a compression system console including control means for determining the temporo-spatial regime of cell inflation.

69. The device as claimed in claim 66, further comprising a compression system console including a control unit to control cell inflation and deflation.

70. The device as claimed in claim 69, wherein said compression system console includes a compressor.

71. The device as claimed in claim 69, wherein said compression system console includes a pressurized air inlet to receive pressurized air for inflating said pressure sleeve.

72. The device as claimed in claim 69, wherein said compression system console includes a plurality of solenoid driven valves, operatively connected to said controller;

said controller controlling an opening and closing of each of said solenoid driven valves to control the flow of said pressurized fluid to and from said pressure sleeve.

73. The device as claimed in claim 69, wherein said compression system console includes a self-operated valve.

74. The device as claimed in claim 69, wherein said control unit determines the temporo-spatial regime of cell inflation.

75. A device for applying pressure to a body limb having a primary axis comprising:

a pressure sleeve including an inflatable cell;

said inflatable cell including two intra-cell compartments, said intra-cell compartments being defined by compartmental bonds;

said intra-cell compartments being confluent to allow for confluent airflow between adjacent intra-cell compartments within said inflatable cell;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated.

76. The device as claimed in claim 75, wherein a ratio of said second intra-cell compartmental dimension value to said first intra-cell compartmental dimension value is greater than 0.64.

77. The device as claimed in claim 75, further comprising a compression system console including a control unit to determine a temporo-spatial regime of cell inflation.

78. The device as claimed in claim 75, further comprising a compression system console including a control unit to control cell inflation and deflation.

79. The device as claimed in claim 78, wherein said compression system console includes a compressor.

80. The device as claimed in claim 78, wherein said compression system console includes a pressurized air inlet to receive pressurized air for inflating said pressure sleeve.

81. The device as claimed in claim 78, wherein said compression system console includes a plurality of solenoid driven valves, operatively connected to said controller;

said controller controlling an opening and closing of each of said solenoid driven valves to control the flow of said pressurized fluid to and from said pressure sleeve.

82. The device as claimed in claim 78, wherein said compression system console includes a self-operated valve.

83. The device as claimed in claim 78, wherein said control unit determines a temporo-spatial regime of cell inflation.

84. The device as claimed in claim 75, further comprising a portable hand-held compression system console for providing pressurized air to said inflatable cell via a conduit;

said portable hand-held compression system console including a control unit for determining a sequence of cell inflation and deflation.

85. The device as claimed in claim 84, wherein said compression system console includes a compressor.

86. The device as claimed in claim 84, wherein said compression system console includes a pressurized air inlet to receive pressurized air for inflating said pressure sleeve.

87. The device as claimed in claim 84, wherein said compression system console includes a plurality of solenoid driven valves, operatively connected to said controller;

said controller controlling an opening and closing of each of said solenoid driven valves to control the flow of said pressurized fluid to and from said pressure sleeve.

88. The device as claimed in claim 84, wherein said compression system console includes a self-operated valve.

89. The device as claimed in claim 84, wherein said conduit comprises a single tube for delivering fluid to said inflatable cell.

90. The device as claimed in claim 89, wherein said conduit comprises means for indicating to said control unit an appropriate inflation and deflation sequence.

91. An automatic portable ambulant system for applying pressure to a body limb comprising:

a pressure sleeve including an inflatable cell;

said inflatable cell including two intra-cell compartments;

said intra-cell compartments being confluent;

said inflatable cell further including inner and outer shells of durable flexible material;

said inner and outer shells being bonded together to form a perimetric cell bond;

said inner and outer shells being further bonded together to form compartmental bonds;

said compartmental bonds allowing for confluent airflow between adjacent intra-cell compartments within said inflatable cell;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated; and a portable hand-held compression system console including a control unit for determining a sequence of cell inflation and deflation.

92. The system as claimed in claim 91, wherein said portable hand-held compression system console is battery operated.

93. The system as claimed in claim 92, wherein said portable hand-held compression system console comprises a rechargeable battery.

94. The system as claimed in claim 91, wherein said portable hand-held console unit comprises an air compressor.

95. The system as claimed in claim 91, wherein said compression system console includes a pressurized air inlet to receive pressurized air for inflating said pressure sleeve.

96. The system as claimed in claim 91, wherein said compression system console includes a plurality of solenoid driven valves, operatively connected to said controller;

said controller controlling an opening and closing of each of said solenoid driven valves to control the flow of said pressurized fluid to and from said pressure sleeve.

97. The system as claimed in claim 91, wherein said compression system console includes a self-operated valve.

98. The system as claimed in claim 91, further comprising a conduit having a single tube for delivering fluid to said inflatable cell.

99. The system as claimed in claim 98, wherein said conduit comprises means for indicating to said control unit an appropriate inflation and deflation sequence.

100. A device for applying pressure to a body limb having a primary axis comprising:

a pressure sleeve including first and second inflatable cells, each of the first and second inflatable cells including at least three intra-cell compartments;

said intra-cell compartments being confluent, each compartment being elongated along a longitudinal axis and being substantially rectangular in shape when deflated and substantially cylindrical in shape when inflated; said first and second inflatable cells being longitudinally adjacent each other and arranged coaxially with respect to the primary axis of the limb when engaged with a limb;

said first and second inflatable cells each including inner and outer shells of durable flexible material;

said inner and outer shells being bonded together to form a perimetric bond about a perimeter of the inflatable cell, said perimetric bond defining the inflatable cell as a volume between said inner and outer shells and within the perimetric bond;

said inner and outer shells being further bonded together to form a plurality of compartmental bonds within the inflatable cell bond, said plurality of compartmental bonds defining at least three intra-cell compartments; said perimetric cell bond of an inflatable cell including first and second perimetric cell bond portions, said first and second perimetric cell bond portions being substantially parallel thereto, wherein a portion of said compartmental bonds partly extending between said first and second perimetric cell bond portions;

said compartmental bonds extending between said first and second perimetric cell bond portions including perforations to allow for confluent airflow between adjacent intra-cell compartments within a cell; said adjacent intra-cell compartments within a cell being spatially fixed relative to each other such that upon inflation of said adjacent intra-cell compartments within the cell, the cell becomes circumferentially constricted;

said first and second inflatable cells being non-confluent such that that said first and second inflatable cells are separately inflatable;

said intra-cell compartments, while being inflated, substantially simultaneously expanding in a direction substantially normal to a surface of the limb and contracting in a direction substantially coaxially to the surface of the limb; means for laterally coupling outermost intra-cell compartments so as to form a sleeve; and a compression system console including control means for determining a temporo-spatial regime of cell inflation.

101. The device as claimed in claim 100, wherein said compression system console includes a compressor.

102. The device as claimed in claim 100, wherein said compression system console includes a pressurized air inlet to receive pressurized air for inflating said pressure sleeve.

103. The device as claimed in claim 100, wherein said compression system console includes a plurality of solenoid driven valves, operatively connected to said controller;

said controller controlling an opening and closing of each of said solenoid driven valves to control the flow of said pressurized fluid to and from said pressure sleeve.

104. The device as claimed in claim 100, wherein said compression system console includes a self-operated valve.

105. An automatic portable ambulant system for applying pressure to a body limb comprising:

a sleeve including first and second inflatable cells;

said first and second inflatable cells each including at least three intra-cell compartments;

said intra-cell compartments being confluent;

said intra-cell compartments being elongated along a longitudinal axis and being substantially rectangular in shape when deflated and substantially cylindrical in shape when inflated;

said first and second inflatable cells being longitudinally adjacent to each other so as to be adapted to be arranged coaxially with respect to a primary axis of a body limb;

said first and second inflatable cells each including inner and outer shells of durable flexible material;

said inner and outer shells being bonded together to form a perimetric bond about a perimeter of the inflatable cell, said perimetric bond defining the inflatable cell as a volume between said inner and outer shells and within the perimetric bond;

said inner and outer shells being further bonded together to form a plurality of compartmental bonds within the inflatable cell bond, said plurality of compartmental bonds defining at least three intra-cell compartments;

said perimetric cell bond including first and second perimetric cell bond portions, said first and second perimetric cell bond portions being substantially parallel thereto, wherein a portion of said compartmental bonds partly extending between said first and second perimetric cell bond portions;

said compartmental bonds extending between said first and second perimetric cell bond portions including perforations to allow for confluent airflow between adjacent intra-cell compartments within a cell;

said first inflatable cell becoming circumferentially constricted when said intra-cell compartments of said first inflatable cell are inflated;

said second inflatable cell becoming circumferentially constricted when said intra-cell compartments of said second inflatable cell are inflated;

said first and second inflatable cells being non-confluent such that the first and second inflatable cells are separately inflatable;

said intra-cell compartments, while being inflated, substantially simultaneously expanding in a direction substantially normal to a surface of the limb and contracting in a direction substantially coaxially to the surface of the limb;

means for laterally coupling outermost intra-cell compartments so as to form a sleeve; and a portable hand-held compression system console including a control unit for determining the sequence of cell inflation and deflation.

106. The system as claimed in claim 105, wherein said compression system console is battery operated.

107. The system as claimed in claim 106, wherein said compression system console comprises a rechargeable battery.

108. The system as claimed in claim 105, wherein said compression system console comprises an air compressor.

109. The system as claimed in claim 105, wherein said compression system console includes a pressurized air inlet to receive pressurized air for inflating said pressure sleeve.

110. The system as claimed in claim 105, wherein said compression system console includes a plurality of solenoid driven valves, operatively connected to said controller;

said controller controlling an opening and closing of each of said solenoid driven valves to control the flow of said pressurized fluid to and from said pressure sleeve.

111. The compression system as claimed in claim 105, wherein said compression system console includes a self-operated valve.

112. The system as claimed in claim 105, further comprising a conduit having a single tube for delivering fluid to said sleeve.

113. The system as claimed in claim 112, wherein said conduit comprises means for indicating to said control unit an appropriate inflation and deflation sequence.

114. A device for applying pressure to a body limb having a primary axis comprising:

a pressure sleeve including first and second inflatable cells;

said first and second inflatable cells each including at least three intra-cell compartments;

said intra-cell compartments being confluent;

said intra-cell compartments being elongated along a longitudinal axis and being substantially rectangular in shape when deflated and substantially cylindrical in shape when inflated;

said first and second inflatable cells being adjacent each other and arranged coaxially with respect to the primary axis of the limb;

said first and second inflatable cells each including inner and outer shells of durable flexible material;

said inner and outer shells being bonded together to form a perimetric bond about a perimeter of the inflatable cell, said perimetric bond defining the inflatable cell as a volume between said inner and outer shells and within the perimetric bond;

said inner and outer shells being further bonded together to form a plurality of compartmental bonds within the inflatable cell bond, said plurality of compartmental bonds defining at least three intra-cell compartments;

said perimetric cell bond including first and second perimetric cell bond portions, said first and second perimetric cell bond portions being substantially parallel thereto, wherein a portion of said compartmental bonds partly extending between said first and second perimetric cell bond portions;

said compartmental bonds extending between said first and second perimetric cell bond portions including perforations to allow for confluent airflow between adjacent intra-cell compartments within a cell;

said first inflatable cell becoming circumferentially constricted when said intra-cell compartments of said first inflatable cell are inflated;

said second inflatable cell becoming circumferentially constricted when said intra-cell compartments of said second inflatable cell are inflated;

said first and second inflatable cells being non-confluent such that said first and second inflatable cells are separately inflatable;

said intra-cell compartments, while being inflated, substantially simultaneously expanding in a direction substantially normal to a surface of the limb and contracting in a direction substantially coaxially to the surface of the limb;

means for laterally coupling outermost compartments so as to form a sleeve such that the sleeve; and a compression system console including control means for determining a temporo-spatial regime of cell inflation.

115. The device as claimed in claim 114, wherein said compression system console includes a compressor.

116. The device as claimed in claim 114, wherein said compression system console includes a pressurized air inlet to receive pressurized air for inflating said pressure sleeve.

117. The device as claimed in claim 114, wherein said compression system console includes a plurality of solenoid driven valves, operatively connected to said controller;

said controller controlling an opening and closing of each of said solenoid driven valves to control the flow of said pressurized fluid to and from said pressure sleeve.

118. The compression system as claimed in claim 114, wherein said compression system console includes a self-operated valve.

119. An automatic portable ambulant system for applying pressure to a body limb comprising:

a sleeve including first and second inflatable cells;

said first and second inflatable cells each including at least three intra-cell compartments;

said intra-cell compartments being confluent;

said intra-cell compartments being elongated along a longitudinal axis and being substantially rectangular in shape when deflated and substantially cylindrical in shape when inflated;

said first and second inflatable cells being adjacent each other and arranged coaxially with respect to the primary axis of the limb;

said first and second inflatable cells each including inner and outer shells of durable flexible material;

said inner and outer shells being bonded together to form a perimetric bond about a perimeter of the inflatable cell, said perimetric bond defining the inflatable cell as a volume between said inner and outer shells and within the perimetric bond;

said inner and outer shells being further bonded together to form a plurality of compartmental bonds within the inflatable cell bond, said plurality of compartmental bonds defining at least three intra-cell compartments;

said perimetric cell bond including first and second perimetric cell bond portions, said first and second perimetric cell bond portions being substantially parallel thereto, wherein a portion of said compartmental bonds partly extending between said first and second perimetric cell bond portions;

said compartmental bonds extending between said first and second perimetric cell bond portions including perforations to allow for confluent airflow between adjacent intra-cell compartments within a cell;

said first inflatable cell becoming circumferentially constricted when said intra-cell compartments of said first inflatable cell are inflated;

said second inflatable cell becoming circumferentially constricted when said intra-cell compartments of said second inflatable cell are inflated;

said first and second inflatable cells being non-confluent such that said first and second inflatable cells are separately inflatable;

said intra-cell compartments, while being inflated, substantially simultaneously expanding in a direction substantially normal to a surface of the limb and contracting in a direction substantially coaxially to the surface of the limb;

means for laterally coupling the outermost intra-cell compartments within a cell so as to form a sleeve; and a portable hand-held compression system console including a control unit for determining the sequence of cell inflation and deflation.

120. The device as claimed in claim 119, wherein said compression system console includes a compressor.

121. The device as claimed in claim 119, wherein said compression system console includes a pressurized air inlet to receive pressurized air for inflating said pressure sleeve.

122. The device as claimed in claim 119, wherein said compression system console includes a plurality of solenoid driven valves, operatively connected to said controller;

said controller controlling an opening and closing of each of said solenoid driven valves to control the flow of said pressurized fluid to and from said pressure sleeve.

123. The compression system as claimed in claim 119, wherein said compression system console includes a self-operated valve.

124. The system as claimed in claim 119, further comprising a conduit having a single tube for delivering fluid to said sleeve.

125. The system as claimed in claim 119, wherein said conduit comprises means for indicating to said control unit an appropriate inflation and deflation sequence.

126. A device for applying pressure to a body limb having a primary axis comprising:

a pressure sleeve including an inflatable cell;

said inflatable cell including two intra-cell compartments;

said intra-cell compartments being confluent;

said inflatable cell further including inner and outer shells;

said inner and outer shells being bonded together to form a perimetric cell bond;

said inner and outer shells being further bonded together along compartmental bonds;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated.

127. The device as claimed in claim 126, further comprising a compression system console including control means for determining a temporo-spatial regime of cell inflation.

128. The device as claimed in claim 127, wherein said compression system console includes a compressor.

129. The device as claimed in claim 127, wherein said compression system console includes a pressurized air inlet to receive pressurized air for inflating said pressure sleeve.

130. The compression system as claimed in claim 127, wherein said compression system console includes a plurality of solenoid driven valves, operatively connected to said controller;

said controller controlling an opening and closing of each of said solenoid driven valves to control the flow of said pressurized fluid to and from said pressure sleeve.

131. The compression system as claimed in claim 127, wherein said compression system console includes a self-operated valve.

132. A device for applying pressure to a body limb having a primary axis comprising:

a pressure sleeve including an inflatable cell;

said inflatable cell including two intra-cell compartments defined by intra-cell compartmental bonds;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent intra-cell compartmental bonds when said inflatable cell is deflated, said second intra-cell compartmental dimension value being a length between said adjacent intra-cell compartmental bonds when said inflatable cell is inflated.

133. The device as claimed in claim 132, further comprising a compression system console including control means for determining a temporo-spatial regime of cell inflation.

134. The device as claimed in claim 133, wherein said compression system console includes a compressor.

135. The device as claimed in claim 133, wherein said compression system console includes a pressurized air inlet to receive pressurized air for inflating said pressure sleeve.

136. The device as claimed in claim 133, wherein said compression system console includes a plurality of solenoid driven valves, operatively connected to said controller;

said controller controlling an opening and closing of each of said solenoid driven valves to control the flow of said pressurized fluid to and from said pressure sleeve.

137. The device as claimed in claim 133, wherein said compression system console includes a self-operated valve.

138. The device as claimed in claim 133, wherein said control means determines a sequence of cell inflation and deflation.

139. The device as claimed in claim 138, further comprising a conduit having a single tube for delivering fluid to said inflatable cell.

140. The device as claimed in claim 139, wherein said conduit comprises means for indicating to said control unit an appropriate inflation and deflation sequence.

141. An automatic portable ambulant system for applying pressure to a body limb comprising:

a pressure sleeve including an inflatable cell;

said inflatable cell including two intra-cell compartments;

said intra-cell compartments being confluent;

said inflatable cell further including inner and outer;

said inner and outer shells being bonded together to form a perimetric cell bond;

said inner and outer shells being further bonded together along compartmental bonds to define each intra-cell compartment;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated; and a portable hand-held compression system console including a control unit for determining a sequence of cell inflation and deflation.

142. The system as claimed in claim 141, wherein said portable hand-held compression system console is battery operated.

143. The system as claimed in claim 142, wherein said portable hand-held compression system console comprises a rechargeable battery.

144. The system as claimed in claim 141, wherein said portable hand-held compression system console comprises an air compressor.

145. The system as claimed in claim 141, wherein said compression system console includes a pressurized air inlet to receive pressurized air for inflating said pressure sleeve.

146. The system as claimed in claim 141, wherein said compression system console includes a plurality of solenoid driven valves, operatively connected to said controller;

said controller controlling an opening and closing of each of said solenoid driven valves to control the flow of said pressurized fluid to and from said pressure sleeve.

147. The system as claimed in claim 141, wherein said compression system console includes a self-operated valve.

148. The system as claimed in claim 141, further comprising a conduit having a single tube for delivering fluid to said sleeve.

149. The system as claimed in claim 148, wherein said conduit comprises means for indicating to said control unit an appropriate inflation and deflation sequence.

150. The device as claimed in claim 40, wherein said compression system console includes a compressor.

151. The device as claimed in claim 40, wherein said compression system console includes a pressurized air inlet to receive pressurized air for inflating said pressure sleeve.

152. The device as claimed in claim 40, wherein said compression system console includes a plurality of solenoid driven valves, operatively connected to said controller;

said controller controlling an opening and closing of each of said solenoid driven valves to control the flow of said pressurized fluid to and from said pressure sleeve.

153. The device as claimed in claim 40, wherein said compression system console includes a self-operated valve.

154. A device for applying pressure to a body limb having a primary axis, comprising:

a pressure sleeve including first and second inflatable cells, each of the first and second inflatable cells including three intra-cell compartments;

said intra-cell compartments being confluent;

said first and second inflatable cells each including inner and outer shells of durable flexible material;

said inner and outer shells being bonded together to form a perimetric bond;

said inner and outer shells being further bonded together to form a plurality of compartmental bonds within the inflatable cell;

said compartmental bonds allowing for confluent airflow between adjacent intra-cell compartments within a cell;

said first and second inflatable cells being non-confluent such that that said first and second inflatable cells are separately inflatable;

said first inflatable cell having a first intra-cell compartmental dimension value when said first inflatable cell is deflated and a second intra-cell compartmental dimension value when said first inflatable cell is inflated, said second intra-cell compartmental dimension value being less than said first intra-cell compartmental dimension value so as to provide for circumferential constriction of said first inflatable cell, said first intra-cell compartmental dimension value being a length between adjacent compartmental bonds of said first inflatable cell when said first inflatable cell is deflated, said second intra-cell compartmental dimension value being a length between said adjacent compartmental bonds of said first inflatable cell when said first inflatable cell is inflated;

said second inflatable cell having a first intra-cell compartmental dimension value when said second inflatable cell is deflated and a second intra-cell compartmental dimension value when said second inflatable cell is inflated, said second intra-cell compartmental dimension value being less than said first intra-cell compartmental dimension value so as to provide for circumferential constriction of said second inflatable cell, said first intra-cell compartmental dimension value being a length between adjacent compartmental bonds of said second inflatable cell when said first inflatable cell is deflated, said second intra-cell compartmental dimension value being a length between said adjacent compartmental bonds of said second inflatable cell when said second inflatable cell is inflated; and a compression system console including control means for determining a temporo-spatial regime of cell inflation.

155. A device for applying pressure to a body limb having a primary axis, comprising:

a pressure sleeve including first and second inflatable cells, each of the first and second inflatable cells including three intra-cell compartments;

said intra-cell compartments being confluent;

said first and second inflatable cells each including inner and outer shells of durable flexible material;

said inner and outer shells being bonded together to form a perimetric bond;

said inner and outer shells being further bonded together to form a plurality of compartmental bonds within the inflatable cell;

said compartmental bonds allowing for confluent airflow between adjacent intra-cell compartments within a cell;

said first and second inflatable cells being non-confluent such that that said first and second inflatable cells are separately inflatable;

said first inflatable cell having a first intra-cell compartmental dimension value when said first inflatable cell is deflated and a second intra-cell compartmental dimension value when said first inflatable cell is inflated, said second intra-cell compartmental dimension value being less than said first intra-cell compartmental dimension value so as to provide for circumferential constriction of said first inflatable cell, said first intra-cell compartmental dimension value being a length between adjacent compartmental bonds of said first inflatable cell when said first inflatable cell is deflated, said second intra-cell compartmental dimension value being a length between said adjacent compartmental bonds of said first inflatable cell when said first inflatable cell is inflated;

said second inflatable cell having a first intra-cell compartmental dimension value when said second inflatable cell is deflated and a second intra-cell compartmental dimension value when said second inflatable cell is inflated, said second intra-cell compartmental dimension value being less than said first intra-cell compartmental dimension value so as to provide for circumferential constriction of said second inflatable cell, said first intra-cell compartmental dimension value being a length between adjacent compartmental bonds of said second inflatable cell when said first inflatable cell is deflated, said second intra-cell compartmental dimension value being a length between said adjacent compartmental bonds of said second inflatable cell when said second inflatable cell is inflated; and a portable hand-held compression system console including a control unit for determining the sequence of cell inflation and deflation.

156. The pressure sleeve as claimed in claim 14, wherein said first portion of said outer shell is a rigid material portion.

157. The compression system as claimed in claim 20, wherein said first portion of said outer shell is a rigid material portion.

158. The device as claimed in claim 66, wherein said adjacent compartmental bonds being substantially parallel to the primary axis of the body limb.

159. The device as claimed in claim 158, further comprising a second inflatable cell;

said second inflatable cell including two intra-cell compartments, said intra-cell compartments being confluent;

said second inflatable cell further including inner and outer shells of durable flexible material, said inner and outer shells being bonded together to form a perimetric cell bond, said inner and outer shells being further bonded together to form compartmental bonds, said compartmental bonds allowing for confluent airflow between adjacent intra-cell compartments within said second inflatable cell;

said second inflatable cell having a first intra-cell compartmental dimension value when said inflatable cell is deflated and a second intra-cell compartmental dimension value when said second inflatable cell is inflated, said second intra-cell compartmental dimension value being less than said first intra-cell compartmental dimension value so as to provide for circumferential constriction of said second inflatable cell, said first intra-cell compartmental dimension value being a length between adjacent compartmental bonds when said second inflatable cell is deflated, said second intra-cell compartmental dimension value being a length between said adjacent compartmental bonds when said inflatable cell is second inflated, said adjacent compartmental bonds being substantially parallel to the primary axis of the body limb.

160. The device as claimed in claim 75, wherein said adjacent compartmental bonds being substantially parallel to the primary axis of the body limb.

161. The device as claimed in claim 160, further comprising a second inflatable cell;

said second inflatable cell including two intra-cell compartments, said intra-cell compartments being defined by compartmental bonds;

said intra-cell compartments being confluent to allow for confluent airflow between adjacent intra-cell compartments within said inflatable cell;

said inflatable cell having a first intra-cell compartmental dimension value when said inflatable cell is deflated and a second intra-cell compartmental dimension value when said inflatable cell is inflated, said second intra-cell compartmental dimension value being less than said first intra-cell compartmental dimension value so as to provide for circumferential constriction of said inflatable cell, said first intra-cell compartmental dimension value being a length between adjacent compartmental bonds when said inflatable cell is deflated, said second intra-cell compartmental dimension value being a length between said adjacent compartmental bonds when said inflatable cell is inflated, said adjacent compartmental bonds being substantially parallel to the primary axis of the body limb.

* * * * *

UNITED STATES PATENT AND TRADEMARK OFFICE

CERTIFICATE OF CORRECTION

PATENT NO. : 7,591,796 B1
APPLICATION NO. : 10/370283
DATED : September 22, 2009
INVENTOR(S) : Barak et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1940 days.

Signed and Sealed this

Twenty-first Day of September, 2010

David J. Kappos

David J. Kappos
*Director of the United States Patent and Trademark Office*